US007229753B2

(12) United States Patent
Oya et al.

(10) Patent No.: US 7,229,753 B2
(45) Date of Patent: Jun. 12, 2007

(54) PHOTOTHERMOGRAPHIC MATERIAL AND METHOD FOR FORMING IMAGES

(75) Inventors: Toyohisa Oya, Minami-ashigara (JP); Kouta Fukui, Minami-ashigara (JP); Yasuhiro Yoshioka, Minami-ashigara (JP); Kazunobu Katoh, Minami-ashigara (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 09/809,178

(22) Filed: Mar. 16, 2001

(65) Prior Publication Data

US 2002/0048732 A1 Apr. 25, 2002

(30) Foreign Application Priority Data

Mar. 17, 2000 (JP) ..... 2000-076273
Sep. 19, 2000 (JP) ..... 2000-283931
Jan. 10, 2001 (JP) ..... 2001-002670

(51) Int. Cl.
*G03C 1/498* (2006.01)

(52) U.S. Cl. ..... 430/619; 430/264; 430/965

(58) Field of Classification Search ..... 430/619, 430/264, 610, 600, 965
See application file for complete search history.

(56) References Cited

U.S. PATENT DOCUMENTS 3,751,249 A * 8/1973 Hiller ..... 430/353
4,021,240 A * 5/1977 Cerquone et al.
5,064,753 A * 11/1991 Sohei et al. ..... 430/567
5,851,745 A * 12/1998 Takeuchi ..... 430/505
6,013,421 A * 1/2000 Nakamura et al. ..... 430/351
6,090,538 A * 7/2000 Arai et al. ..... 430/619
6,146,822 A * 11/2000 Asanuma et al. ..... 430/619
6,174,663 B1 * 1/2001 Kato ..... 430/619

FOREIGN PATENT DOCUMENTS

EP 0 762 196 A1 3/1997
JP 10339934 A * 12/1997
JP 2000112064 * 4/2000

* cited by examiner

*Primary Examiner*—Thorl Chea
(74) *Attorney, Agent, or Firm*—Birch, Stewart, Kolasch & Birch, LLP

(57) ABSTRACT

A photothermographic material comprising at least (a) a photosensitive silver halide, (b) a reducible silver salt, (c) a reducing compound represented by the following general formula (1), and (d) a binder:

$Q^1$—NHNH—$R^1$: Formula (1)

wherein, in the general formula (1), $Q^1$ represents a 5- to 7-membered unsaturated ring bonding to NHNH—$R^1$ at a carbon atom, and $R^1$ represents a carbamoyl group, an acyl group, an alkoxycarbonyl group, an aryloxycarbonyl group, a sulfonyl group or a sulfamoyl group, provided that when $R^1$ is propylcarbamoyl group, $Q^1$ is not 2,3,5,6-tetrachloro-4-cyanophenyl group. According to the present invention, there is provided a novel photothermographic materials showing high sensitivity, high development speed and little fluctuation of performance due to heat development temperature variation.

6 Claims, 1 Drawing Sheet

PHOTOTHERMOGRAPHIC MATERIAL AND METHOD FOR FORMING IMAGES

FIELD OF THE INVENTION

The present invention relates to a photothermographic material. In particular, the present invention relates to a novel photothermographic material that shows high sensitivity, high development speed and little fluctuation of performance due to heat development temperature variation.

BACKGROUND OF THE INVENTION

There are known many photosensitive materials having a photosensitive layer on a support, with which image formation is attained by light-exposing them imagewise. Those materials include those utilizing a technique of forming images by heat treatment as systems that can contribute to the environmental protection and simplify image-forming means.

Methods for forming images by heat development are described in, for example, U.S. Pat. Nos. 3,152,904 and 3,457,075 and D. Klosterboer, "Thermally Processed Silver Systems", Imaging Processes and Materials, Neblette, 8th ed., compiled by J. Sturge, V. Walworth and A. Shepp, Chapter 9, p.279, (1989). Such photothermographic materials comprise a reducible non-photosensitive silver source (e.g., silver salt of an organic acid), a photocatalyst (e.g., silver halide) in a catalytically active amount and a reducing agent for silver, which are usually dispersed in an organic binder matrix. While the photosensitive materials are stable at an ordinary temperature, when they are heated to a high temperature (e.g., 80° C. or higher) after light exposure, silver is produced through an oxidation-reduction reaction between the reducible silver source (which functions as an oxidizing agent) and the reducing agent. The oxidation-reduction reaction is accelerated by catalytic action of a latent image generated upon exposure. The silver produced from the reaction of the reducible silver salt in the exposed areas shows black color and provides contrast with respect to the non-exposed areas, and thus images are formed.

For photothermographic materials using silver salt of an organic acid, reducing agents of a wide range have been disclosed. There can be mentioned, for example, the reducing agents disclosed in Japanese Patent Laid-open Publication (Kokai, hereinafter referred to as JP-A) 46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,667,9586, 3,679,426, 3,751,252, 3,751,255, 3,761,270, 3,782,949, 3,839,048, 3,928,686 and 5,464,738, German Patent No. 2,321,328, European Patent Publication (hereinafter referred to as EP-A) No. 692,732 and so forth.

Specific examples thereof include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with ascorbic acid such as a combination of 2,2-bis(hydroxymethyl)-propionyl-β-phenylhydrazine with ascorbic acid; combinations of polyhydroxybenzene with hydroxylamine, reductone and/or hydrazine such as a combination of hydroquinone with bis(ethoxyethyl)hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzenesulfonamidophenol; α-cyanophenylacetic acid derivatives such as ethyl-α-cyano-2-methylphenylacetate and ethyl-α-cyanophenylacetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl)methane; combinations of a bis-β-naphthol with a 1,3-dihydroxybenzene derivative (e.g., 2,4-dihydroxybenzophenone, 2,4-dihydroxy-acetophenone); 5-pyrazolones such as 3-methyl-1-phenyl-5-pyrazolone; reductones such as dimethylaminohexose reductone, anhydrodihydroaminohexose reductone and anhydrodihydro-piperidonehexose reductone; sulfonamidophenol reducing agents such as 2,6-dichloro-4-benzenesulfonamidophenol and p-benzenesulfonamidophenol; 2-phenylindane-1,3-dione etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methyl-phenyl)propane, 4,4-ethylidene-bis(2-t-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; and chromanols such as tocopherol.

Among those known reducing agents, hindered phenol compounds and bisphenol compounds are widely used. However, photothermographic materials utilizing these reducing agents may suffer from problems, for example, they may require long development time for obtaining sufficient image density, they show significant sensitivity fluctuation with respect to development temperature and so forth. Therefore, techniques for solving these problems have been investigated.

As means for solving these problems, development accelerators, particularly reducing agent, have been put into practical use. For example, JP-A-10-221806 discloses sulfonamidophenol compounds.

Hydrazine derivatives are known for a reducing agent in a photothermographic material. As is disclosed in U.S. Pat. No. 5,496,695 and JP-A-9-304875, ultrahigh contrast image can be obtained by using a hydrazine derivative in a photothermographic material for photomechanical reproduction. When the derivatives disclosed in these prior art references are added to a photothermographic material which does not necessitate ultrahigh contrast image, such as a photothermographic material for medical use, there may be caused problems such as strong fog, too high contrast, low image reproductivity. They will not be on a commercial basis.

However, even when such known development accelerators and known hydrazine derivatives as mentioned above are used, there may be caused problems such as insufficient development accelerating action, too high contrast, low image reproductivity and insufficient stability of photosensitive materials during storage thereof due to various factors including combination of other additives, production conditions of photosensitive materials, development temperature, lapse of time and so forth, and solution for these problems have constituted an important object in designing of photothermographic materials. Therefore, there has been desired a photothermographic material that solves the problems.

SUMMARY OF THE INVENTION

An object of the present invention is to solve the aforementioned problems of the prior art. That is, the object to be achieved by the present invention is to provide a photothermographic material that shows high sensitivity, high development speed and little fluctuation of performance due to heat development temperature variation.

The inventors of the present invention assiduously studied in order to achieve the aforementioned objects. As a result, they found that excellent photothermographic materials that provide the desired effects could be obtained by using reducing compounds having a particular structure (developing agents collectively called hydrazine developing agents) in photothermographic materials comprising at least a photosensitive silver halide, a reducible silver salt and a binder on the same surface of a support, and thus accomplished the present invention.

That is, the present invention provides a photothermographic material comprising at least (a) a photosensitive silver halide, (b) a reducible silver salt, (c) a reducing compound represented by the following general formula (1), and (d) a binder:

$Q^1$—NHNH—$R^1$ Formula (1):

wherein, in the general formula (1), $Q^1$ represents a 5- to 7-membered unsaturated ring bonding to NHNH—$R^1$ at a carbon atom, and $R^1$ represents a carbamoyl group, an acyl group, an alkoxycarbonyl group, an aryloxycarbonyl group, a sulfonyl group or a sulfamoyl group, provided that when $R^1$ is propylcarbamoyl group, $Q^1$ is not 2,3,5,6-tetrachloro-4-cyano-phenyl group.

Preferably, in the compound represented by the general formula (1), $R^1$ represents a substituted carbamoyl group. $Q^1$preferably represents a substituted phenyl group in which the sum of Hammett σp values of the substituents on the phenyl group is 1.6 or more. More preferably, $Q^1$ represents a substituted phenyl group in which the sum of Hammett σp values of the substituents on the phenyl group is 1.6 or more, $R^1$ is a substituted carbamoyl group represented by —C(═O)—NH—$R^{11}$ and $R^{11}$ is an alkyl or aryl group having 1–10 carbon-atoms.

In the compound represented by the general formula (1), $Q^1$ preferably represents a 5- to 7-membered unsaturated heteroring such as a quinazoline ring, bonding to NHNH—$R^1$ at a carbon atom. More preferably, $Q^1$ represents a quinazoline ring bonding to NHNH—$R^1$ at a carbon atom, $R^1$ is a substituted carbamoyl group represented by —C(═O)—NH—$R^1$ and $R^{11}$ is an alkyl group or an aryl group having 1–10 carbon atoms.

Preferably, the compound represented by the general formula (1) does not function as an ultrahigh contrast agent.

Preferably, the photothermographic material of the present invention is characterized by further containing (e) a compound represented by the general following formula (2) or (3) on the same surface of the support.

Formula (2)

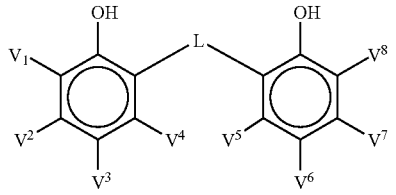

In the general formula (2), $V^1$ to $V^8$ each independently represent hydrogen atom or a substituent. L represents a bridging group consisting of —CH($V^9$)— or —S—. $V^9$ represents hydrogen atom or a substituent.

Formula (3)

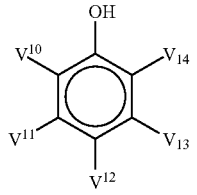

In the general formula (3), $V^{10}$ to $V^{14}$ each independently represent hydrogen atom or a substituent.

Preferably, the amount of the compound represented by the general formula (1) is 0.1–10 mole % of the amount of the compound represented by the general formula (2) or (3). Preferably, the photothermographic material of the present invention further comprises (g) a hydrogen bond-forming compound.

Preferably, the photothermographic material of the present invention further comprises (g) a hydrogen bond-forming compound on the same surface of the support.

Preferably, the photothermographic material of the present invention further comprises (f) a compound represented by the general formula (4) on the same surface of the support.

Formula (4)

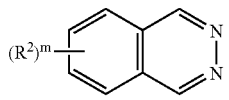

In the general formula (4), $R^2$ represents hydrogen atom or a monovalent substituent, and m represents an integer of 1 to 6. ($R^2$)m means that 1–6 of Y independently exist on the phthalazine ring, and when m is 2 or more, adjacent two of $R^2$ may form an aliphatic ring or an aromatic ring.

Preferably, in the general formula (4), $R^2$ represents a monovalent substituent, and m represents an integer of 1 to 6.

Preferably, (b) the reducible silver salt is a silver salt of a long chain aliphatic carboxylic acid.

According to another aspect of the present invention, there is provided a method for forming images, which comprises developing the aforementioned photothermographic material of the present invention by heating to form a silver image.

In the method for forming images of the present invention, the heat development is preferably performed at a temperature of 100–117° C.

In the present specification, ranges indicated with "-" mean ranges including the numerical values before and after "-" as the minimum and maximum values. Hammett σp values are described in, for example, Chem. Rev., 91, 165–195 (1991).

According to the present invention, there can be obtained novel photothermographic materials showing high sensitivity, high development speed and little fluctuation of performance due to heat development temperature variation.

PREFERRED EMBODIMENTS OF THE INVENTION

Figure 1:
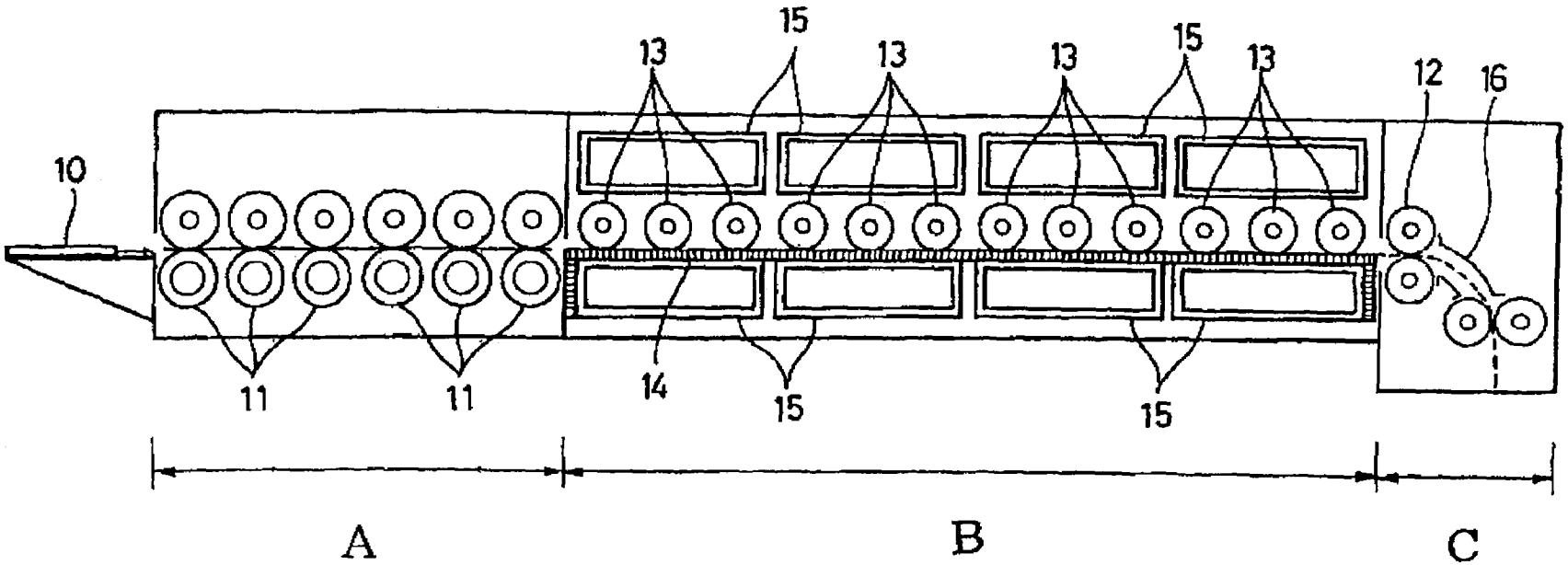
FIG. 1 is a side view of an exemplary heat development apparatus used for heat development of the photothermographic material of the present invention. In the figure, there are shown a photothermographic material 10, carrying-in roller pairs 11, carrying-out roller pairs 12, rollers 13, a flat surface 14, heaters 15, and guide panels 16. The apparatus consists of a preheating section A, a heat development section B, and a gradual cooling section C.

The photothermographic material of the present invention comprises an image-forming layer containing a silver salt of an organic acid, which is a reducible silver salt, and a binder, and a photosensitive silver halide emulsion layer (photosensitive layer) containing a photosensitive silver halide on the same surface of a support. The image-forming layer preferably contains a photosensitive silver halide to also serve as a photosensitive layer. The photothermographic material of the present invention further comprises a reducing compound represented by the general formula (1) on the image-forming layer side, and thus it can be a photothermographic material that shows high sensitivity, high development speed and little fluctuation of performance due to heat development temperature variation.

The photothermographic material of the present invention comprises a reducing compound represented by the aforementioned general formula (1) on the same surface of a support as the photosensitive silver halide and the reducible silver salt.

In the formula, $Q^1$ represents a 5- to 7-membered unsaturated ring bonding to NHNH—$R^1$ at a carbon atom, and $R^1$ represents a carbamoyl group, an acyl group, an alkoxycarbonyl group, an aryloxycarbonyl group, a sulfonyl group or a sulfamoyl group, provided that when $R^1$ is propylcarbamoyl group, $Q^1$ is not 2,3,5,6-tetrachloro-4-cyanophenyl group.

Preferred examples of the 5- to 7-membered unsaturated heteroring represented by $Q^1$ include benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isoxazole ring, thiophene ring and so forth. Condensed rings in which these rings are condensed together are also preferred.

These rings may have one or more substituents. When they have two or more substituents, those substituents may be identical or different from each other or one another. Examples of the substituents include a halogen atom, an alkyl group, an aryl group, a carbonamido group, an alkylsulfonamido group, an arylsulfonamido group, an alkoxy group, an aryloxy group, an alkylthio group, an arylthio group, a carbamoyl group, a sulfamoyl group, cyano group, an alkylsulfonyl group, an arylsulfonyl group, an alkoxycarbonyl group, an aryloxycarbonyl group and an acyl group. When these substituents are groups that can be substituted, they may further have one or more substituents. Preferred examples of such substituents include a halogen atom, an alkyl group, an aryl group, a carbonamido group, an alkylsulfonamido group, an arylsulfonamido group, an alkoxy group, an aryloxy group, an alkylthio group, an arylthio group, an acyl group, an alkoxycarbonyl group, an aryloxycarbonyl group, a carbamoyl group, cyano group, a sulfamoyl group, an alkylsulfonyl group, an arylsulfonyl group and an acyloxy group.

The carbamoyl group represented by $R^1$ has preferably 1–50 carbon atoms, more preferably 2–40 carbon atoms, further more preferably 2–11 carbon atoms. Examples thereof include, for example, unsubstituted carbamoyl, methylcarbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}-carbamoyl, N-(2-hexyldecyl)carbamoyl, N-phenylcarbamoyl, N-(4-dodecyloxyphenyl)carbamoyl, N-(2-chloro-5-dodecyloxy-carbonylphenyl)carbamoyl, N-naphthylcarbamoyl, N-3-pyridylcarbamoyl and N-benzylcarbamoyl.

The acyl group represented by $R^1$ has preferably 1–50 carbon atoms, more preferably 6–40 carbon atoms. Examples thereof include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl and 2-hydroxymethylbenzoyl.

The alkoxycarbonyl group represented by $R^1$ has preferably 2–50 carbon atoms, more preferably 6–40 carbon atoms. Examples thereof include, for example, methoxycarbonyl, ethoxycarbonyl, isobutyloxycarbonyl, cyclohexyloxycarbonyl, dodecyloxycarbonyl and benzyloxycarbonyl.

The aryloxycarbonyl group represented by $R^1$ has preferably 7–50 carbon atoms, more preferably 7–40 carbon atoms. Examples thereof include, for example, phenoxycarbonyl, 4-octyloxyphenoxycarbonyl, 2-hydroxymethylphenoxycarbonyl and 4-dodecyloxyphenoxycarbonyl.

The sulfonyl group represented by $R^1$ has preferably 1–50 carbon atoms, more preferably 6–40 carbon atoms. Examples thereof include, for example, methylsulfonyl, butylsulfonyl, octylsulfonyl, 2-hexadecylsulfonyl, 3-dodecyloxypropylsulfonyl, 2-octyloxy-5-tert-octylphenylsulfonyl and 4-dodecyloxyphenylsulfonyl.

The sulfamoyl group represented by $R^1$ has preferably 0–50 carbon atoms, more preferably 6–40 carbon atoms. Examples thereof include, for example, unsubstituted sulfamoyl, N-ethylsulfamoyl, N-(2-ethylhexyl)sulfamoyl, N-decylsulfamoyl, N-hexadecylsulfamoyl, N-{3-(2-ethylhexyloxy)propyl}-sulfamoyl, N-(2-chloro-5-dodecyloxycarbonylphenyl)sulfamoyl and N-(2-tetradecyloxyphenyl) sulfamoyl.

The groups represented by $R^1$ may further have at substitutable positions one or more of the groups mentioned above as substituents of the unsaturated 5- to 7-membered ring represented by $Q^1$. When they have two or more substituents, those substituents may be identical or different from each other or one another.

Among the compounds represented by the general formula (1), preferred are those where $Q^1$ is a 5- to 7-membered unsaturated heteroring bonding to NHNH—$R^1$ at a carbon atom, or a substituted phenyl group in which the sum of Hammett σp values of the substituents on the phenyl group is 1.6 or more. More preferably, $Q^1$ is a substituted phenyl group in which the sum of Hammett σp values of the substituents on the phenyl group is 1.6 or more, quinazoline ring, pyrimidine ring, 1,2,3-triazole ring, 1,2,4-triazole ring, tetrazole ring, 1,3,4-thiadiazole ring, 1,2,4-thiadiazole ring, 1,3,4-oxadiazole ring, 1,2,4-oxadiazole ring, thiazole ring, oxazole ring, isothiazole ring, isoxazole ring or a ring consisting of any of these rings condensed with an unsaturated heterocyclic ring. Particularly preferably, $Q^1$ is a quinazoline ring or a substituted phenyl group in which the sum of Hammett σp values of the substituents on the phenyl group is 1.6 or more.

Further preferably, $Q^1$ has at least one electron-withdrawing group. Examples of preferable substituents include, fluoroalkyl groups such as trifluoromethyl, pentafluoroethyl, 1,1-difluoroethyl, difluoromethyl, fluoromethyl, pentafluoropropyl, pentafluorophenyl; cyano group, halogen atoms such as flourine atom, chlorine atom, bromine atom, iodine atom; acyl groups; alcoxycarbonyl groups; carbomoyl groups; alkylsulhonyl groups such as methanesulfonyl, ethanesulfonyl, propanesulfonyl; arylsuofonyl groups such as benzenesulfonyl, p-toluene sulfonyl, 4-(methanesuofonylamino)phenylsuofonyl; nitro group. Particularly preferable substituent is, for example, trifluoromethyl.

Examples of the substituted phenyl groups in which the sum of Hammett σp values of the substituents on the phenyl group is 1.6 or more include 3,4-dicyano-6-(propanesulfonyl)phenyl, 3,4-dicyano-6-(methanesulfonyl)phenyl, 3,4,6-tri(methane-sulfonyl)phenyl, and 3,4-dicyano-6-(4-(methanesulfonyl-amino)phenyl)sulfonyl)phenyl.

$R^1$ is preferably a carbamoyl group. Particularly preferable $R^1$ is a substituted carbamoyl group represented by —C(═O)—NH—$R^{11}$ and $R^{11}$ is an alkyl group or an aryl group having 1–10 carbon atoms.

It is not completely clear why preferable compounds of formula (1) are those where $Q^1$ is a 5- to 7-membered unsaturated heteroring bonding to NHNH—$R^1$ at a carbon atom, or a substituted phenyl group in which the sum of Hammett σp values of the substituents on the phenyl group is 1.6 or more. It is known that reducing agent having a smaller acid dissociation constant generally exert a stronger reduction activity. It is unknown that the compounds represented by the formula (1) exert development accelerating action in a photothermographic material. The relation between the chemical structure and activity of the compounds is also unknown. The extensive study by the present inventors has revealed that preferable effects can be obtained by using the compounds of formula (1) where $Q^1$ is a 5- to 7-membered unsaturated ring bonding to NHNH—$R^1$ at a carbon atom, particularly a 5- to 7-membered unsaturated heteroring bonding to NHNH—$R^1$ at a carbon atom, or a substituted phenyl group in which the sum of Hammett σp values of the substituents on the phenyl group is 1.6 or more.

Specific examples of the reducing compounds represented by the general formula (1) will be listed below. However, the compounds used for the present invention are not limited by these specific examples.

D-101

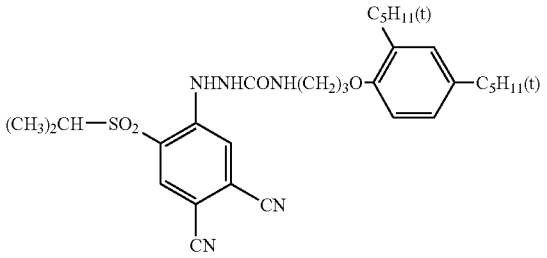

D-102

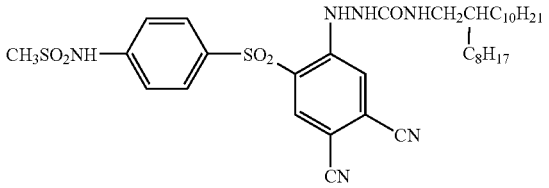

D-103

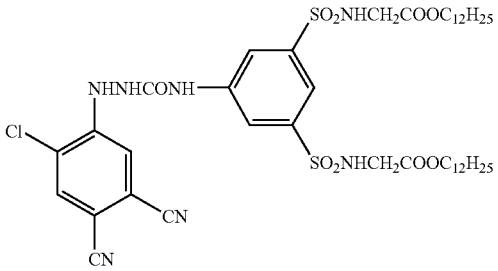

D-104

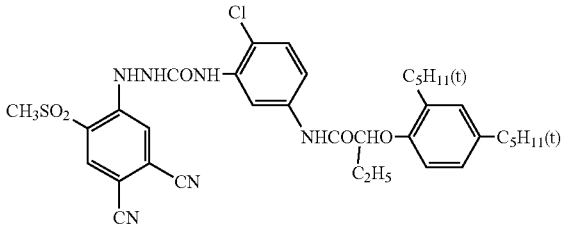

-continued
D-105
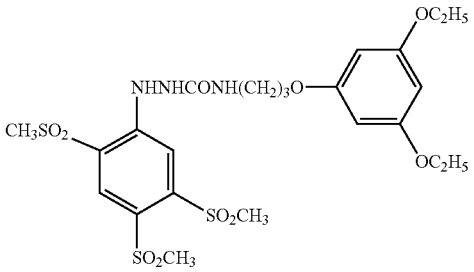
D-106
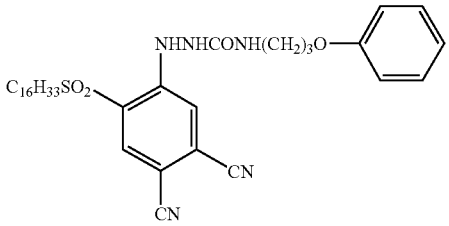
D-107
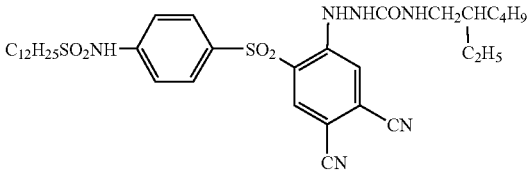
D-108
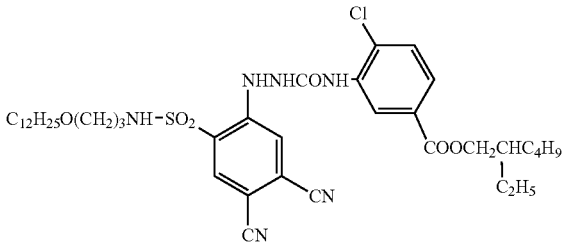
D-109
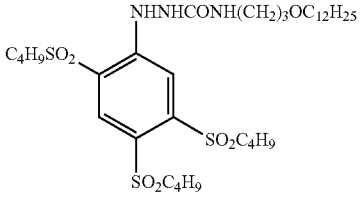
D-110
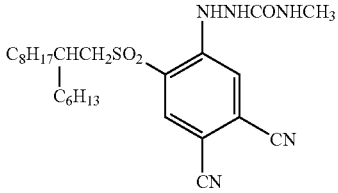
D-111
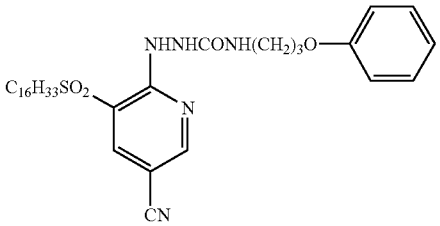
D-112
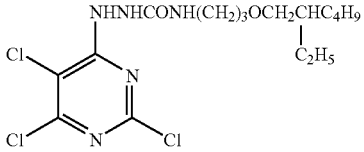
D-113
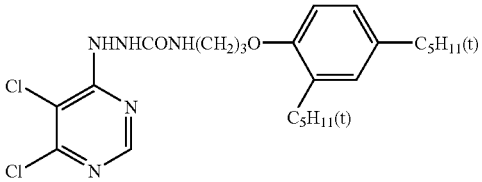
D-114
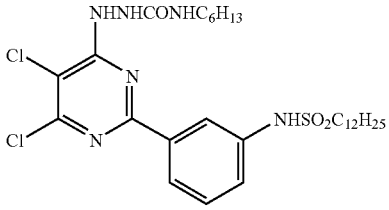
D-115
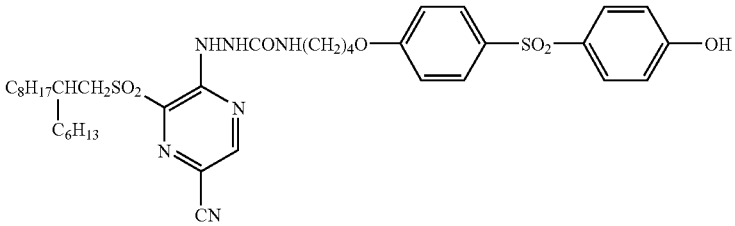

-continued
D-116
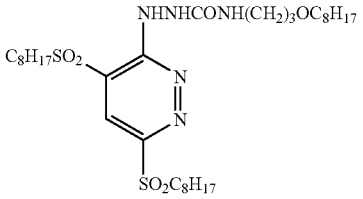
D-117
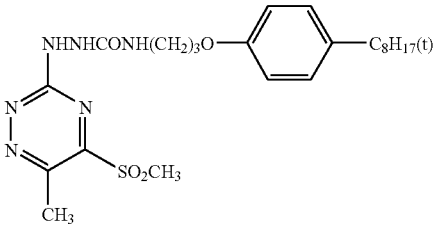
D-118
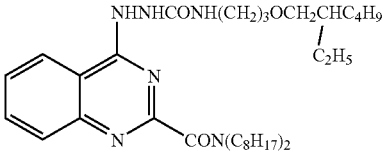
D-119
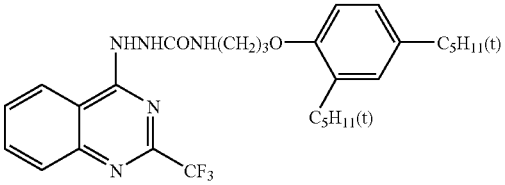
D-120
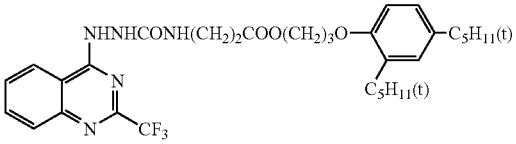
D-121
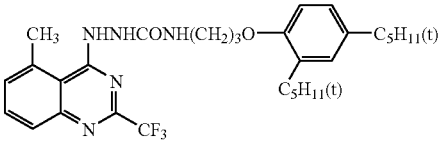
D-122
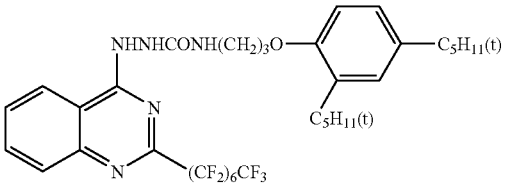
D-123
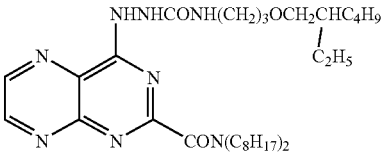
D-124
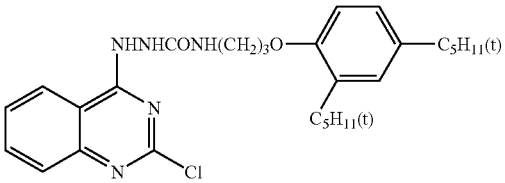
D-125
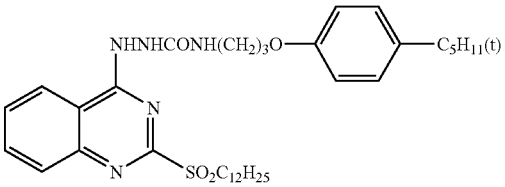
D-126
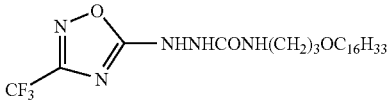
D-127
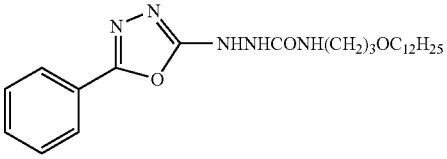
D-128
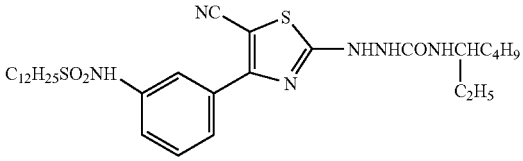
D-129
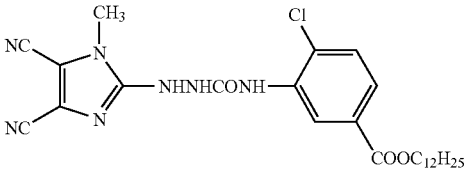
D-130
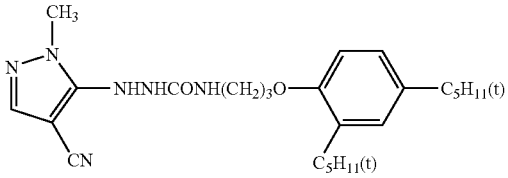
D-131
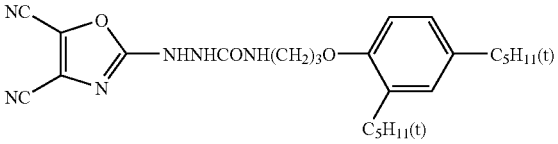

-continued
D-132
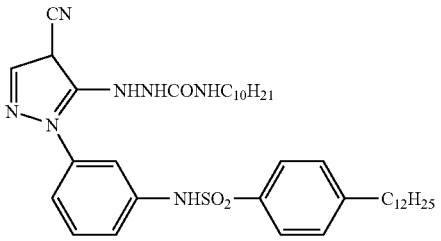
D-133
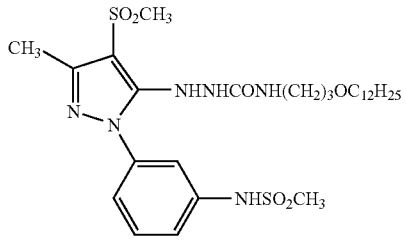
D-134
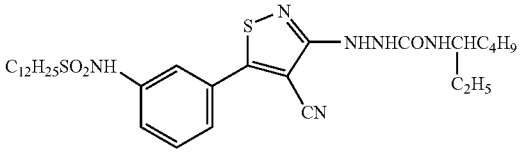
D-135
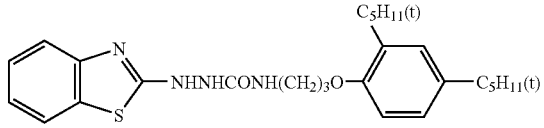
D-136
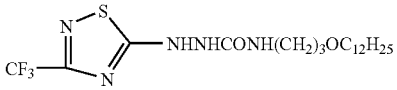
D-137
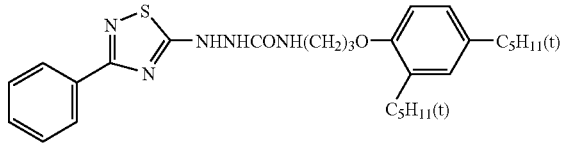
D-138
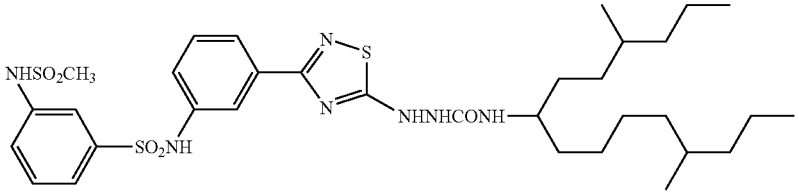
D-139
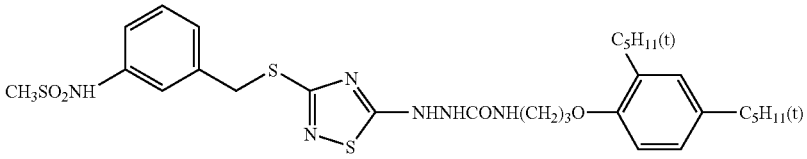
D-140
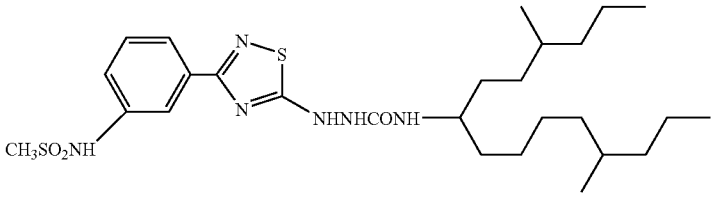
D-141
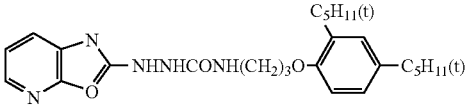
D142
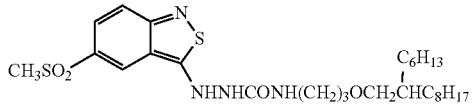
D-143
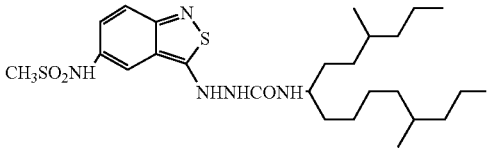
D-144
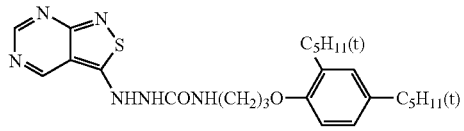
D-145
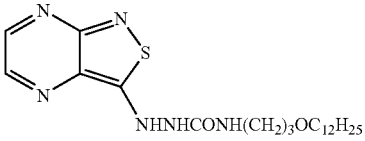
D-146
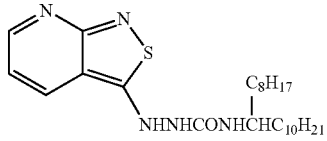

-continued
D-147
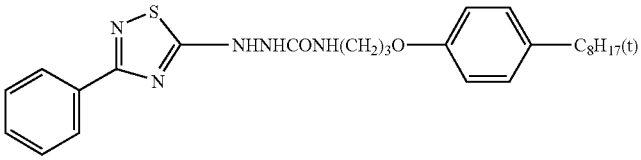
D-148
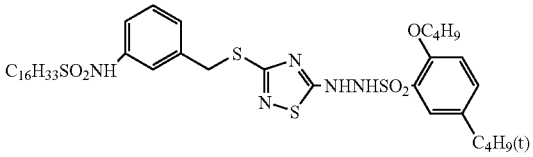
D-149
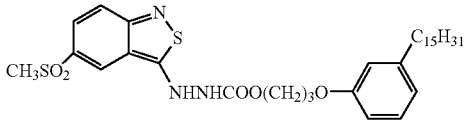
D-150
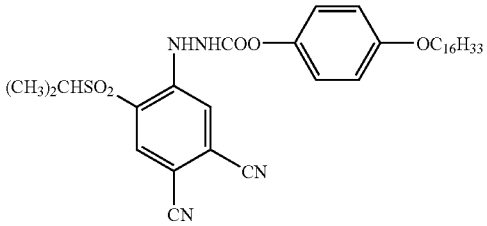
D-151
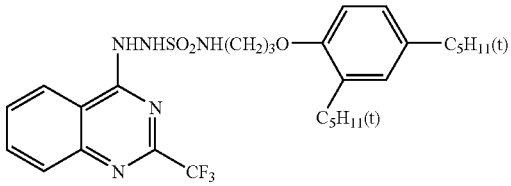
D-152
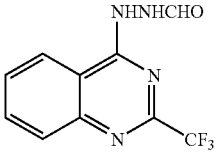
D-153
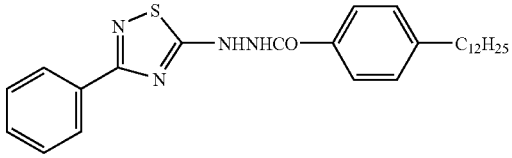
D-154
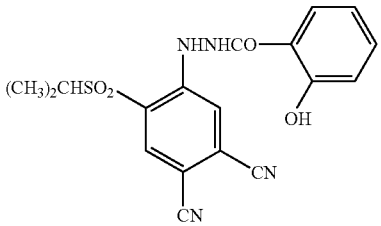
-continued
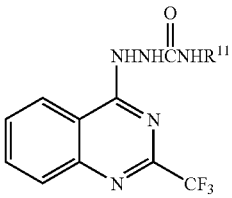
| No. | $R^{11}$ |
|---|---|
| D-155 | $CH_3$ |
| D-156 | $C_2H_5$ |
| D-157 | n-$C_3H_7$ |
| D-158 | i-$C_3H_7$ |
| D-159 | n-$C_4H_9$ |
| D-160 | i-$C_4H_9$ |
| D-161 | sec-$C_4H_9$ |
| D-162 | t-$C_4H_9$ |
| D-163 | n-$C_5H_{11}$ |
| D-164 | t-$C_5H_{11}$ |
-continued
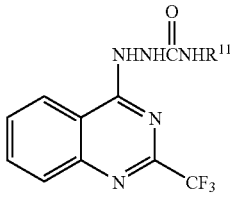
| No. | $R^{11}$ |
|---|---|
| D-165 | n-$C_6H_{13}$ |
| D-166 | 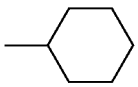 |
| D-167 | n-$C_8H_{17}$ |
| D-168 | t-$C_8H_{17}$ |

-continued
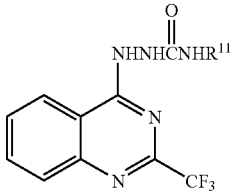
| No. | $R^{11}$ |
|---|---|
| D-169 | 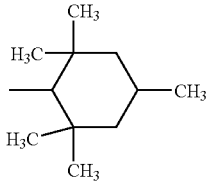 |
| D-170 | 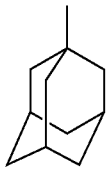 |
| D-171 | 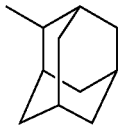 |
| D-172 | 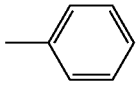 |
| D-173 | 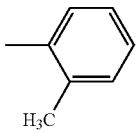 |
| D-174 | 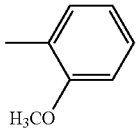 |
| D-175 | 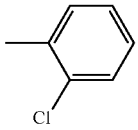 |
| D-176 | 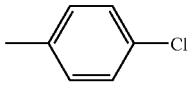 |
| D-177 | 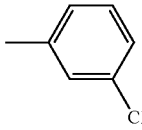 |
-continued
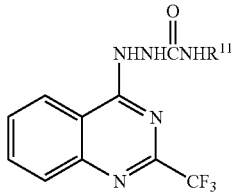
| No. | $R^{11}$ |
|---|---|
| D-178 | 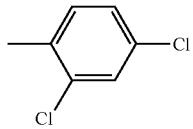 |
| D-179 | 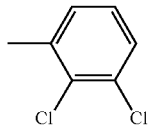 |
| D-180 | 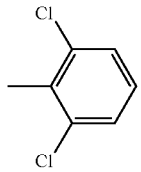 |
| D-181 | 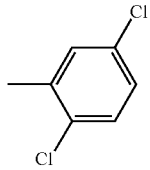 |
| D-182 | 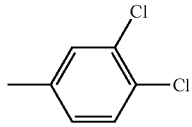 |
| D-183 | 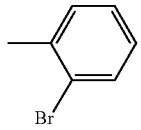 |
| D-184 | 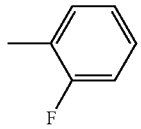 |
| D-185 | 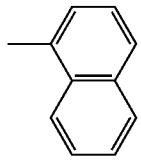 |

-continued
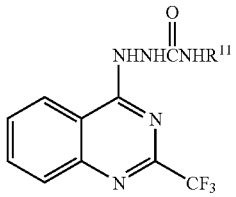
| No. | $R^{11}$ |
|---|---|
| D-186 | 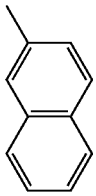 |
| D-187 | $CH_2C_6H_5$ |
| D-188 | $CH_2CH_2OC_6H_5$ |
| D-189 | $CH_2CH_2OCH_2CH_3$ |
| D-190 | $CH_2CH_2OCH_3$ |
D-191
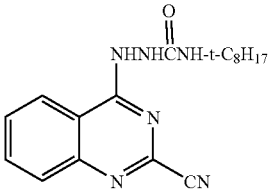
D-192
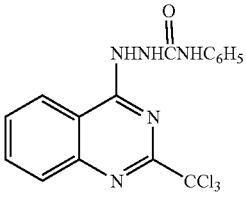
D-193
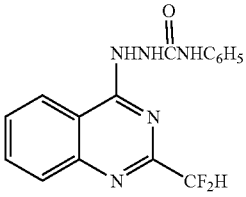
D-194
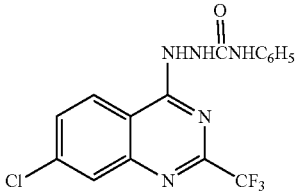
-continued
D-195
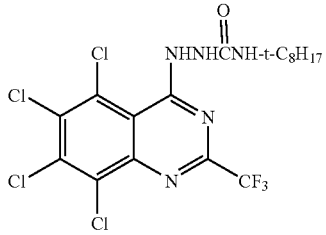
D-196
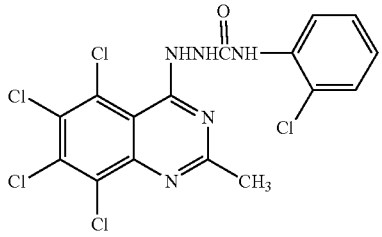
D-197
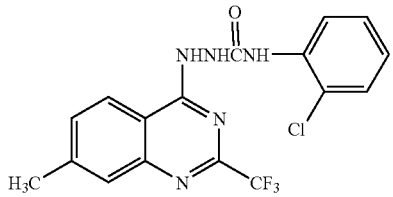
D-198
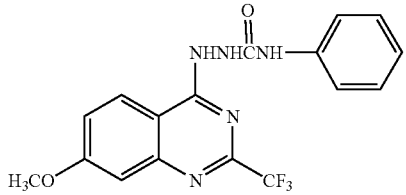
D-199
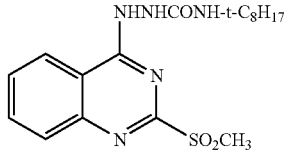
D-200
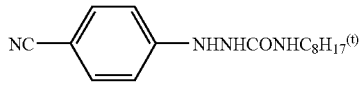
D-201
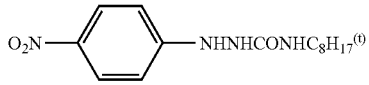
D-202
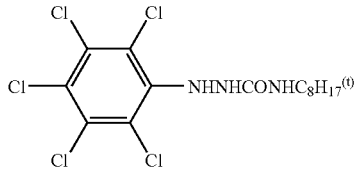
D-203
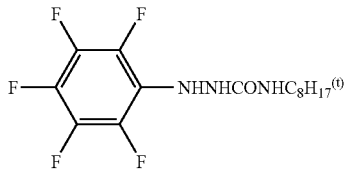

-continued

D-204

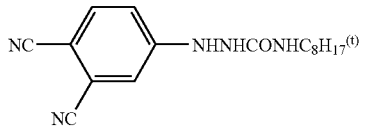

D-205

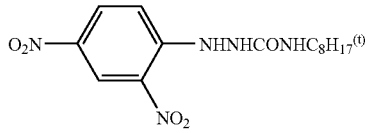

D-206

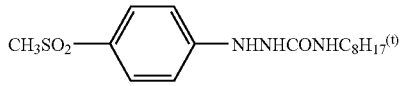

The reducing compounds represented by the general formula (1) can be synthesized according to the methods described in JP-A-9-152702, JP-A-8-286340, JP-A-9-152700, JP-A-9-152701, JP-A-9-152703, JP-A-9-152704 and so forth.

While the amount of the reducing compound represented by the general formula (1) may be selected within a wide range, it is preferably 0.01 to 100 times, more preferably 0.1 to 10 times, of silver ions in mole.

The reducing compound represented by the general formula (1) maybe added in any form, for example, as a solution, powder, solid microparticle dispersion emulsion, oil-protected dispersion and so forth. The solid microparticle dispersion can be formed by a known pulverization means (for example, a ball mill, vibration ball mill, sand mill, colloid mill, jet mill, roller mill etc.). Further, when solid microparticle dispersion is prepared, a dispersing aid may be used.

Preferably, the photothermographic material of the present invention further contains a compound represented by the general following formula (2) or (3) as a reducing agent for the silver salt on the same surface of the support as the photosensitive silver halide and the reducible silver salt.

In the general formula (2), $V^1$ to $V^8$ each independently represent hydrogen atom or a substituent. The substituents represented by $V^1$ to $V^8$ may be the same or different from each other or one another. Preferred examples of the substituents include a halogen atom (for example, fluorine atom, chlorine atom, bromine atom and iodine atom), a linear, branched or cyclic alkyl group or an alkyl group consisting of a combination thereof having preferably 1–20 carbon atoms, more preferably 1–16 carbon atoms, further preferably 1–13 carbon atoms (for example, methyl, ethyl, n-propyl, isopropyl, sec-butyl, tert-butyl, tert-octyl, n-amyl, tert-amyl, n-dodecyl, n-tridecyl, cyclohexyl etc.), an alkenyl group having preferably 2–20 carbon atoms, more preferably 2–16 carbon atoms, further preferably 2–12 carbon atoms (for example, vinyl, allyl, 2-butenyl, 3-pentenyl etc.), an aryl group having preferably 6–30 carbon atoms, more preferably 6–20 carbon atoms, further preferably 6–12 carbon atoms (for example, phenyl, p-methylphenyl, naphthyl etc.), an alkoxy group having preferably 1–20 carbon atoms, more preferably 1–16 carbon atoms, further preferably 1–12 carbon atoms (for example, methoxy, ethoxy, propoxy, butoxy etc.), an aryloxy group having preferably 6–30 carbon atoms, more preferably 6–20 carbon atoms, further preferably 6–12 carbon atoms (for example, phenyloxy, 2-naphthyloxy etc.), an acyloxy group having preferably 2–20 carbon atoms, more preferably 2–16 carbon atoms, further preferably 2–12 carbon atoms (for example, acetoxy, benzoyloxy etc.), an amino group having preferably 0–20 carbon atoms, more preferably 1–16 carbon atoms, further preferably 1–12 carbon atoms (for example, dimethylamino group, diethylamino group, dibutylamino group, anilino group etc.), an acylamino group having preferably 2–20 carbon atoms, more preferably 2–16 carbon atoms, further preferably 2–13 carbon atoms (for example, acetylamino, tridecanoylamino, benzoylamino etc.), a sulfonylamino group having preferably 1–20 carbon atoms, more preferably 1–16 carbon atoms, further preferably 1–12 carbon atoms (for example, methanesulfonylamino, butanesulfonylamino, benzenesulfonylamino etc.), a ureido group having preferably 1–20 carbon atoms, more preferably 1–16 carbon atoms, further preferably 1–12 carbon atoms (for example, ureido, methylureido, phenylureido etc.), a carbamate group having preferably 2–20 carbon atoms, more preferably 2–16 carbon atoms, further preferably 2–12 carbon atoms (for example, methoxycarbonylamino, phenyloxycarbonylamino etc.), carboxyl group, a carbamoyl group having preferably 1–20 carbon atoms, more preferably 1–16 carbon atoms, further preferably 1–12 carbon atoms (for example, carbamoyl, N,N-diethylcarbamoyl, N-dodecylcarbamoyl, N-phenylcarbamoyl etc.), an alkoxycarbonyl group having preferably 2–20 carbon atoms, more preferably 2–16 carbon atoms, further preferably 2–12 carbon atoms (for example, methoxycarbonyl, ethoxycarbonyl, butoxycarbonyl etc.), an acyl group having preferably 2–20 carbon atoms, more preferably 2–16 carbon atoms, further preferably 2–12 carbon atoms (for example, acetyl, benzoyl, formyl, pivaloyl etc.), sulfo group, a sulfonyl group having preferably 1–20 carbon atoms, more preferably 1–16 carbon atoms, further preferably 1–12 carbon atoms (for example, mesyl, tosyl etc.), a sulfamoyl group having preferably 0–20 carbon atoms, more preferably 0–16 carbon atoms, further preferably 0–12 carbon atoms (for example, sulfamoyl, methylsulfamoyl, dimethylsulfamoyl, phenylsulfamoyl, etc.), cyano group, nitro group, hydroxyl group, mercapto group, an alkylthio group having preferably 1–20 carbon atoms, more preferably 1–16 carbon atoms, further preferably 1–12 carbon atoms (for example, methylthio, butylthio etc.), a heterocyclic group having preferably 2–20 carbon atoms, more preferably 2–16 carbon atoms, further preferably 2–12 carbon atoms (for example, pyridyl, imidazoyl, pyrrolidyl etc.) and so forth. These substituents may be further substituted with other substituents.

Particularly preferred examples of the substituents represented by $V^1$ to $V^8$ are alkyl groups (for example, methyl, ethyl, n-propyl, isopropyl, sec-butyl, tert-butyl, tert-octyl, n-amyl, tert-amyl, n-dodecyl, n-tridecyl, cyclohexyl etc.).

In the general formula (2), L represents a bridging group consisting of —CH($V^9$)— or —S—. $V^9$ represents hydrogen atom or a substituent. Preferred examples of the substituent represented by $V^9$ include, for example, a halogen atom (for example, fluorine atom, chlorine atom, bromine atom and iodine atom), a linear, branched or cyclic alkyl group or an alkyl group consisting of a combination thereof having preferably 1–20 carbon atoms, more preferably 1–16 carbon atoms, further preferably 1–13 carbon atoms (for example, methyl, ethyl, n-propyl, isopropyl, sec-butyl, tert-butyl, tert-octyl, n-amyl, tert-amyl, n-dodecyl, n-tridecyl, cyclohexyl, 2,4,4-trimethylpentyl etc.), an alkenyl group having preferably 2–20 carbon atoms, more preferably 2–16 carbon atoms, further preferably 2–12 carbon atoms (for example, vinyl, allyl, 2-butenyl, 3-pentenyl etc.), an aryl group having preferably 6–30 carbon atoms, more preferably 6–20 carbon atoms, further preferably 6–12 carbon atoms (for example, phenyl, p-methylphenyl, naphthyl etc.), an alkoxy group having preferably 1–20 carbon atoms, more preferably 1–16 carbon atoms, further preferably 1–12 carbon atoms (for example, methoxy, ethoxy, propoxy, butoxy etc.), an aryloxy group having preferably 6–30 carbon atoms, more preferably 6–20 carbon atoms, further preferably 6–12 carbon atoms (for example, phenyloxy, 2-naphthyloxy etc.), an acyloxy group having preferably 2–20 carbon atoms, more preferably 2–16 carbon atoms, further preferably 2–12 carbon atoms (for example, acetoxy, benzoyloxy etc.), an amino group having preferably 0–20 carbon atoms, more preferably 1–16 carbon atoms, further preferably 1–12 carbon atoms (for example, dimethylamino group, diethylamino group, dibutylamino group, anilino group etc.), an acylamino group having preferably 2–20 carbon atoms, more preferably 2–16 carbon atoms, further preferably 2–13 carbon atoms (for example, acetylamino, tridecanoylamino, benzoylamino etc.), a sulfonylamino group having preferably 1–20 carbon atoms, more preferably 1–16 carbon atoms, further preferably 1–12 carbon atoms (for example, methanesulfonylamino, butanesulfonylamino, benzenesulfonylamino etc.), a ureido group having preferably 1–20 carbon atoms, more preferably 1–16 carbon atoms, further preferably 1–12 carbon atoms (for example, ureido, methylureido, phenylureido etc.), a carbamate group having preferably 2–20 carbon atoms, more preferably 2–16 carbon atoms, further preferably 2–12 carbon atoms (for example, methoxycarbonylamino, phenyloxycarbonylamino etc.), carboxyl group, a carbamoyl group having preferably 1–20 carbon atoms, more preferably 1–16 carbon atoms, further preferably 1–12 carbon atoms (for example, carbamoyl, N,N-diethylcarbamoyl, N-dodecylcarbamoyl, N-phenylcarbamoyl etc.), an alkoxycarbonyl group having preferably 2–20 carbon atoms, more preferably 2–16 carbon atoms, further preferably 2–12 carbon atoms (for example, methoxycarbonyl, ethoxycarbonyl, butoxycarbonyl etc.), an acyl group having preferably 2–20 carbon atoms, more preferably 2–16 carbon atoms, further preferably 2–12 carbon atoms (for example, acetyl, benzoyl, formyl, pivaloyl etc.), sulfo group, a sulfonyl group having preferably 1–20 carbon atoms, more preferably 1–16 carbon atoms, further preferably 1–12 carbon atoms (for example, mesyl, tosyl etc.), a sulfamoyl group having preferably 0–20 carbon atoms, more preferably 0–16 carbon atoms, further preferably 0–12 carbon atoms (for example, sulfamoyl, methylsulfamoyl, dimethylsulfamoyl, phenylsulfamoyl, etc.), cyano group, nitro group, hydroxyl group, mercapto group, an alkylthio group having preferably 1–20 carbon atoms, more preferably 1–16 carbon atoms, further preferably 1–12 carbon atoms (for example, methylthio, butylthio etc.), a heterocyclic group having preferably 2–20 carbon atoms, more preferably 2–16 carbon atoms, further preferably 2–12 carbon atoms (for example, pyridyl, imidazoyl, pyrrolidyl etc.) and so forth. These substituents may be further substituted with other substituents.

Particularly preferred examples of the substituent represented by $V^9$ are an alkyl group (for example, methyl, ethyl, n-propyl, isopropyl, sec-butyl, tert-butyl, tert-octyl, n-amyl, n-octyl, tert-amyl, n-dodecyl, n-tridecyl, cyclohexyl, 2,4,4-trimethylpentyl etc.), an alkenyl group (for example, vinyl, allyl, 2-butenyl, 3-pentenyl etc.), an aryl group (for example, phenyl, p-methylphenyl, naphthyl etc.), hydroxyl group, mercapto group, an alkylthio group (for example, methylthio, butylthio etc.) and so forth.

Specific examples of the compound represented by the general formula (2) will be shown below. However, the compounds used for the present invention are not limited to these examples.

(I-1)

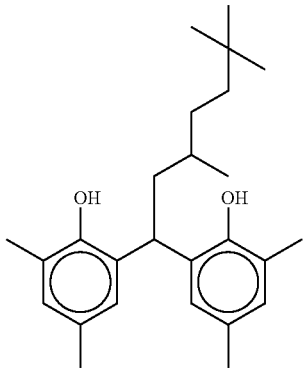

(I-2)

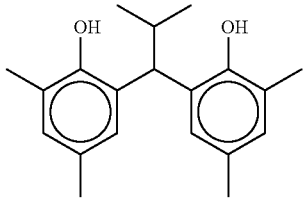

(I-3)

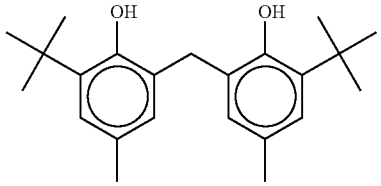

(I-4)

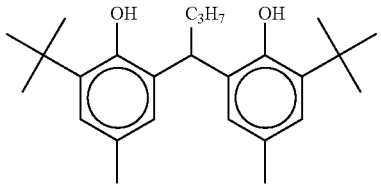

(I-5)

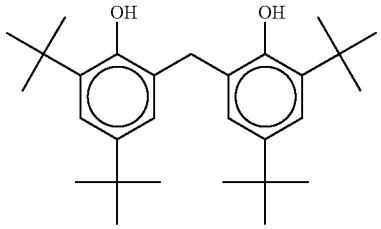

(I-6)

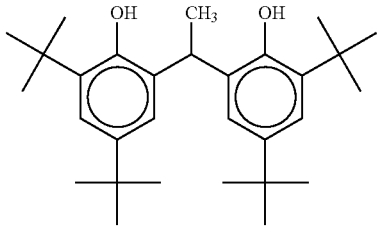

-continued
(I-7)
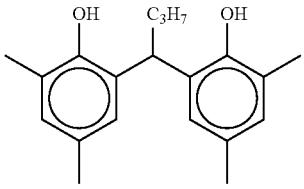
(I-8)
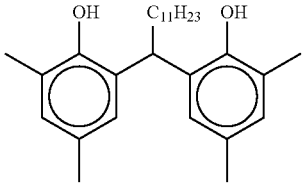
(I-9)
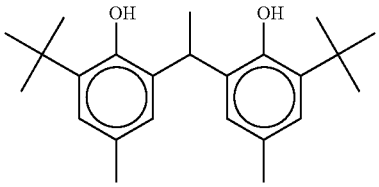
(I-10)
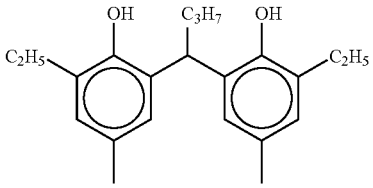
(I-11)
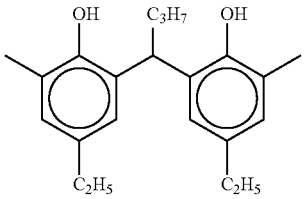
(I-12)
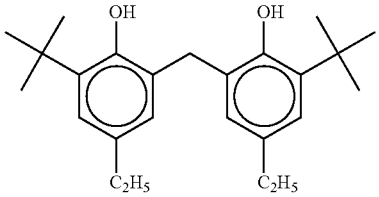
(I-13)
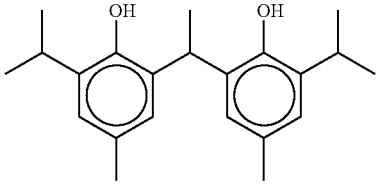
(I-14)
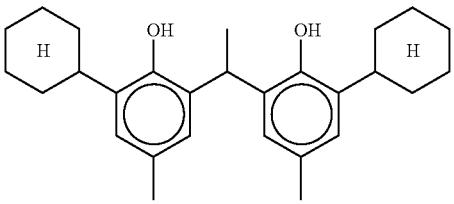
-continued
(I-15)
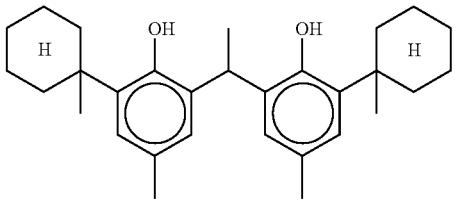
(I-16)
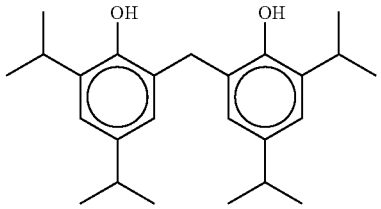
(I-17)
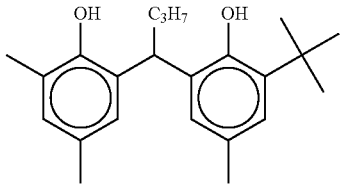
(I-18)
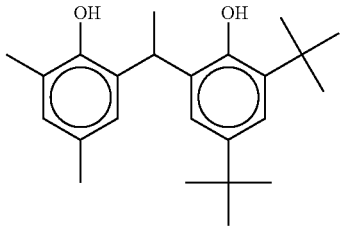
(I-19)
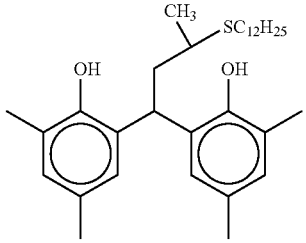
(I-20)
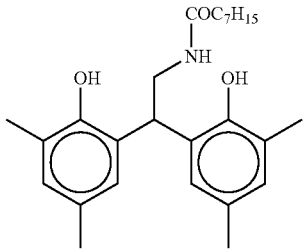
(I-21)
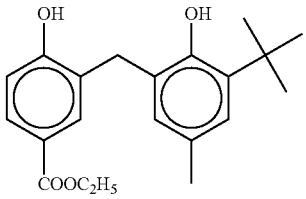

-continued
(I-22)
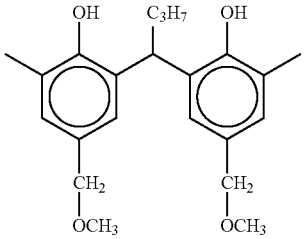
(I-23)
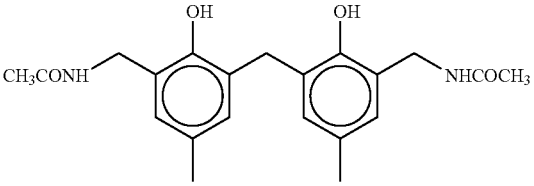
(I-24)
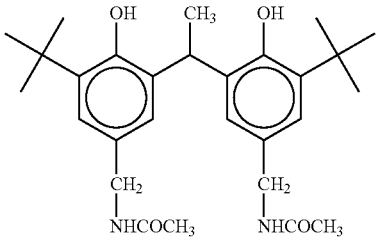
(I-25)
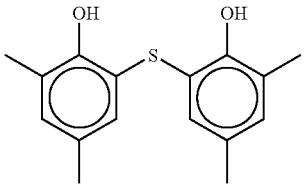
(I-26)
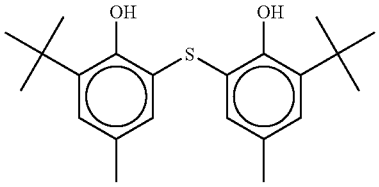
(I-27)
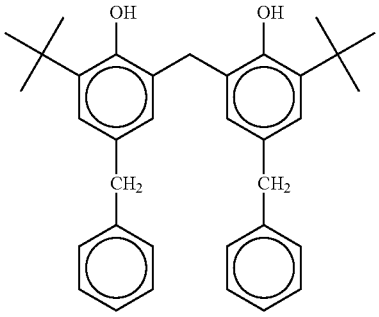
-continued
(I-28)
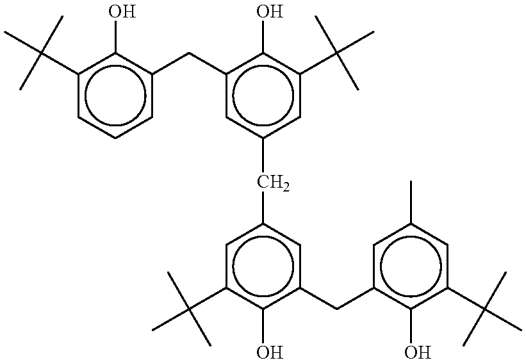
(I-29)
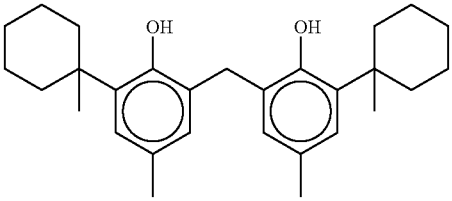
(I-30)
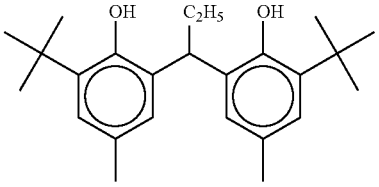
(I-31)
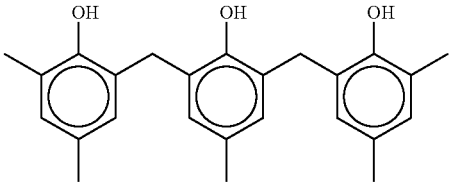
(I-32)
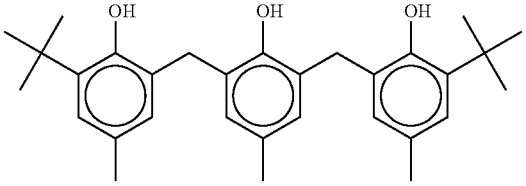
(I-33)
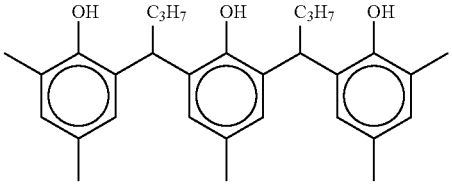

-continued (I-34)

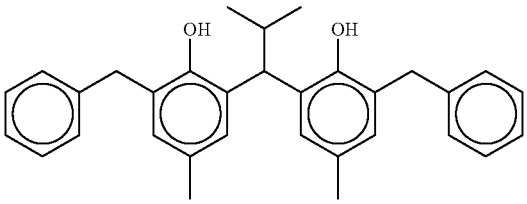

In the general formula (3), $V^{10}$ to $V^{14}$ each independently represent hydrogen atom or a substituent. The substituents represented by $V^{10}$ to $V^{14}$ may be the same or different from each other or one another. Preferred examples of the substituents include a halogen atom (for example, fluorine atom, chlorine atom, bromine atom and iodine atom), a linear, branched or cyclic alkyl group or an alkyl group consisting of a combination thereof having preferably 1–20 carbon atoms, more preferably 1–16 carbon atoms, further preferably 1–13 carbon atoms (for example, methyl, ethyl, n-propyl, isopropyl, sec-butyl, tert-butyl, tert-octyl, n-amyl, tert-amyl, n-dodecyl, n-tridecyl, cyclohexyl etc.), an alkenyl group having preferably 2–20 carbon atoms, more preferably 2–16 carbon atoms, further preferably 2–12 carbon atoms (for example, vinyl, allyl, 2-butenyl, 3-pentenyl etc.), an aryl group having preferably 6–30 carbon atoms, more preferably 6–20 carbon atoms, further preferably 6–12 carbon atoms (for example, phenyl, p-methylphenyl, naphthyl etc.), an alkoxy group having preferably 1–20 carbon atoms, more preferably 1–16 carbon atoms, further preferably 1–12 carbon atoms (for example, methoxy, ethoxy, propoxy, butoxy etc.), an aryloxy group having preferably 6–30 carbon atoms, more preferably 6–20 carbon atoms, further preferably 6–12 carbon atoms (for example, phenyloxy, 2-naphthyloxy etc.), an acyloxy group having preferably 2–20 carbon atoms, more preferably 2–16 carbon atoms, further preferably 2–12 carbon atoms (for example, acetoxy, benzoyloxy etc.), an amino group having preferably 0–20 carbon atoms, more preferably 1–16 carbon atoms, further preferably 1–12 carbon atoms (for example, dimethylamino group, diethylamino group, dibutylamino group, anilino group etc.), an acylamino group having preferably 2–20 carbon atoms, more preferably 2–16 carbon atoms, further preferably 2–13 carbon atoms (for example, acetylamino, tridecanoylamino, benzoylamino etc.), a sulfonylamino group having preferably 1–20 carbon atoms, more preferably 1–16 carbon atoms, further preferably 1–12 carbon atoms (for example, methanesulfonylamino, butanesulfonylamino, benzenesulfonylamino etc.), a ureido group having preferably 1–20 carbon atoms, more preferably 1–16 carbon atoms, further preferably 1–12 carbon atoms (for example, ureido, methylureido, phenylureido etc.), a carbamate group having preferably 2–20 carbon atoms, more preferably 2–16 carbon atoms, further preferably 2–12 carbon atoms (for example, methoxycarbonylamino, phenyloxycarbonylamino etc.), carboxyl group, a carbamoyl group having preferably 1–20 carbon atoms, more preferably 1–16 carbon atoms, further preferably 1–12 carbon atoms (for example, carbamoyl, N,N-diethylcarbamoyl, N-dodecylcarbamoyl, N-phenylcarbamoyl etc.), an alkoxycarbonyl group having preferably 2–20 carbon atoms, more preferably 2–16 carbon atoms, further preferably 2–12 carbon atoms (for example, methoxycarbonyl, ethoxycarbonyl, butoxycarbonyl etc.), an acyl group having preferably 2–20 carbon atoms, more preferably 2–16 carbon atoms, further preferably 2–12 carbon atoms (for example, acetyl, benzoyl, formyl, pivaloyl etc.), sulfo group, a sulfonyl group having preferably 1–20 carbon atoms, more preferably 1–16 carbon atoms, further preferably 1–12 carbon atoms (for example, mesyl, tosyl etc.), a sulfamoyl group having preferably 0–20 carbon atoms, more preferably 0–16 carbon atoms, further preferably 0–12 carbon atoms (for example, sulfamoyl, methylsulfamoyl, dimethylsulfamoyl, phenylsulfamoyl etc.), cyano group, nitro group, hydroxyl group, mercapto group, an alkylthio group having preferably 1–20 carbon atoms, more preferably 1–16 carbon atoms, further preferably 1–12 carbon atoms (for example, methylthio, butylthio etc.), a heterocyclic group having preferably 2–20 carbon atoms, more preferably 2–16 carbon atoms, further preferably 2–12 carbon atoms (for example, pyridyl, imidazoyl, pyrrolidyl etc.) and so forth. These substituents may be further substituted with other substituents.

Particularly preferred examples of the substituents represented by $V^{10}$to $V^{14}$ are alkyl groups (for example, methyl, ethyl, n-propyl, isopropyl, sec-butyl, tert-butyl, tert-octyl, n-amyl, tert-amyl, n-dodecyl, n-tridecyl, cyclohexyl etc.).

Further, the compound represented by the general formula (3) may be provided in the form of a precursor, or there may be used a compound comprising a monovalent group derived from a compound represented by the general formula (3) bonded through a bridging group (e.g., a bridging group represented as —C(X)(Y)— wherein X and Y each independently represent hydrogen atom, an alkyl group, an aryl group or a heterocyclic group, and these groups may have a substituent).

Specific examples of the compound represented by the general formula (3) will be shown below. However, the compounds used for the present invention are not limited to these examples.

(II-1)

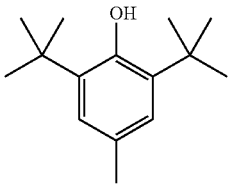

(II-2)

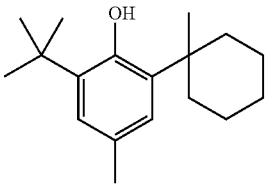

-continued
(II-3)
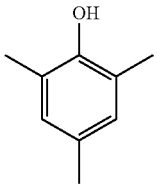
(II-4)
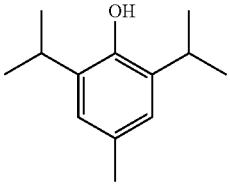
(II-5)
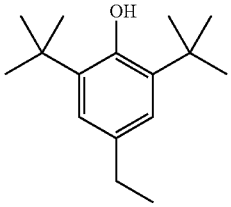
(II-6)
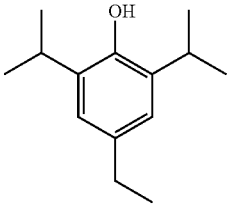
(II-7)
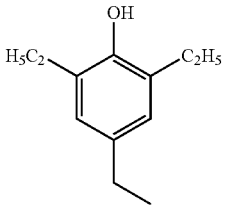
(II-8)
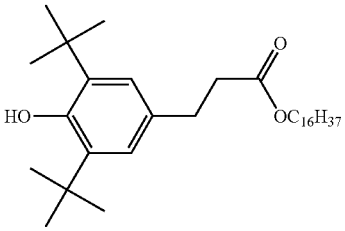
(II-9)
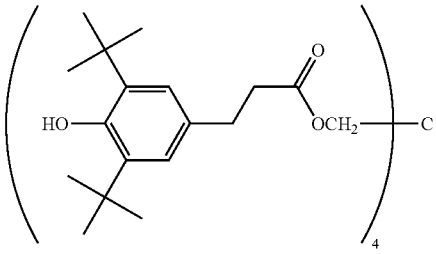
(II-10)
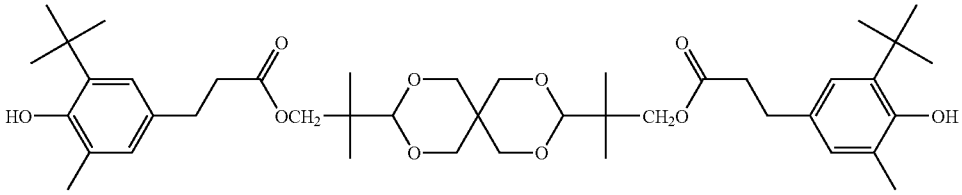
(II-11)
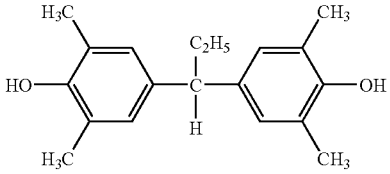
(II-12)
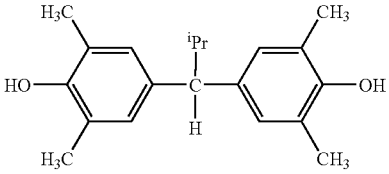
(II-13)
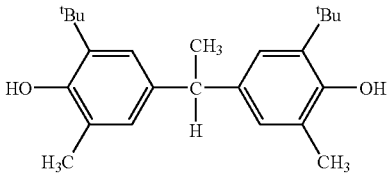
(II-14)
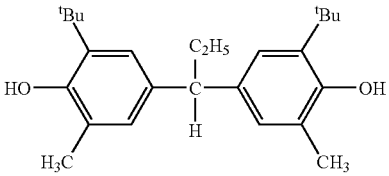

-continued
(II-15)
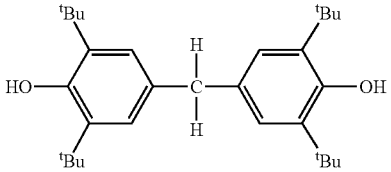
(II-16)
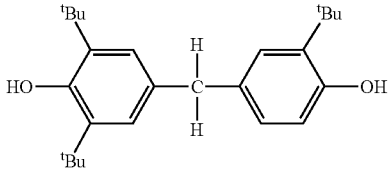
(II-17)
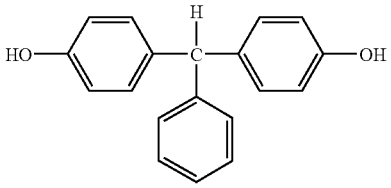
(II-18)
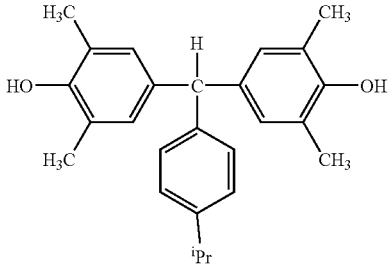
(II-19)
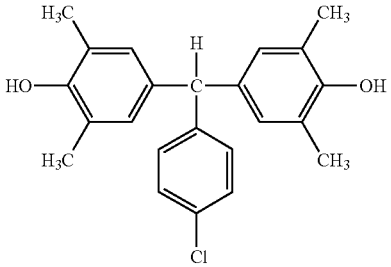
(II-20)
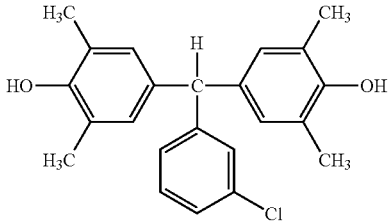
(II-21)
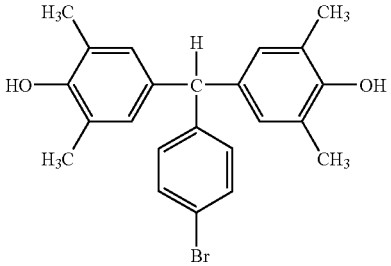
(II-22)
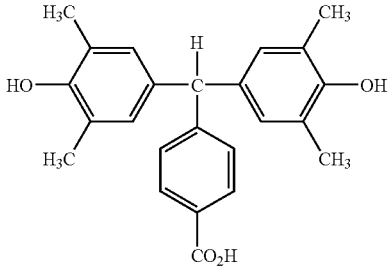
(II-23)
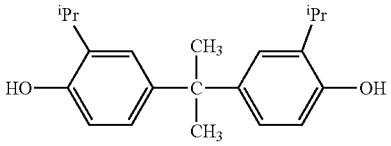
(II-24)
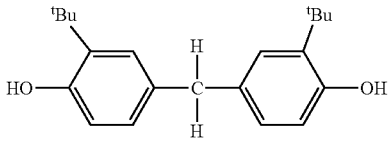
(II-25)
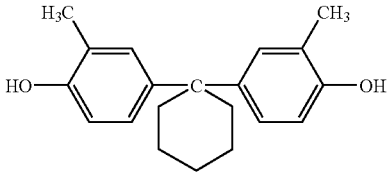
(II-26)
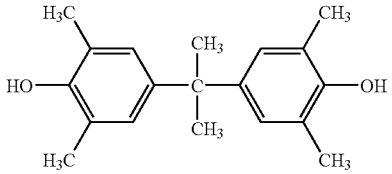
(II-27)
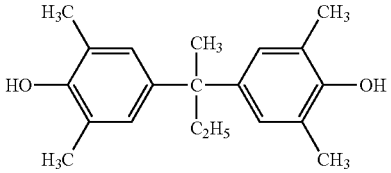
(II-28)
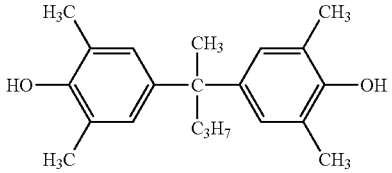

-continued (II-29)

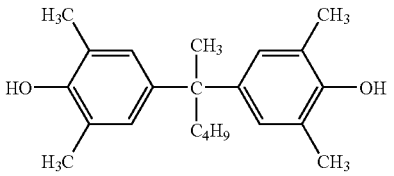

(II-30)

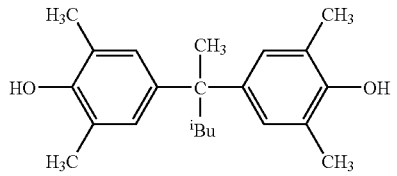

(II-31)

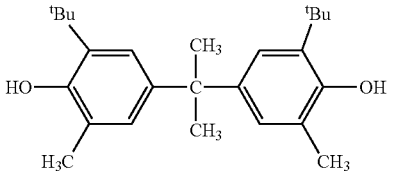

While the amount of the compound represented by the general formula (2) or (3) is not particularly limited, it is preferably 0.01–1000 mole %, more preferably 0.1–100 mole %, further preferably 0.1–10 mole %, with respect to the compound represented by the general formula (1).

The reducing compound represented by the general formula (2) or (3) may be added in any form, for example, as a solution, powder, solid microparticle dispersion and so forth. The solid microparticle dispersion can be formed by a known pulverization means (for example, a ball mill, vibration ball mill, sand mill, colloid mill, jet mill, roller mill etc.). Further, when solid microparticle dispersion is prepared, a dispersing aid may be used.

The compound represented by the formula (2) or (3) may be added to any layer provided on the same side on a support as the photosensitive silver halide and the reducible silver salt. However, it is preferably added to a layer containing the silver halide or a layer adjacent thereto.

The photothermographic material of the present invention preferably contains a reducing agent for the silver salt of an organic acid in addition to the compound represented by the formula (1) and the compound represented by the formula (2) or (3). The reducing agent for the silver salt of an organic acid may be any substance that reduces silver ion to metal silver, preferably such an organic substance. While conventional photographic developers such as phenidone, hydroquinone and catechol are useful, hindered phenol reducing agents are also preferred. The reducing agent is preferably contained in an amount of 5–50 mole %, more preferably 10–40 mole %, per mole of silver on the side having the image-forming layer. The reducing agent may be added to any layer on the image-forming layer side of the support. In the case of adding the reducing agent to a layer other than the image-forming layer, the reducing agent is preferably used in a slightly larger amount, i.e., 10–50 mole % per mole of silver. The reducing agent may also be a so-called precursor that is derived to effectively function only at the time of development.

When the reducing agent used in the present invention has an aromatic hydroxyl group (—OH), in particular when the reducing agent is any of the aforementioned bisphenols, it is preferable to use together a non-reducing compound having a group that can form a hydrogen bond with the aromatic hydroxyl group. Examples of the group that can form a hydrogen bond with hydroxyl group or amino group include phosphoryl group, sulfoxido group, sulfonyl group, carbonyl group, amido group, an ester group, urethane group, ureido group, a tertiary amino group, a nitrogen-containing aromatic group and so forth. Particularly preferred examples of such a compound are those compounds having phosphoryl group, sulfoxido group, amido group (provided that it does not have >N—H group, but it is blocked like >N—R (R is a substituent other than H)), urethane group (provided that it does not have >N—H group, but it is blocked like >N—R (R is a substituent other than H)), or ureido group (provided that it does not have >N—H group, but it is blocked like >N—R (R is a substituent other than H)).

Particularly preferred hydrogen bond-forming compounds for the present invention are compounds represented by the following general formula (II).

(II)

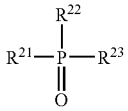

In the general formula (II), $R^{21}$, $R^{22}$ and $R^{23}$ each independently represent an alkyl group, an aryl group, an alkoxy group, an aryloxy group, an amino group or a heterocyclic group, and these groups may or may not have one or more substituents. Two of $R^{21}$, $R^{22}$ and $R^{23}$ may be bonded together to form a ring.

When $R^{21}$, $R^{22}$ and $R^{23}$ have one or more substituents, they can be selected from a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group and so forth, and they are preferably selected from an alkyl group and an aryl group. Specific examples thereof are methyl group, ethyl group, isopropyl group, t-butyl group, t-octyl group, phenyl group, 4-alkoxyphenyl group, 4-acyloxyphenyl group and so forth.

Specific examples of the groups represented by $R^{21}$, $R^{22}$ and $R^{23}$include a substituted or unsubstituted alkyl group such as methyl group, ethyl group, butyl group, octyl group, dodecyl group, isopropyl group, t-butyl group, t-amyl group, t-octyl group, cyclohexyl group, 1-methylcyclohexyl group, benzyl group, phenethyl group and 2-phenoxypropyl group; a substituted or unsubstituted aryl group such as phenyl group, cresyl group, xylyl group, naphthyl group, 4-t-butylphenyl group, 4-t-octylphenyl group, 4-anisidyl group and 3,5-dichlorophenyl group; a substituted or unsubstituted alkoxyl group such as methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group and benzyloxy group; a substituted or unsubstituted aryloxy group such as phenoxy group, cresyloxy group, isopropylphenoxy group, 4-t-butylphenoxy group, naphthoxy group and biphenyloxy group; a substituted or unsubstituted amino group such as amino group, dimethylamino group, diethylamino group, dibutylamino group, dioctylamino group, N-methyl-N-hexylamino group, dicyclohexylamino group, diphenylamino group and N-methyl-N-phenylamino group; a heterocyclic group such as 2-pyridyl group, 4-pyridyl group, 2-furanyl group, 4-piperidinyl group, 8-quinolyl group and 5-quinolyl group, and so forth.

$R^{21}$, $R^{22}$ and $R^{23}$ are preferably selected from an alkyl group, an aryl group, an alkoxy group and an aryloxy group. In view of the desired effects of the present invention, it is preferred that one or more of $R^{21}$, $R^{22}$ and $R^{23}$ should be selected from an alkyl group and an aryl group, and it is more preferred that two or more of $R^{21}$, $R^{22}$ and $R^{23}$ should be selected from an alkyl group and an aryl group. In view of availability at low cost, it is preferred that $R^{21}$, $R^{22}$ and $R^{23}$ should be the same groups.

Specific examples of the compound represented by the general formula (II) will be shown below. However, the compounds used for the present invention are not limited to these examples.

(P-1)

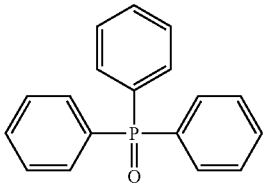

(P-2)

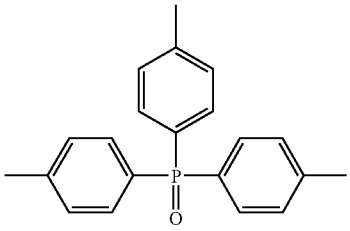

(P-3)

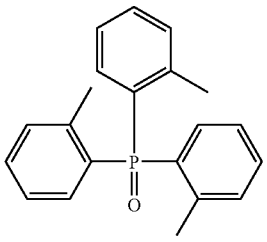

(P-4)

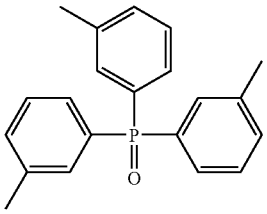

-continued (P-5)

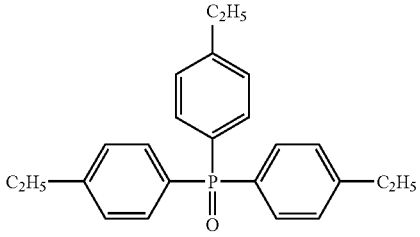

(P-6)

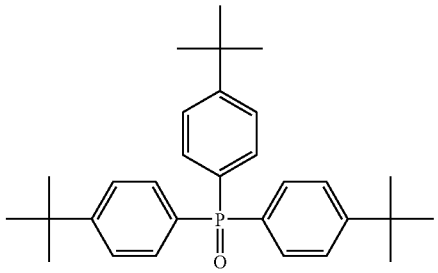

(P-7)

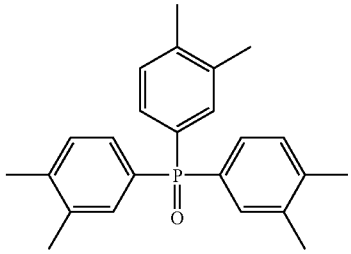

(P-8)

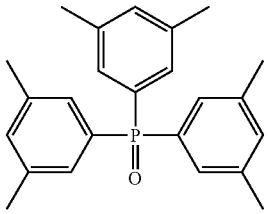

(P-9)

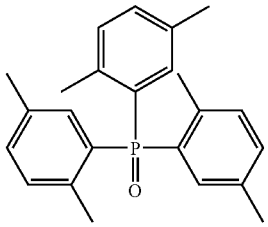

(P-10)

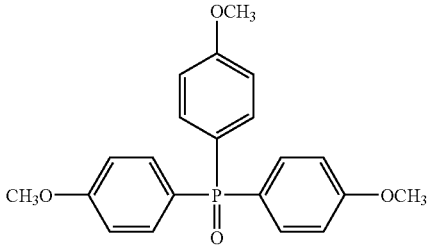

-continued
(P-11)
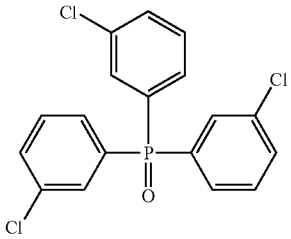
(P-12)
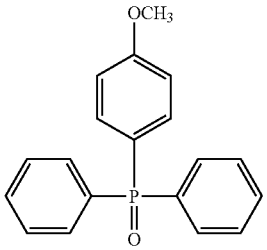
(P-13)
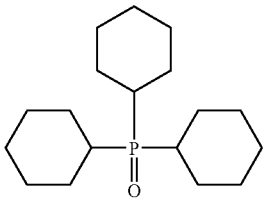
(P-14)
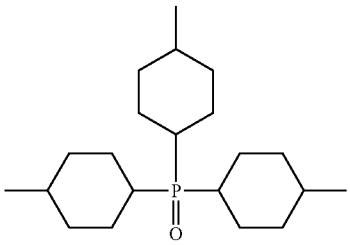
(P-15)
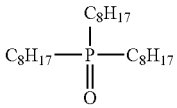
(P-16)
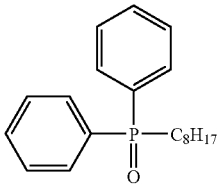
(P-17)
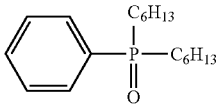
(P-18)
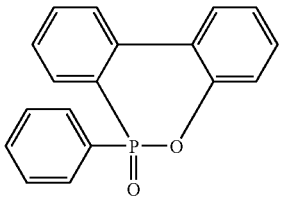
-continued
(P-19)
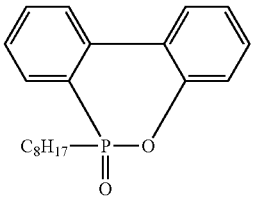
(P-20)
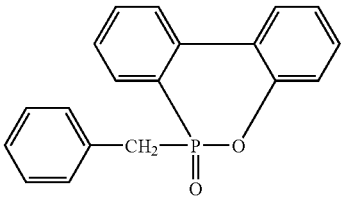
(P-21)
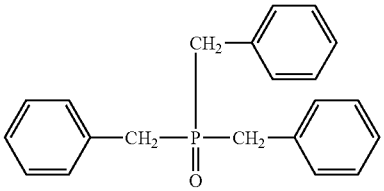
(P-22)
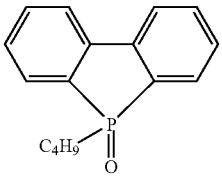
(P-23)
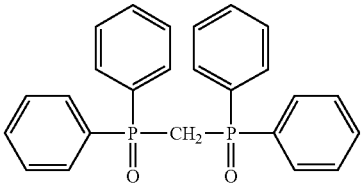
(P-24)
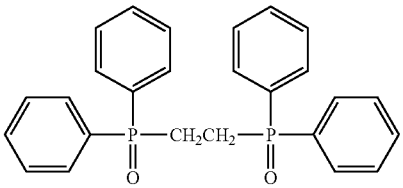
(P-25)
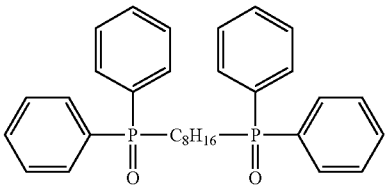
(P-26)
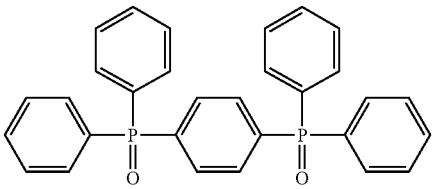

-continued (P-27)

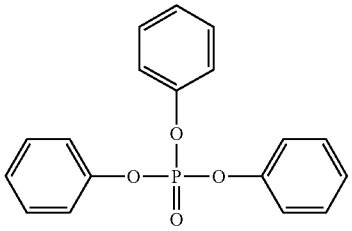

(P-28)

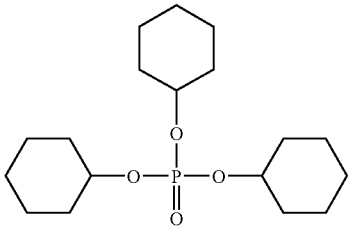

(P-29)

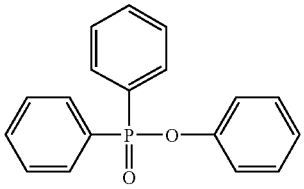

(P-30)

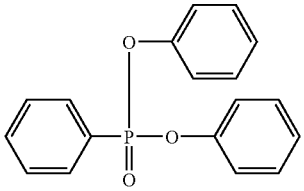

(P-31)

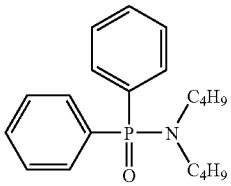

(P-32)

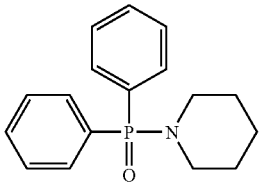

(P-33)

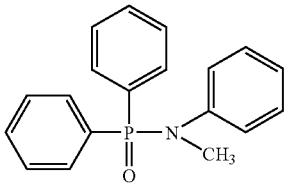

(P-34)

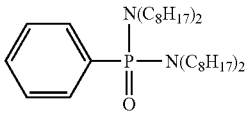

-continued (P-35)

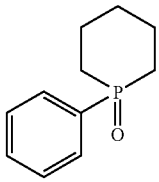

(P-36)

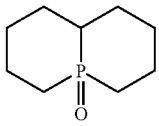

(P-37)

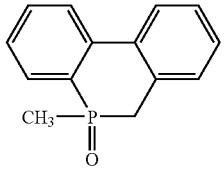

(P-38)

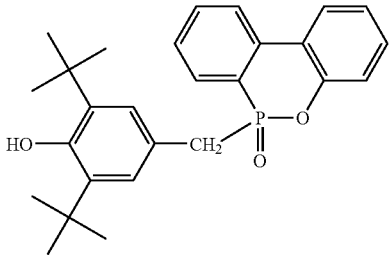

(P-39)

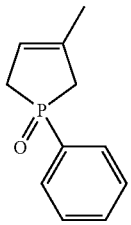

(P-40)

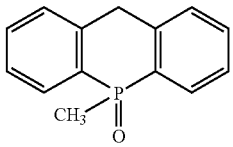

The compound represented by the general formula (II) for use in the present invention may be added to a coating solution, like the reducing agent, in the form of solution, emulsion dispersion or solid microparticle dispersion for use in the photosensitive material. The compound represented by the general formula (II) forms a complex in a solution with a compound having a phenolic hydroxyl group or amino group through hydrogen bond, and hence it can be isolated as crystals of such a complex depending on the combination of the reducing agent and the compound represented by the general formula (II). Crystal powder isolated in such a manner is particularly preferably used as solid microparticle dispersion in order to obtain stable performance. Further, it is also preferable to mix the reducing agent and the compound represented by the general formula (II) as powders and allow them to form a complex during dispersion operation using a suitable dispersing agent in a sand grinder mill or the like.

The compound represented by the general formula (II) is preferably used in an amount of 1–200 mole %, more preferably 10–150 mole %, further preferably 30–100 mole %, with respect to the reducing agent.

The photothermographic material of the present invention may contain a compound called "toning agent" as required in order to improve image density of silver images, color tone of silver and heat developability.

For photothermographic materials using a silver salt of an organic acid, toning agents of a wide range can be used. For example, there can be mentioned toning agents disclosed in JP-A-46-6077, JP-A-47-10282, JP-A-49-5019, JP-A-49-5020, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, Japanese Patent Publication (Kokoku, hereinafter referred to as JP-B) 49-10727, JP-B-54-20333, U.S. Pat. Nos. 3,080,254, 3,446,648, 3,782,941, 4,123,282 and 4,510,236, British Patent No. 1,380,795, Belgian Patent No. 841,910, JP-B-1-25050 and so forth. Specific examples of the toning agent include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(amino-methyl)aryldicarboxyimides such as N,N-(dimethylaminomethyl)-phthalimide and N,N-(dimethylaminomethyl)naphthalene-2,3-dicarboxyimide; blocked pyrazoles, isothiuronium derivatives and a certain kind of photobleaching agents such as N,N'-hexamethylenebis(1-carbamoyl-3,5-dimethylpyrazole), 1,8-(3,6-diazaoctane)bis(isothiuroniumtrifluoroacetate) and 2-(tribromomethylsulfonyl)benzothiazole; 3-ethyl-5-[(3-ethyl-2-benzothiazolinylidene)-1-methylethylidene]-2-thio-2,4-oxazolidinedione; phthalazinone, phthalazinone derivatives and metal salts thereof, such as 4-(1-naphthyl)phthalazinone, 6-chlorophthalazinone, 5,7-dimethyloxyphthalazinone or 2,3-dihydro-1,4-phthalazinedione; combinations of phthalazinone with a phthalic acid derivative (e.g., phthalic acid, 4-methylphthalic acid, 4-nitrophthalic acid, tetrachlorophthalic acid anhydride, homophthalic acid); phthalazine, phthalazine derivatives (e.g., 4-(1-naphthyl)-phthalazine, 6-chlorophthalazine, 5,7-dimethoxyphthalazine, 6-isopropylphthalazine, 6-isobutylphthalazine, 6-tert-butylthalazine, 5,7-dimethylphthalazine, 2,3-dihydrophthalazine) and metal salts thereof; combinations of phthalazine or a derivative thereof and a phthalic acid derivative (e.g., phthalic acid, 4-methylphthalic acid, 4-nitrophthalic acid, tetrachlorophthalic acid anhydride, homophthalic acid etc.); quinazolinedione, benzoxazine and naphthoxazine derivatives; rhodium complexes that function not only as a toning agent but also as a halide ion source for the formation of silver halide at the site, such as ammonium hexachlororhodate (III), rhodium bromide, rhodium nitrate and potassium hexachlororhodate (III); inorganic peroxides and persulfates such as ammonium disulfide peroxide and hydrogen peroxide; benzoxazine-2,4-diones such as 1,3-benzoxazine-2,4-dione, 8-methyl-1,3-benzoxazine-2,4-dione and 6-nitro-1,3-benzoxazine-2,4-dione; pyrimidines and asymmetric triazines such as 2,4-dihydroxpyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene and so forth.

The toning agents have been searched in view of desired performances (image density, silver color tone, improvement of heat developability), properties of volatilization, sublimation or the like from photosensitive materials, properties of photosensitive materials comprising them in combination with other additives such as antifoggants, and many toning agents have been reported. It is known that, among those, superior results can be obtained by combinations of phthalazine compounds represented by the aforementioned general formula (4) and phthalic acid derivatives.

The photothermographic material of the present invention preferably further comprises a phthalazine compound represented by the aforementioned general formula (4) on the same surface of support as the photosensitive silver halide and the reducible silver salt.

In the general formula (4), $R^2$ represents hydrogen atom or a monovalent substituent. Examples of the substituents represented by $R^2$ include, for example, an alkyl group having preferably from 1 to 20 carbon atoms, more preferably from 1 to 12 carbon atoms, further preferably from 1 to 8 carbon atoms (for example, methyl, ethyl, n-propyl, isopropyl, n-butyl, isobutyl, tert-butyl, n-octyl, n-decyl, n-hexadecyl, cyclopropyl, cyclopentyl, cyclohexyl etc.); an alkenyl group having preferably from 2 to 20 carbon atoms, more preferably from 2 to 12 carbon atoms, further preferably from 2 to 8 carbon atoms (for example, vinyl, allyl, 2-butenyl, 3-pentenyl etc.); an alkynyl group having preferably from 2 to 20 carbon atoms, more preferably from 2 to 12 carbon atoms, further preferably from 2 to 8 carbon atoms (for example, propargyl, 3-pentynyl etc.); an aryl group having preferably from 6 to 30 carbon atoms, more preferably from 6 to 20 carbon atoms, further preferably from 6 to 12 carbon atoms (for example, phenyl, p-methylphenyl, naphthyl etc.); an aralkyl group having preferably from 7 to 30 carbon atoms, more preferably from 7 to 20 carbon atoms, further preferably from 7 to 12 carbon atoms (for example, benzyl, α-methylmenzyl, 2-phenylethyl, naphthylmethyl, (4-methylphenyl)methyl etc.); an amino group having preferably from 0 to 20 carbon atoms, more preferably from 0 to 10 carbon atoms, further preferably from 0 to 6 carbon atoms (for example, amino, methylamino, dimethylamino, diethylamino, dibenzylamino etc.); an alkoxy group having preferably from 1 to 20 carbon atoms, more preferably from 1 to 12 carbon atoms, particularly preferably from 1 to 8 carbon atoms (for example, methoxy, ethoxy, butoxy etc.); an aryloxy group having preferably from 6 to 20 carbon atoms, more preferably from 6 to 16 carbon atoms, further preferably from 6 to 12 carbon atoms (for example, phenyloxy, 2-naphthyloxy etc.); an acyl group having preferably from 1 to 20 carbon atoms, more preferably from 1 to 16 carbon atoms, further preferably from 1 to 12 carbon atoms (for example, acetyl, benzoyl, formyl, pivaloyl etc.); an alkoxycarbonyl group having preferably from 2 to 20 carbon atoms, more preferably from 2 to 16 carbon atoms, further preferably from 2 to 12 carbon atoms (for example, methoxycarbonyl, ethoxycarbonyl etc.); an aryloxycarbonyl group having preferably from 7 to 20 carbon atoms, more preferably from 7 to 16 carbon atoms, further preferably from 7 to 10 carbon atoms (for example, phenyloxycarbonyl etc.); an acyloxy group having preferably from 2 to 20 carbon atoms, more preferably from 2 to 16 carbon atoms, further preferably from 2 to 10 carbon atoms (for example, acetoxy, benzoyloxy etc.); an acylamino group having preferably from 2 to 20 carbon atoms, more preferably from 2 to 16 carbon atoms, further preferably from 2 to 10 carbon atoms (for example, acetylamino, benzoylamino etc.); an alkoxycarbonylamino group having preferably from 2 to 20 carbon atoms, more preferably from 2 to 16 carbon atoms, further preferably from 2 to 12 carbon atoms (for example, methoxycarbonylamino etc.); an aryloxycarbonylamino group having preferably from 7 to 20 carbon atoms, more preferably from 7 to 16 carbon atoms, further preferably from 7 to 12 carbon atoms (for example, phenyloxycarbonylamino etc.); a sulfonylamino group having preferably from 1 to 20 carbon atoms, more preferably from 1 to 16 carbon atoms, further preferably from 1 to 12 carbon atoms (for example, methanesulfonylamino, benzenesulfonylamino etc.); a sulfamoyl group having preferably from 0 to 20 carbon atoms, more preferably from 0 to 16 carbon atoms, further preferably from 0 to 12 carbon atoms (for example, sulfamoyl, methylsulfamoyl, dimethylsulfamoyl, phenylsulfamoyl etc.); a carbamoyl group having preferably from 1 to 20 carbon atoms, more preferably from 1 to 16 carbon atoms, further preferably from 1 to 12 carbon atoms (for example, carbamoyl, methylcarbamoyl, diethylcarbamoyl, phenylcarbamoyl etc.); an alkylthio group having preferably from 1 to 20 carbon atoms, more preferably from 1 to 16 carbon atoms, further preferably from 1 to 12 carbon atoms (for example, methylthio, ethylthio etc.); an arylthio group having preferably from 6 to 20 carbon atoms, more preferably from 6 to 16 carbon atoms, further preferably from 6 to 12 carbon atoms (for example, phenylthio etc.); a sulfonyl group having preferably from 1 to 20 carbon atoms, more preferably from 1 to 16 carbon atoms, further preferably from 1 to 12 carbon atoms (for example, mesyl, tosyl etc.); a sulfinyl group having preferably from 1 to 20 carbon atoms, more preferably from 1 to 16 carbon atoms, further preferably from 1 to 12 carbon atoms (for example, methanesulfinyl, benzenesulfinyl etc.); a ureido group having preferably from 1 to 20 carbon atoms, more preferably from 1 to 16 carbon atoms, further preferably from 1 to 12 carbon atoms (for example, ureido, methylureido, phenylureido etc.); a phosphoric acid amido group having preferably from 1 to 20 carbon atoms, more preferably from 1 to 16 carbon atoms, further preferably from 1 to 12 carbon atoms (for example, diethylphosphoric acid amido, phenylphosphoric acid amido etc.); hydroxyl group; mercapto group; a halogen atom (e.g., fluorine atom, chlorine atom, bromine atom, iodine atom); cyano group; sulfo group; carboxyl group; nitro group; hydroxamic acid group; sulfino group; hydrazino group; a heterocyclic group (e.g., imidazolyl, pyridyl, furyl, piperidyl, morpholino etc.) ad so forth. These substituents may be further substituted with other substituents.

$R^2$is preferably hydrogen atom, an alkyl group, an alkenyl group, an alkynyl group, an aryl group, an aralkyl group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a sulfinyl group, hydroxy group, a halogen atom or cyano group, more preferably hydrogen atom, an alkyl group, an aryl group, an aralkyl group, an acyl group, hydroxy group, a halogen atom, or cyano group, further preferably hydrogen atom, an alkyl group, an aryl group, an aralkyl group or a halogen atom, particularly preferably hydrogen atom, an alkyl group, an aryl group or an aralkyl group.

m represents an integer of 1 to 6. m is preferably 3 or less, more preferably 2 or less. $(R^2)m$ means that 1–6 of Y independently exist on the phthalazine ring, and when m is 2 or more, adjacent two of $R^2$ may form an aliphatic ring or an aromatic ring. The aliphatic ring is preferably a 3- to 8-membered ring, more preferably 5- or 6-membered ring. The aromatic ring is preferably benzene or naphthalene ring. The aliphatic ring and aromatic ring may be a heterocycle, and it is preferably a 5- or 6-membered ring.

As for the methods for producing the phthalazine compounds represented by the general formula (4), there can be mentioned, for example, the method comprising condensing a corresponding phthalic acid derivative (phthalaldehyde, phthalic acid anhydride, phthalic ester etc.) with hydrazine to form a phthalazine base structure as described in R. G. ElderField "Heterocyclic Compounds", John Wiley and Sons, Vols. 1–9, 1950–1967, A. R. Katritzky, "Comprehensive Heterocyclic Chemistry", Pergamon Press, 1984 etc., the method comprising condensing α,α,α',α'-tetrachloro-o-xylene with hydrazine to form a phthalazine, the method comprising reacting an arylaldazine derivative with a mixture of aluminum chloride and aluminum bromide under a condition where the materials are melted to cause cyclization as described in Tetrahedron Letters, vol. 22, 345 page (1981), the method in which the synthesis is attained by cyclization of an aldazine compound in an organic solvent using an aluminum chloride catalyst as described in JP-A-11-180961 and so forth.

Specific examples of the phthalazine compound represented by the general formula (4) are listed below. However, the phthalazine compounds used for the present invention are not limited to these.

I-1

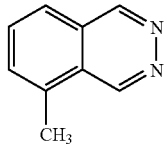

I-2

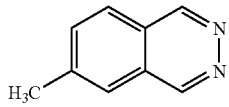

I-3

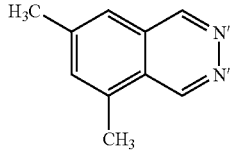

I-4

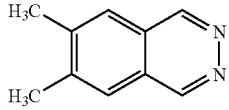

I-5

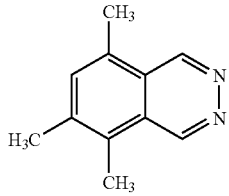

I-6

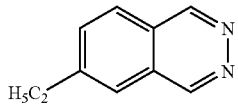

-continued
I-7
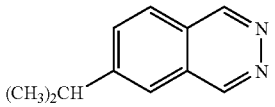
I-8
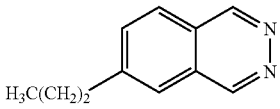
I-9
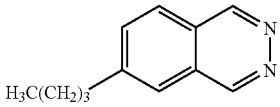
I-10
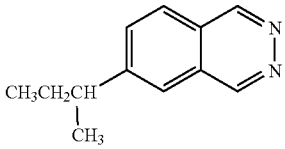
I-11
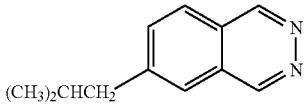
I-12
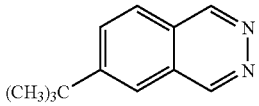
I-13
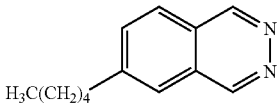
I-14
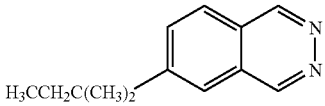
I-15
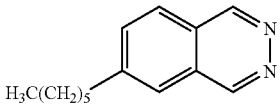
I-16
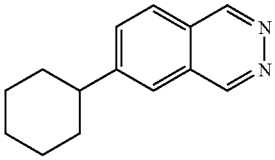
I-17
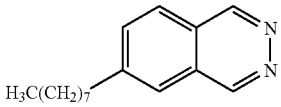
I-18
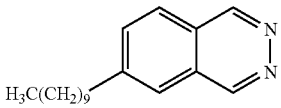
-continued
I-19
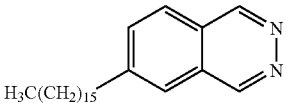
I-20
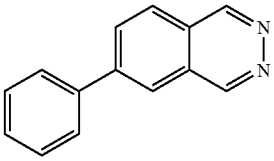
I-21
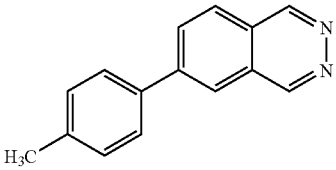
I-22
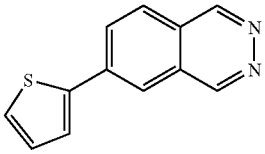
I-23
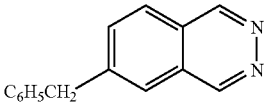
I-24
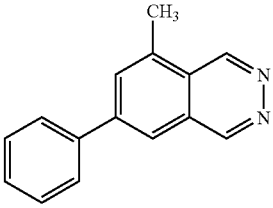
I-25
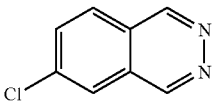
I-26
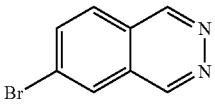
I-27
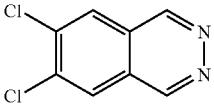
I-28
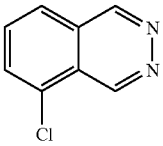
I-29
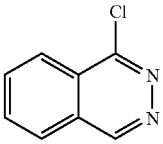

-continued
I-30
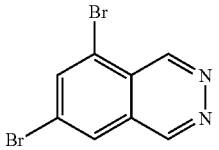
I-31
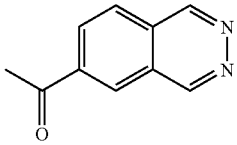
I-32
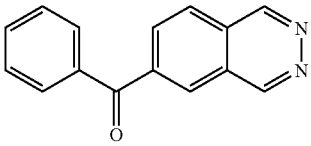
I-33
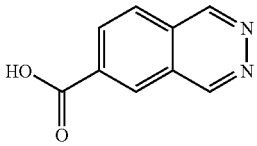
I-34
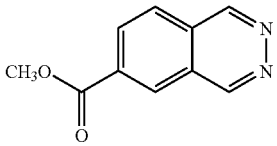
I-35
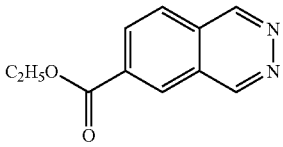
I-36
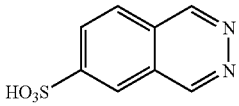
I-37
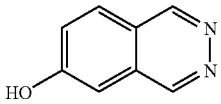
I-38
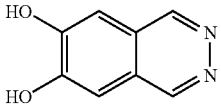
I-39
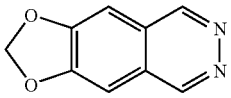
I-40
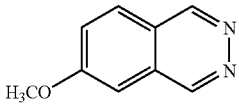
-continued
I-41
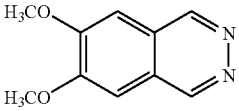
I-42
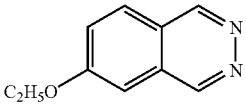
I-43
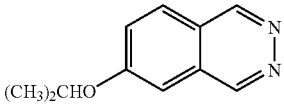
I-44
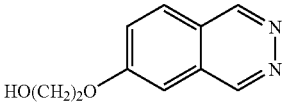
I-45
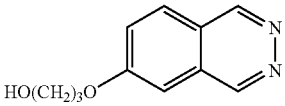
I-46
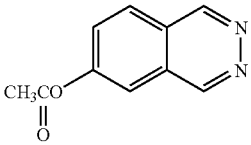
I-47
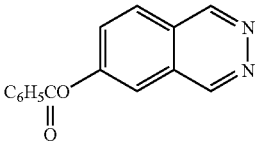
I-48
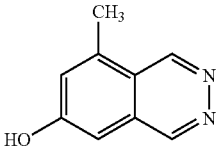
I-49
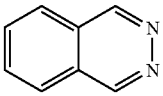
I-50
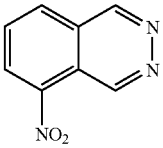
I-51
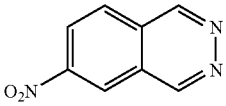
I-52
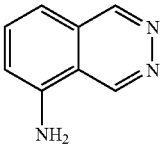

-continued
I-53
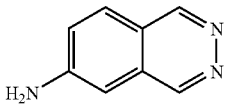
I-54
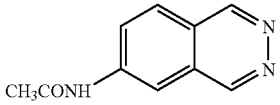
I-55
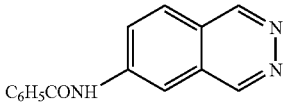
I-56
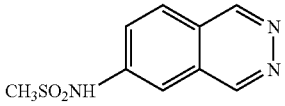
I-57
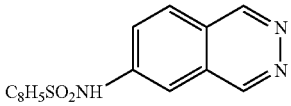
I-58
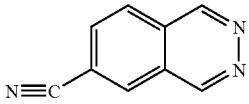
I-59
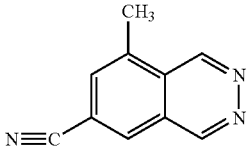
I-60
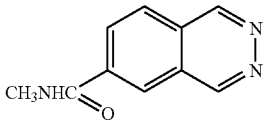
I-61
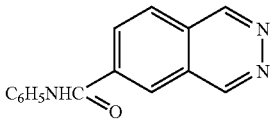
I-62
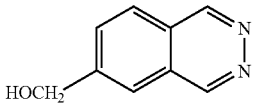
I-63
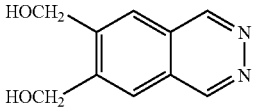
I-64
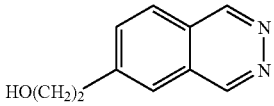
I-65
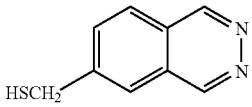
-continued
I-66
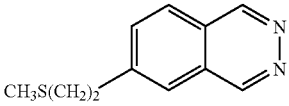
I-67
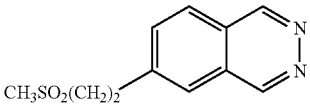
I-68
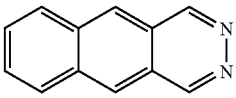
I-69
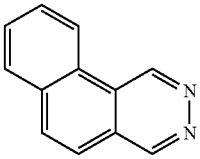
I-70
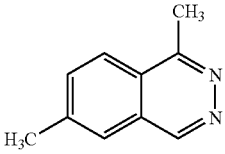
I-71
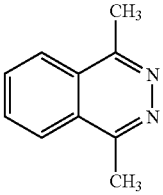
I-72
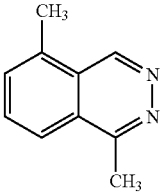
I-73
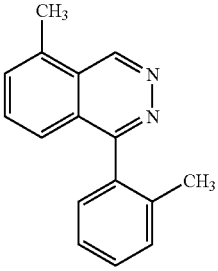

-continued
I-74
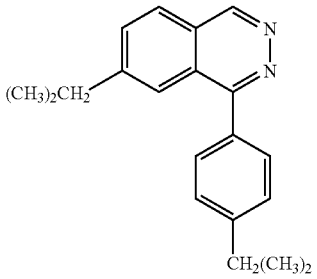
I-75
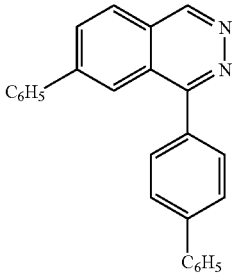
I-76
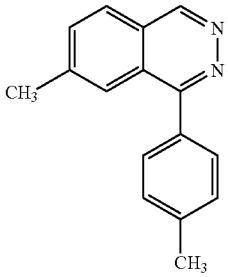
I-77
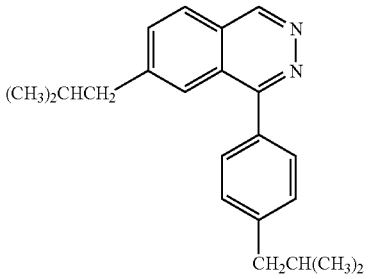
I-78
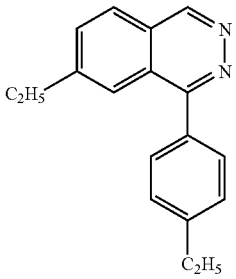
-continued
I-79
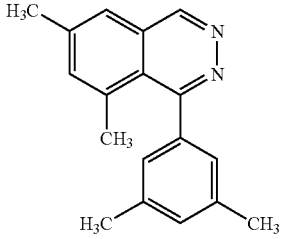
I-80
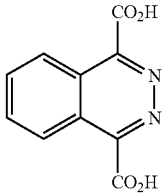
I-81
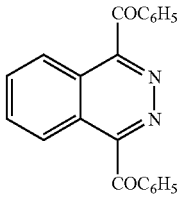
I-82
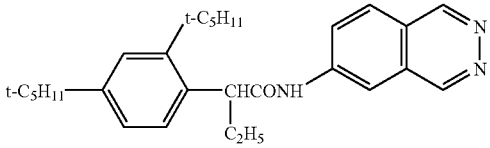
I-83
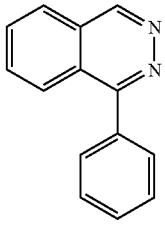
I-84
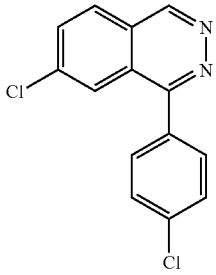
I-85
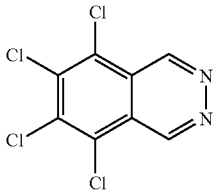

The amount of the phthalazine compound represented by the general formula (4) is preferably $10^{-4}$ mole to 1 mole, more preferably $10^{-3}$ mole to 0.3 mole, further preferably $10^{-4}$ mole to 0.3 mole, per mole of silver.

The phthalazine compound represented by the general formula (4) may be added in any form, for example, as a solution, powder, solid microparticle dispersion, emulsion, oil-protected dispersion and so forth. The solid microparticle dispersion can be formed by a known pulverization means (for example, a ball mill, vibration ball mill, sand mill, colloid mill, jet mill, roller mill etc.). Further, when solid microparticle dispersion is prepared, a dispersing aid may be used.

The phthalazine compound represented by the general formula (4) may be added to any layer on a support provided on the same side as the photosensitive silver halide and the reducible silver salt. However, it is preferably added to a layer containing the silver halide or a layer adjacent thereto.

The photothermographic material may be used either of monochromatic photosensitive materials and color photosensitive materials. For obtaining a wide range of colors on the chromaticity diagram by using three primary colors of yellow, magenta and cyan, at least three silver halide emulsion layers each having photosensitivity in a different spectral region can be used in combination. For example, there are a combination of three layers of blue sensitive layer, green sensitive layer and red sensitive layer, a combination of a green sensitive layer, red sensitive layer and infrared sensitive layer and so forth. These photosensitive layers may be provided in various orders known in ordinary color photosensitive materials. Further, each of these photosensitive layers may consist of two or more layers as required. The photosensitive material may be provided with various auxiliary layers, e.g., a protective layer, undercoat layer, intermediate layer, antihalation layer, back layer and so forth. Further, various filter dyes may also be added to the photosensitive material in order to improve color separation property.

A base is generally required for treatment of photographic photosensitive materials. For the photographic material of the present invention, various mechanisms for supplying base may be used. For example, when a base-generating function is imparted to the photosensitive material, a base precursor may be added to the photosensitive material. Examples of such a base precursor include salts of organic acids with bases that are decarboxylated by heat, compounds that release amines by intramolecular nucleophilic substitution reaction, Lossen rearrangement or Beckman rearrangement and so forth. Examples thereof are described in U.S. Pat. Nos. 4,514,493, 4,657,848 and so forth.

The photothermographic material of the present invention preferably contains an ultrahigh contrast agent. While type of the ultrahigh contrast agent that can be used for the present invention is not particularly limited, preferred examples thereof include all of the hydrazine derivatives represented by the formula (H) mentioned in JP-A-2000-284399 (specifically, the hydrazine derivatives mentioned in Tables 1–4 of the same), the hydrazine derivatives described in JP-A-10-10672, JP-A-10-161270, JP-A-10-62898, JP-A-9-304870, JP-A-9-304872, JP-A-9-304871, JP-A-10-31282, U.S. Pat. No. 5,496,695 and EP-A-741,320.

Particularly preferably used ultrahigh contrast agents are the substituted alkene derivatives, substituted isoxazole derivatives and particular acetal compounds represented by the formulas (1) to (3) mentioned in JP-A-2000-284399, and more preferably, the cyclic compounds represented by the formula (A) or (B) mentioned in the same, specifically Compounds 1–72 mentioned in Chem. 8 to Chem. 12 of the same, may be used. Two or more of these ultrahigh contrast agents may be used in combination.

The aforementioned ultrahigh contrast agent may be used after being dissolved in an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

Further, it may also be used as an emulsion dispersion mechanically prepared according to an already well known emulsion dispersion method by using an oil such as dibutyl phthalate, tricresyl phosphate, glyceryl triacetate or diethyl phthalate, ethyl acetate or cyclohexanone as an auxiliary solvent for dissolution. Alternatively, the ultrahigh contrast agent may be used by dispersing powder of the ultrahigh contrast agent in a suitable solvent such as water using a ball mill, colloid mill, or by means of ultrasonic wave according to a known method for solid dispersion.

While the ultrahigh contrast agent may be added to any layer on the image-forming layer side, it is preferably added to the image-forming layer or a layer adjacent thereto.

The amount of the ultrahigh contrast agent is $1\times10^{-6}$ mole to 1 mole, more preferably from $1\times10^{-5}$ mole to $5\times10^{-1}$ mole, further preferably from $2\times10^{-5}$ mole to $2\times10^{-1}$ mole, per mole of silver.

In addition to the aforementioned compounds, the compounds disclosed in U.S. Pat. Nos. 5,545,515, 5,635,339, 5,654,130 International Patent Publication WO97/34196 and U.S. Pat. No. 5,686,228, and the compounds disclosed in JP-A-11-119372, JP-A-11-133546, JP-A-11-119373, JP-A-11-109546, JP-A-11-95365, JP-A-11-95366 and JP-A-11-149136 may also be used.

In the present invention, a contrast accelerator may be used in combination with the above-described ultrahigh contrast agent for the formation of an ultrahigh contrast image. For example, the amine compounds described in U.S. Pat. No. 5,545,505, specifically, AM-1 to AM-5; the hydroxamic acids described in U.S. Pat. No. 5,545,507, specifically, HA-1 to HA-11; the acrylonitriles described in U.S. Pat. No. 5,545,507, specifically, CN-1 to CN-13; the hydrazine compounds described in U.S. Pat. No. 5,558,983, specifically, CA-1 to CA-6; and the onium salts described in JP-A-9-297368, specifically, A-1 to A-42, B-1 to B-27 and C-1 to C-14, and so forth may be used.

The aforementioned compound represented by the general formula (1) preferably does not have an activity as such an ultrahigh contrast agent.

Formic acid and formic acid salts serve as a strongly fogging substance in a photothermographic material containing a non-photosensitive silver salt, a photosensitive silver halide and a binder. In the present invention, the photothermographic material preferably contains formic acid or a formic acid salt on the side having the image-forming layer containing a photosensitive silver halide in an amount of 5 mmol or less, more preferably 1 mmol or less, per 1 mole of silver.

In the photothermographic material the present invention, an acid formed by hydration of diphosphorus pentoxide or a salt thereof is preferably used together with the ultrahigh contrast agent. Examples of the acid formed by hydration of diphosphorus pentoxide or a salt thereof include metaphosphoric acid (salt), pyrophosphoric acid (salt), orthophosphoric acid (salt), triphosphoric acid (salt), tetraphosphoric acid (salt), hexametaphosphoric acid (salt) and so forth. Particularly preferably used acids formed by hydration of diphosphorus pentoxide or salts thereof are orthophosphoric acid (salt) and hexametaphosphoric acid (salt). Specific examples of the salt are sodium orthophosphate, sodium dihydrogenorthophosphate, sodium hexametaphosphate, ammonium hexametaphosphate and so forth.

The acid formed by hydration of diphosphorus pentoxide or a salt thereof that can be preferably used in the present invention is added to the image-forming layer or a binder layer adjacent thereto in order to obtain the desired effect with a small amount of the acid or a salt thereof.

The acid formed by hydration of diphosphorus pentoxide or a salt thereof may be used in a desired amount (coated amount per $m^2$ of the photosensitive material) depending on the desired performance including sensitivity and fog. However, it can preferably be used in an amount of 0.1–500 $mg/m^2$, more preferably 0.5–100 $mg/m^2$.

The photosensitive silver halide used for the present invention is not particularly limited as for the halogen composition, and silver chloride, silver chlorobromide, silver bromide, silver iodobromide, silver chloroiodobromide and so forth may be used.

Preparation methods of the photosensitive silver halide are well known in the art, and for example, the methods described in Research Disclosure, No. 17029 (June, 1978) and U.S. Pat. No. 3,700,458 can be used. More specifically, a method can be used which comprises steps of preparing photosensitive silver halide grains by addition of a silver-supplying compound and a halogen-supplying compound to a solution of gelatin or other polymer, and then adding a silver salt of an organic acid to the resulting grains. Further, the methods described in JP-A-11-119374, paragraphs 0127–0224, Japanese Patent Application Nos. 11-98708 and 11-84182 are also preferred.

As for a grain size of the photosensitive silver halide, smaller grains are desirable to prevent cloudiness of the photosensitive material after image formation. Specifically, the grain size may preferably be not greater than 0.20 μm, preferably from 0.01–0.15 μm, more preferably from 0.02–0.12 μm. The term "grain size" used herein means a diameter of a circular area having the same area of projected area of silver halide grain (where the silver halide grain is tabular a grain, the term means the diameter of a circle having the same area as a projected area of the main surface of the tabular grain)

Examples of the form of silver halide grains include a cubic form, octahedral form, tetradecahedral form, tabular form, spherical form, rod-like form, potato-like form and so forth. In particular, cubic grains and tabular grains are preferred for the present invention. As for the characteristics of the grain form such as aspect ratio and surface index of the grains, they may be similar to those described in JP-A-11-119374, paragraph 0225. Further, the halide composition may have a uniform distribution in the grains, or the composition may change stepwise or continuously in the grains. Silver halide grains having a core/shell structure may also be preferably used. Core/shell grains having preferably a double to quintuple structure, more preferably a double to quadruple structure may be used. A technique for localizing silver bromide on the surface of silver chloride or silver chlorobromide grains may also be preferably used.

In the present invention, silver halide grains having hexacyano-metal complex on their outermost surfaces are preferred. Specific examples of the hexacyano-metal complex include $[Fe(CN)_6]^{4-}$, $[Fe(CN)_6]^{3-}$, $[Ru(CN)_6]^{4-}$, $[OS(CN)_6]^{4-}$, $[Co(CN)_6]^{3-}$, $[Rh(CN)_6]^{3-}$, $[Ir(CN)_6]^{3-}$, $[Cr(CN)_6]^{3-}$, $[Re(CN)_6]^{3-}$ and so forth. In the present invention, hexacyano-Fe complexes are preferred.

Since the hexacyano-metal complex exists in the form of an ion in an aqueous solution, its counter cation is not critical. However, it is preferable to use ions readily mixed with water and suitable for the precipitation operation of silver halide emulsions, for example, alkali metal ions such as sodium ion, potassium ion, rubidium ion, cesium ion and lithium ion, ammonium ions, alkylammonium ions (e.g., tetramethylammonium ions, tetraethylammonium ions, tetrapropylammonium ions, tetra(n-butyl)ammonium ions) and so forth.

The hexacyano-metal complex may be added to silver halide grains in the form of a solution in water or in a mixed solvent of water and an organic solvent miscible with water (for example, alcohols, ethers, glycols, ketones, esters, amides etc.), or in the form of a mixture thereof with gelatin.

The amount of the hexacyano-metal complex is preferably $1\times10^{-5}$ mole to $1\times10^{-2}$ mole, more preferably $1\times10^{-4}$ mole to $1\times10^{-3}$ mole, per mol of silver.

In order to make the hexacyano-metal complex exist on the outermost surfaces of silver halide grains, the complex is directly added before completion of the grain formation process, i.e., after the addition of an aqueous silver nitrate solution used for the formation of silver halide grains and before chemical sensitization process where chalcogen sensitization with sulfur, selenium or tellurium or noble metal sensitization with gold or the like is performed, during washing with water or dispersion operation or immediately before the chemical sensitization. To prevent growth of the silver halide grains, it is desirable that the hexacyano-metal complex is added to the grains immediately after the grains are formed, and the complex is added before the grain formation process is finished.

The addition of the hexacyano-metal complex may be started after 96 weight % of the total of silver nitrate has been added. More preferably it is added after 98 weight of silver nitrate, particularly preferably after 99 weight % of silver nitrate has been added.

If the hexacyano-metal complex is added after addition of aqueous solution of silver nitrate in which the formation of silver halide grains is almost completed, the hexacyano-metal complex can be adsorbed onto the outermost surfaces of the silver halide grains, and most of the complex forms a hardly-soluble salt with silver ions existing on the surfaces of the grains. Such a silver salt of hexacyano-iron (II) is a salt more hardly soluble than AgI, and therefore fine grains formed are prevented from being dissolved again. Thus, it becomes possible to produce fine silver halide grains having a small grain size.

As for the grain size distribution of the silver halide grains used for the present invention, the grains show monodispersion degree of 30% or less, preferably 1–20%, more preferably 5–15%. The monodispersion degree used herein is defined as a percentage (%) of a value obtained by dividing standard deviation of grain size by average grain size (variation coefficient). The grain size of the silver halide grains is represented as a ridge length for cubic grains, or a diameter as circle of projected area for the other grains (octahedral grains, tetradecahedral grains, tabular grains and so forth) for convenience.

The photosensitive silver halide grains used for the present invention preferably contain a metal of Group VII or Group VIII in the periodic table of elements or a complex of such a metal. The metal of Group VII or Group VIII of the periodic table or the center metal of the complex is preferably rhodium, rhenium, ruthenium, osmium or iridium. Particularly preferred metal complexes are $(NH_4)_3Rh(H_2O)Cl_5$, $K_2Ru(NO)Cl_5$, $K_3IrCl_6$ and $K_4Fe(CN)_6$. The metal complexes may be used each alone, or two or more complexes of the same or different metals may also be used in combination. The metal or metal complex content is preferably from $1\times10^{-9}$ to $1\times10^{-3}$ mole, more preferably $1\times10^{-8}$ to $1\times10^{-4}$ mole, permole of silver. As for specific structures of metal complexes, metal complexes of the structures described in JP-A-7-225449 and so forth can be used. Types and addition methods of these heavy metals and complexes thereof are described in JP-A-11-119374, paragraphs 0227–0240.

The photosensitive silver halide grains may be desalted by washing methods with water known in the art, such as the noodle washing and flocculation washing. However, the grains may not be desalted in the present invention.

The photosensitive silver halide grains are preferably subjected to chemical sensitization. For the chemical sensitization, the method described in JP-A-11-119374, paragraphs 0242–0250 can preferably be used.

Silver halide emulsions used in the present invention may be added with thiosulfonic acid compounds by the method described in EP-A-293,917.

As gelatin used with the photosensitive silver halide used for the present invention, low molecular weight gelatin is preferably used in order to maintain good dispersion state of the silver halide emulsion in a coating solution containing a silver salt of an organic acid. The low molecular weight gelatin has a molecular weight of 500–60,000, preferably 1,000–40,000. While such low molecular weight gelatin may be added during the formation of grains or dispersion operation after the desalting treatment, it is preferably added during dispersion operation after the desalting treatment. It is also possible to use ordinary gelatin (molecular weight of about 100,000) during the grain formation and use low molecular weight gelatin during dispersion operation after the desalting treatment.

While the concentration of dispersion medium may be 0.05–20 weight %, it is preferably in the range of 5–15 weight % in view of handling. As for type of gelatin, alkali-treated gelatin is usually used. Besides that, however, acid-treated gelatin, modified gelatin such as phthalated gelatin and so forth can also be used.

As a sensitizing dye that can be used for the present invention, there can be advantageously selected those sensitizing dyes that can spectrally sensitize silver halide grains within a desired wavelength range after they are adsorbed by the silver halide grains and have spectral sensitivity suitable for spectral characteristics of the light source to be used for exposure. Such sensitizing dyes and addition methods therefor are described in JP-A-11-65021, paragraphs 0103 to 0109, the compounds of formula (II) mentioned in JP-A-10-186572, the dyes represented by the general formula (I) mentioned in JP-A-11-119374 and paragraph 0106 of the same, dyes mentioned in U.S. Pat. Nos. 5,510,236, 3,871,887, Example 5, dyes mentioned in JP-A-2-96131, JP-A-59-48753, EP-A-0803764, page 19, line 38 to page 20, line 35, Japanese Patent Application Nos. 2000-86865, 2000-102560, 2000-205399 and so forth.

For example, as dyes that spectrally sensitize in a wavelength range of 550 nm to 750 nm, there can be mentioned the compounds of formula (II) described in JP-A-10-186572, and more specifically, dyes of II-6, II-7, II-14, II-15, II-18, II-23 and II-25 mentioned in the same can be exemplified as preferred dyes. As dyes that spectrally sensitize in a wavelength range of 750 nm to 1400 nm, there can be mentioned the compounds of formula (I) described in JP-A-11-119374, and more specifically, dyes of (25), (26), (30), (32), (36), (37), (41), (49) and (54) mentioned in the same can be exemplified as preferred dyes. Further, as dyes forming J-band, those disclosed in U.S. Pat. Nos. 5,510,236, 3,871,887 (Example 5), JP-A-2-96131 and JP-A-59-48753 can be exemplified as preferred dyes. These sensitizing dyes can be used each alone, or two or more of them can be used in combination.

In the present invention, the sensitizing dye is added to the silver halide emulsion preferably during the period after the desalting step and before the coating step, more preferably during the period after the desalting step and before the start of the chemical ripening.

While the amount of the sensitizing dye used in the present invention may be selected to be a desired amount depending on the performance including sensitivity and fog, it is preferably used in an amount of $10^{-6}$–1 mole, more preferably $10^{-4}$–$10^{-1}$ mole, per mole of silver halide in the photosensitive layer.

In the present invention, a supersensitizer can be used in order to improve spectral sensitization efficiency. Examples of the supersensitizer used for the present invention include the compounds disclosed in EP-A-587,338, U.S. Pat. Nos. 3,877,943, 4,873,184, JP-A-5-341432, JP-A-11-109547, JP-A-10-111543 and so forth.

Photosensitive silver halide grains used for the present invention are preferably subjected to chemical sensitization by sulfur sensitization, selenium sensitization or tellurium sensitization. Any known compounds are preferably usable for such sulfur, selenium or tellurium sensitization, and for example, the compounds described in JP-A-7-128768 are usable for that purpose. In the present invention, especially favorable is tellurium sensitization, and the compounds described in JP-A-11-65021, paragraph 0030 and those disclosed in JP-A-5-313284 as the compounds of the general formulas (II), (III) and (IV) are preferred.

In the present invention, the chemical sensitization may be performed at any time so long as it is performed after the formation of the grains and before the coating. It may be performed after desalting and (1) before the spectral sensitization, (2) simultaneously with the spectral sensitization, (3) after the spectral sensitization, (4) immediately before the coating, or the like. It is particularly preferably performed after spectral sensitization.

The amount of the sulfur, selenium or tellurium sensitizer for use in the present invention varies depending on the type of the silver halide grains to be used, the condition for chemical ripening etc., but may fall generally between $10^{-8}$ and $10^{-2}$ mole, preferably between $10^{-7}$ and $10^{-3}$ mole or so, per mole of the silver halide. Although the conditions for the chemical sensitization are not particularly limited in the present invention, pH falls between around 5 and 8, the pAg falls between around 6 and 11, and the temperature falls between around 40 and 95° C.

In the photothermographic material of the present invention, one kind of photosensitive silver halide emulsion may be used or two or more different emulsions (for example, those having different average grain sizes, different halogen compositions, different crystal habits or different chemical sensitization conditions) may be used in combination. By using plural photosensitive silver halides having different sensitivities, contrast can be controlled. Examples of the techniques concerning these include those mentioned in JP-A-57-119341, JP-A-53-106125, JP-A-47-3929, JP-A-48-55730, JP-A-46-5187, JP-A-50-73627, JP-A-57-150841 and so forth. Each emulsion may preferably have sensitivity difference of 0.2 log E or more.

The amount of the photosensitive silver halide used in the present invention is preferably from 0.01 to 0.5 mole, more preferably from 0.02 to 0.3 mole, still more preferably from 0.03 to 0.25 mole, per mole of the silver salt of an organic acid.

Methods and conditions for mixing photosensitive silver halide and a silver salt of an organic acid, which are prepared separately, are not particularly limited so long as the effect of the present invention can be attained satisfactorily. Examples thereof include, for example, a method of mixing silver halide grains and a silver salt of an organic acid after completion of respective preparations by using a high-speed stirring machine, ball mill, sand mill, colloid mill, vibrating mill or homogenizer or the like, or a method of preparing a silver salt of an organic acid by mixing a photosensitive silver halide obtained separately at any time during the preparation of the silver salt of an organic acid. In the mixing, two or more kinds of organic acid silver salt aqueous dispersions are preferably mixed with two or more kinds of photosensitive silver salt aqueous dispersions, so that the photographic properties can be controlled.

The silver salt of an organic acid that can be used for the present invention, which is a reducible silver salt, is a silver salt relatively stable against light, but forms a silver image when it is heated at 80° C. or higher in the presence of an exposed photocatalyst (e.g., a latent image of photosensitive silver halide) and a reducing agent. The silver salt of an organic acid may be any organic substance containing a source of reducible silver ions. Silver salts of an organic acid, in particular, silver salts of a long chain aliphatic carboxylic acid having from 10 to 30, preferably from 15 to 28 carbon atoms, are preferred. Complexes of organic or inorganic acid silver salts of which ligands have a complex stability constant in the range of 4.0–10.0 are also preferred. The silver supplying substance can preferably constitute about 5–70 weight % of the image-forming layer. Preferred examples of the silver salts of an organic acid include silver salts of organic compounds having carboxyl group. Specifically, the silver salts of an organic acid may be silver salts of an aliphatic carboxylic acid and silver salts of an aromatic carboxylic acid, but not limited to these. Preferred examples of the silver salts of an aliphatic carboxylic acid include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate, mixtures thereof and so forth.

In the present invention, there is preferably used silver salt of an organic acid having a silver behenate content of 75 mole % or more, more preferably silver salt of an organic acid having a silver behenate content of 85 mole % or more, among the aforementioned silver salts of an organic acid and mixtures of silver salts of an organic acid. The silver behenate content used herein means a molar percent of silver behenate with respect to silver salt of an organic acid to be used. As silver salts of an organic acid other than silver behenate contained in the silver salts of organic acid used for the present invention, the silver salts of an organic acid exemplified above can preferably be used.

Silver salts of an organic acid that can be preferably used for the present invention can be prepared by allowing a solution or suspension of an alkali metal salt (e.g., Na salts, K salts, Li salts) of the aforementioned organic acids to react with silver nitrate. As the preparation method, the methods described in JP-A-2000-292882, paragraphs 0019–0021 and EP-A-0962812 can be used.

In the present invention, a method of preparing a silver salt of an organic acid by adding an aqueous solution of silver nitrate and a solution of alkali metal salt of an organic acid to a sealable means for mixing liquids can preferably be used. Specifically, the method described in Japanese Patent Application Nos. 11-203413 and 2000-195621 can be used.

In the present invention, a dispersing agent soluble in water can be added to the aqueous solution of silver nitrate and the solution of alkali metal salt of an organic acid or reaction mixture during the preparation of the silver salt of an organic acid. Type and amount of the dispersing agent used in this case are specifically mentioned in JP-A-2000-305214, paragraph 0052.

The silver salt of an organic acid for use in the present invention is preferably prepared in the presence of a tertiary alcohol. The tertiary alcohol preferably has a total carbon number of 15 or less, more preferably 10 or less. Examples of preferred tertiary alcohols include tert-butanol. However, tertiary alcohol that can be used for the present invention is not limited to it.

The tertiary alcohol used for the present invention may be added in any timing during the preparation of the organic acid silver salt, but the tertiary alcohol is preferably used by adding at the time of preparation of the organic acid alkali metal salt to dissolve the organic alkali metal salt. The tertiary alcohol for use in the present invention may be added in any amount of 0.01–10 in terms of the weight ratio to water used as a solvent for the preparation of the silver salt of an organic acid, but preferably added in an amount of 0.03–1 in terms of weight ratio to water.

Although shape and size of the organic acid silver salt are not particularly limited, those mentioned in JP-A-2000-292882, paragraph 0024 and EP-A-0962812 can be preferably used. The shape of the organic acid silver salt can be determined from a transmission electron microscope image of organic silver salt dispersion. An example of the method for determining monodispesibility is a method comprising obtaining the standard deviation of a volume weight average diameter of the organic acid silver salt. The percentage of a value obtained by dividing the standard deviation by the volume weight average diameter (variation coefficient) is preferably 80% or less, more preferably 50% or less, particularly preferably 30% or less. As a measurement method, for example, the grain size can be determined by irradiating organic acid silver salt dispersed in a liquid with a laser ray and determining an autocorrelation function for change of the fluctuation of the scattered light with time (volume weight average diameter). The average grain size determined by this method is preferably from 0.05 to 10.0 um, more preferably from 0.1 to 5.0 μm, further preferably from 0.1 to 2.0 μm, as in solid microparticle dispersion.

The silver salt of an organic acid that can be used in the present invention is preferably desalted. The desalting method is not particularly limited and any known methods may be used. Known filtration methods such as centrifugal filtration, suction filtration, ultrafiltration and flocculation washing by coagulation may be preferably used. As the method of ultrafiltration, the method described in JP-A-2000-292882 and Japanese Patent Application No. 2000-90093 can be used.

For obtaining an organic acid silver salt solid dispersion having a high S/N ratio and a small grain size and being free from coagulation, there is preferably used a dispersion method comprising steps of converting an aqueous dispersion that contains a silver salt of an organic acid as an image-forming medium and contains substantially no photosensitive silver salt into a high-speed flow dispersion, and then releasing the pressure. As such a dispersion method, the method mentioned in JP-A-2000-292882, paragraphs 0027–0038 can be used.

The grain size distribution of the silver salt of an organic acid preferably corresponds to monodispersion. Specifically, the percentage (variation coefficient) of the value obtained by dividing a standard deviation by a volume weight average diameter is preferably 80% or less, more preferably 50% or less, particularly preferably 30% or less.

The organic acid silver salt grain solid dispersion used for the present invention consists at least of a silver salt of an organic acid and water. While the ratio of the silver salt of an organic acid and water is not particularly limited, the ratio of the silver salt of an organic acid is preferably in the range of 5–50 weight %, particularly preferably 10–30 weight %, with respect to the total weight. While it is preferred that the aforementioned dispersing agent should be used, it is preferably used in a minimum amount within a range suitable for minimizing the grain size, and it is preferably used in an amount of 0.5–30 weight %, particularly preferably 1–15 weight %, with respect to the silver salt of an organic acid.

The silver salt of an organic acid for use in the present invention may be used in any desired amount. However, it is preferably used in an amount of 0.1–5 g $m^2$, more preferably 1–3 g $m^2$, in terms of silver.

The photothermographic material of the present invention contains a binder on the same surface of a support as the photosensitive silver halide and the reducible silver salt. The binder of the image-forming layer (photosensitive layer, emulsion layer) can be selected from well known natural or synthetic resins such as gelatin, poly(vinyl acetal), poly (vinyl chloride), poly(vinyl acetate), cellulose acetate, polyolefins, polyesters, polystyrene, polyacrylonitrile and polycarbonate. Copolymers and terpolymers may also be used. Preferred polymers are polyvinyl butyral, butyl ethyl cellulose, methacrylate copolymer, maleic anhydride ester copolymer, polystyrene and butadiene/styrene copolymer. Two or more of these polymers can be used in combination, if required. The polymers are used in an amount sufficient to hold other components in the polymer, namely, they are used in an effective range to function as a binder. Those skilled in the art can appropriately determine the effective range. In order to hold at least the organic silver salt, the proportion of the binder and the organic silver salt may preferably range from about 15:1 to 1:2, particularly preferably 8:1 to 1:1.

Among image-forming layers, at least one layer is preferably an image-forming layer utilizing polymer latex to be explained below in an amount of 50 weight % or more with respect to the total amount of binder (this image-forming layer will be referred to as the "image-forming layer of the present invention", and the polymer latex used for the binder will be referred to as the "polymer latex used in the present invention" hereinafter). The polymer latex may be used not only in the image-forming layer, but also in the protective layer, back layer or the like. When the photothermographic material of the present invention is used for, in particular, printing use in which dimensional change causes problems, the polymer latex should be used also in a protective layer and a back layer. The term "polymer latex" used herein means a dispersion comprising hydrophobic water-insoluble polymer dispersed in a water-soluble dispersion medium as fine particles. The dispersed state may be one in which polymer is emulsified in a dispersion medium, one in which polymer underwent emulsion polymerization, micelle dispersion, one in which polymer molecules having a hydrophilic portion are dispersed in a molecular state or the like. Polymer latex used in the present invention is described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); Soichi Muroi, "Gosei Latex no Kagaku (Chemistry of Synthetic Latex)", Kobunshi Kanko Kai (1970) and so forth. The dispersed particles preferably have a mean particle size of about 1–50000 nm, more preferably about 5–1000 nm. The particle size distribution of the dispersed particles is not particularly limited, and the particles may have either wide particle size distribution or monodispersed particle size distribution.

Other than ordinary polymer latex of a uniform structure, the polymer latex used in the present invention may be latex of the so-called core/shell type. In this case, use of different glass transition temperatures of the core and shell may be preferred.

Preferred range of the glass transition temperature (Tg) of the polymer latex preferably used as the binder varies for the protective layer, back layer and image-forming layer. As for the image-forming layer, the glass transition temperature is 40° C. or lower, preferably 20–40° C., preferably 23–40° C., preferably 30–40° C., for accelerating diffusion of photographic elements during the heat development. Polymer latex used for the protective layer or back layer preferably has a glass transition temperature of 25–70° C., because these layers are brought into contact with various apparatuses.

The polymer latex used in the present invention preferably shows a minimum film forming temperature (MFT) of about −30–90° C., more preferably about 0–70° C. A film-forming aid may be added in order to control the minimum film forming temperature. The film-forming aid is also referred to as a plasticizer, and consists of an organic compound (usually an organic solvent) that lowers the minimum film forming temperature of the polymer latex. It is explained in, for example, the aforementioned Soichi Muroi, "Gosei Latex no Kagaku (Chemistry of Synthetic Latex)", Kobunshi Kanko Kai (1970).

Examples of polymer species used for the polymer latex used in the present invention include acrylic resins, polyvinyl acetate resins, polyester resins, polyurethane resins, rubber resins, polyvinyl chloride resins, polyvinylidene chloride resins and polyolefin resins, copolymers of monomers constituting these resins and so forth. The polymers may be linear, branched or crosslinked. They may be so-called homopolymers in which a single kind of monomer is polymerized, or copolymers in which two or more different kinds of monomers are polymerized. The copolymers may be random copolymers or block copolymers. The polymers may have a number average molecular weight of 5,000 to 1,000,000, preferably from 10,000 to 100,000. Polymers having a too small molecular weight may unfavorably suffer from insufficient mechanical strength of the image-forming layer, and those having a too large molecular weight may unfavorably suffer from bad film forming property.

Examples of the polymer latex used as the binder of the image-forming layer of the photothermographic material of the present invention include latex of methyl methacrylate/ethyl acrylate/methacrylic acid copolymer, latex of methyl methacrylate/2-ethylhexyl acrylate/styrene/acrylic acid copolymer, latex of styrene/butadiene/acrylic acid copolymer, latex of styrene/butadiene/divinylbenzene/methacrylic acid copolymer, latex of methyl methacrylate/vinyl chloride/acrylic acid copolymer, latex of vinylidene chloride/ethyl acrylate/acrylonitrile/methacrylic acid copolymer and so forth. Such polymers are also commercially available and examples thereof include acrylic resins such as CEBIAN A4635, 46583, 4601 (all produced by Dicel Kagaku Kogyo Co., Ltd), Nipol Lx811, 814, 821, 820, 857 (all produced by Nippon Zeon Co., Ltd.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber resins such as LACSTAR 7310K, 3307B, 4700H, 7132C (all produced by Dai-Nippon Ink & Chemicals, Inc.), Nipol LX416, 410, 438C, 2507 (all produced by Nippon Zeon Co., Ltd.); polyvinyl chloride resins such as G351, G576 (both produced by Nippon Zeon Co., Ltd.); polyvinylidene chloride resins such as L502, L513 (both produced by Asahi Chemical Industry Co., Ltd.), ARON D7020, D504, D5071 (all produced by Mitsui Toatsu Co., Ltd.); and olefin resins such as CHEMIPEARL S120 and SA100 (both produced by Mitsui Petrochemical Industries, Ltd.) and so forth. These polymers may be used individually or if desired, as a blend of two or more of them.

The image-forming layer of the photothermographic material of the present invention preferably contains 50 weight % or more, more preferably 70 weight % or more of the aforementioned polymer latex based on the total binder.

The total amount of the binder in the image-forming layer is preferably from 0.2–30 g/m$^2$, more preferably from 1–15 g/m$^2$. The image-forming layer may contain a crosslinking agent for crosslinking, surfactant for improving coatability and so forth.

If needed, the image-forming layer may contain a hydrophilic polymer in an amount of 50 weight % or less of the total binder, such as gelatin, polyvinyl alcohol, methylcellulose, hydroxypropylcellulose, carboxymethylcellulose and hydroxypropylmethylcellulose. The amount of the hydrophilic polymer is preferably 30 weight % or less, more preferably 15 weight % or less, of the total binder in the image-forming layer.

In the present invention, the image-forming layer is preferably formed by coating an aqueous coating solution and then drying the coating solution. The term "aqueous" as used herein means that water content of the solvent (dispersion medium) in the coating solution is 60 weight % or more. In the coating solution, the component other than water may be a water-miscible organic solvent such as methyl alcohol, ethyl alcohol, isopropyl alcohol, methyl cellosolve, ethyl cellosolve, dimethylformamide and ethyl acetate. Specific examples of the solvent composition include, in addition to water, water/methanol=90/10, water/methanol=70/30, water/ethanol=90/10, water/isopropanol=90/10, water/dimethylformamide=95/5, water/methanol/dimethylformamide=80/15/5, and water/methanol/dimethylformamide=90/5/5 (the numerals indicate weight %).

The silver halide emulsion and/or the silver salt of an organic acid for use in the photothermographic material of the present invention can be further prevented from the production of additional fog or stabilized against the reduction in sensitivity during the stock storage by a known antifoggant, stabilizer or stabilizer precursor. Examples of suitable antifoggant, stabilizer and stabilizer precursor that can be used individually or in combination include the thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechols described in U.S. Pat. No. 3,235,652, oximes, nitrons and nitroindazoles described in British Patent No. 623,448, polyvalent metal salts described in U.S. Pat. No. 2,839,405, thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, phosphorus compounds described in U.S. Pat. No. 4,411,985 and so forth.

The antifoggant that is particularly preferably used in the present invention is an organic halide, and examples thereof include the compounds described in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809 and U.S. Pat. Nos. 5,340,712, 5,369,000 and 5,464,737.

Although not essential for practicing the present invention, it is advantageous in some cases to add a mercury (II) salt as an antifoggant to the emulsion layer. Preferred mercury (II) salts for this purpose are mercury acetate and mercury bromide.

The photothermographic material of the present invention may contain a benzoic acid compound for the purpose of achieving high sensitivity or preventing fog. The benzoic acid compound for use in the present invention may be any benzoic acid derivative, but preferred examples thereof include the compounds described in U.S. Pat. Nos. 4,784,939 and 4,152,160 and JP-A-9-329863, JP-A-9-329864 and JP-A-9-281637.

The benzoic acid compound may be added in any amount. However, the addition amount thereof is preferably from $1\times10^{-6}$ to 2 mole, more preferably from $1\times10^{-3}$ to 0.5 mole, per mole of silver. The benzoic acid compound may be added in any form such as powder, solution, and microparticle dispersion, or it may be added as a solution containing a mixture of the benzoic acid compound with other additives such as a sensitizing dye, reducing agent and toning agent. The benzoic acid compound for use in the present invention may be added at any step during the preparation of the coating solution. In the case of adding the benzoic acid compound to a layer containing a silver salt of an organic acid, it may be added at any step from the preparation of the silver salt of an organic acid to the preparation of the coating solution, but it is preferably added in the period after the preparation of the silver salt of an organic acid and immediately before the coating. The benzoic acid compound for use in the present invention may be added to any site of the photothermographic material, but it is preferably added to a layer on the side of the photosensitive layer that is the image-forming layer, more preferably a layer containing a silver salt of an organic acid.

The photothermographic material of the present invention may contain a mercapto compound, disulfide compound or thione compound so as to control the development by inhibiting or accelerating the development, improve spectral sensitization efficiency or improve the storage stability before or after the development.

In the case of using a mercapto compound, one having any structure may be used but those represented by Ar—SM$^0$ or Ar—S—S—Ar are preferred, wherein M$^0$ is hydrogen atom or an alkali metal atom, and Ar is an aromatic ring or condensed aromatic ring containing one or more nitrogen, sulfur, oxygen, selenium or tellurium atoms. The heteroaromatic ring is preferably selected from benzimidazole, naphthimidazole, benzothiazole, naphthothiazole, benzoxazole, naphthoxazole, benzoselenazole, benzotellurazole, carbazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have one or more substituents selected from, for example, the group consisting of a halogen (e.g., Br, Cl), hydroxy, amino, carboxy, alkyl (e.g., alkyl having one or more carbon atoms, preferably from 1 to 4 carbon atoms), alkoxy (e.g., alkoxy having one or more carbon atoms, preferably from 1 to 4 carbon atoms) and aryl (which may have a substituent). Examples of the mercapto-substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methyl-pyrimidine hydrochloride, 3-mercapto-5-phenyl-1,2,4-triazole, 1-phenyl-5-mercaptotetrazole, sodium 3-(5-mercaptotetrazole)-benzenesulfonate, N-methyl-N'-{3-(5-mercaptotetrazolyl)-phenyl}urea, 2-mercapto-4-phenyloxazole, N-[3-(5-mercapto-acetylamino)propyl]carbazole and so forth. However, the present invention is not limited to these.

The amount of the mercapto compound is preferably from 0.0001 to 1.0 mole, more preferably from 0.001 to 0.3 mole, per mole of silver in the image-forming layer.

The image-forming layer (photosensitive layer) of the photothermographic material of the present invention may contain, as a plasticizer or a lubricant, polyhydric alcohols (for example, glycerins and diols described in U.S. Pat. No. 2,960,404), fatty acids or esters thereof described in U.S. Pat. Nos. 2,588,765 and 3,121,060, and silicone resins described in British Patent No. 955,061.

The image-forming layer for use in the photothermographic material of the present invention may contain a dye or a pigment of various types to improve color tone or prevent irradiation. Any dye or pigment may be used, and examples thereof include pigments and dyes described in the color index. Specific examples thereof include organic pigments and inorganic pigments such as pyrazoloazole dyes, anthraquinone dyes, azo dyes, azomethine dyes, oxonol dyes, carbocyanine dyes, styryl dyes, triphenylmethane dyes, indoaniline dyes, indophenol dyes and phthalocyanines. Preferred examples of the dye include anthraquinone dyes (e.g., Compounds 1 to 9 described in JP-A-5-341441, Compounds 3–6 to 3–18 and 3–23 to 3–38 described in JP-A-5-165147), azomethine dyes (e.g., Compounds 17 to 47 described in JP-A-5-341441), indoaniline dyes (e.g., Compounds 11 to 19 described in JP-A-5-289227, Compound 47 described in JP-A-5-341441, Compounds 2–10, 2–11 and so forth described in JP-A-5-165147) and azo dyes (Compounds 10 to 16 described in JP-A-5-341441).

The amount of the dye or pigment may be determined depending on a desired amount of absorption. In general, the compound is preferably used in an amount of from 1 μg to 1 g per 1 $m^2$ of the photosensitive material. These dyes may be added in any form, for example, as a solution, emulsion or solid microparticle dispersion, or as a polymer mordant mordanted with a dye.

The photothermographic material of the present invention may have a surface protective layer, for example, in order to prevent adhesion of the image-forming layer.

The surface protective layer may contain any polymers as a binder. The surface protective layer may preferably contain a polymer having carboxyl residues in an amount of from 100 mg/$m^2$ to 5 g/$m^2$. Examples of the polymer having carboxyl residues include, for example, natural polymers (e.g., gelatin, alginic acid), modified natural polymers (e.g., carboxymethyl cellulose, phthalized gelatin), synthetic polymers (e.g., polymethacrylate, polyacrylate, poly(alkyl methacrylate)/acrylate copolymer, polystyrene/polymethacrylate copolymer) and the like. The content of the carboxyl residue in the polymer is preferably from 10 mmol to 1.4 mol per 100 g of the polymer. The carboxylic acid residues may form salts with alkali metal ions, alkaline earth metal ions, organic cations and so forth.

For the surface protective layer, any anti-adhesion material can be used. Examples of the anti-adhesion material include wax, silica particles, styrene-containing elastomeric block copolymer (e.g., styrene/butadiene/styrene, styrene/isoprene/styrene), cellulose acetate, cellulose acetate butyrate, cellulose propionate and mixtures thereof. The surface protective layer may also contain a crosslinking agent for forming cross-linkage or a surface active agent for improving coating property.

In the present invention, the image-forming layer or the protective layer for the image-forming layer may contain a light-absorbing material and a filter dye such as those described in U.S. Pat. Nos. 3,253,921, 2,274,782, 2,527,583 and 2,956,879. The dyes can be mordanted as described in, for example, U.S. Pat. No. 3,282,699. The filter dye is preferably used in such an amount that absorbance at an exposure wavelength of 0.1–3, most preferably 0.2–1.5, should be achieved.

In the present invention, the image-forming layer or a layer adjacent thereto may contain various types of dyes and pigments (e.g., C.I. Pigment Blue 60, C.I. Pigment Blue 64, C.I. Pigment Blue 15:6) may be used to improve color tone, to prevent interference fringes generated during laser exposure and to prevent irradiation. These techniques are detailed in International Patent Publication WO98/36322, JP-A-10-268465, JP-A-11-338098 and so forth.

The photothermographic material of the present invention is preferably a so-called single-sided photosensitive material comprising a support having on one side thereof at least one photosensitive layer (preferably, an image-forming layer) containing a silver halide emulsion and on the other side thereof a back layer.

The back layer preferably has a maximum absorption of from about 0.3 to 2.0 in a desired wavelength range. Where the desired range is 750–1,400 nm, the back layer may preferably have an optical density of from 0.005 to less than 0.5 at from 360–750 nm, and more preferably act as an antihalation layer having optical density of from 0.001 to less than 0.3. Where the desired range is less than 750 nm, the back layer may preferably be an antihalation layer having a maximum absorption of from 0.3 to 2.0 in a desired range of wavelength before the formation of an image, and an optical density of from 0.005 to less than 0.3 at 360–750 nm after the formation of an image. The method for decreasing the optical density after the formation of an image to the above-described range is not particularly limited. For example, a method for reducing the density through decoloration of dye by heating as described in Belgian Patent No. 733,706, or a method for reducing the density using decoloration by light irradiation described in JP-A-54-17833 may be used.

The antihalation layer is described in JP-A-11-65021, paragraphs 0123 to 0124, JP-A-11-223898, JP-A-9-230531, JP-A-10-36695, JP-A-10-104779, JP-A-11-231457, JP-A-11-352625, JP-A-11-352626 and so forth.

When antihalation dyes are used, the dyes may be any compounds so long as they have an intended absorption in a desired wavelength region and sufficiently low absorption in a visible region after the development, and also provide an absorption spectral pattern desired for the aforementioned back layer. Examples of such dye include, as a single dye, the compounds described in JP-A-59-56458, JP-A-2-216140, JP-A-7-13295, JP-A-7-11432, U.S. Pat. No. 5,380,635, JP-A-2-68539 (from page 13, left lower column, line 1 to page 14, left lower column, line 9) and JP-A-3-24539 (from page 14, left lower column to page 16, right lower column); and as a dye which is decolored after the treatment, the compounds described in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-A-11-231457, JP-B-48-33692, JP-B-50-16648, JP-B-2-41734 and U.S. Pat. Nos. 4,088,497, 4,283,487, 4,548,896 and 5,187,049. However, the scope of the present invention is not limited to these examples.

The binder suitable for the back layer may be transparent or translucent, and generally colorless. Examples include natural polymers and synthetic resins including homopolymers and copolymers, and other film-forming media. Specific examples include, for example, gelatin, gum arabic, poly(vinyl alcohol), hydroxyethylcellulose, cellulose acetate, cellulose acetate butyrate, poly(vinylpyrrolidone), casein, starch, poly(acrylic acid), poly(methyl methacrylate), poly(vinyl chloride), poly(methacrylic acid), copoly(styrene-maleic anhydride), copoly(styrene-acrylonitrile), copoly(styrene-butadiene), poly(vinyl acetal) (e.g., poly(vinyl formal), poly(vinyl butyral)), poly(ester), poly(urethane), phenoxy resin, poly(vinylidene chloride), poly(epoxide), poly(carbonate), poly(vinyl acetate), cellulose ester and poly(amide). The binder may be coated after being dissolved in water or an organic solvent or in the form of an emulsion.

The photothermographic material of the present invention may contain, in the surface protective layer for the photosensitive emulsion layer (preferably image-forming layer) and/or the back layer or in the surface protective layer for the back layer, a matting agent to improve transferability. The matting agent is, in general, a fine particle of a water-insoluble organic or inorganic compound. Any matting agent may be employed, and those well known in the art may be used, such as organic matting agents described in U.S. Pat. Nos. 1,939,213, 2,701,245, 2,322,037, 3,262,782, 3,539,344 and 3,767,448, or inorganic matting agents described in U.S. Pat. Nos. 1,260,772, 2,192,241, 3,257,206, 3,370,951, 3,523,022 and 3,769,020. Specific examples of the organic compound which can be used as the matting agent include, for example, water-dispersible vinyl polymers such as polymethyl acrylate, polymethyl methacrylate, polyacrylonitrile, acrylonitrile/α-methylstyrene copolymer, polystyrene, styrene/divinylbenzene copolymer, polyvinyl acetate, polyethylene carbonate and polytetrafluoroethylene; cellulose derivatives such as methyl cellulose, cellulose acetate and cellulose acetate propionate; starch derivatives such as carboxy starch, carboxynitrophenyl starch and urea/formaldehyde/starch reaction product; and gelatin hardened with a known hardening agent and hardened gelatin in the form of a microcapsule hollow particle produced by coacervation hardening. Examples of the inorganic compound include, for example, silicon dioxide, titanium dioxide, magnesium dioxide, aluminum oxide, barium sulfate, calcium carbonate, silver chloride desensitized by a known method, silver bromide desensitized by a known method, glass, diatomaceous earth and so forth. The matting agent may be used as a mixture of different substances as required. The size and shape of the matting agent are not particularly limited and the matting agent may have any particle size. A matting agent having a particle size of from 0.1–30 μm may preferably used to carry out the present invention. The matting agent may have either a narrow or broad particle size distribution. However, since the matting agent may greatly affect the haze or surface gloss of the photosensitive material, the particle size, shape and particle size distribution is preferably controlled to meet a desired purpose at the preparation of the matting agent or by mixing several matting agents.

The matting agent may preferably be incorporated in the outermost surface layer of the photosensitive material or a layer which functions as the outermost surface layer, or alternatively, in a layer close to the outer surface or a layer which acts as a so-called protective layer. The matting degree on the surface protective layer for the emulsion layer can be freely chosen so long as the star dust troubles do not occur. The degree may preferably be within a range of 500–10,000 seconds, most preferably 500–2,000 seconds, in terms of Beck's smoothness.

According to the present invention, the photothermographic material that is a single-sided photosensitive material and has a back layer containing a matting agent constitutes a preferred embodiment. The matting degree of the back layer is 10–1,200 seconds, more preferably 50–700 seconds, in terms of Beck's smoothness.

The emulsion for photothermography used in the present invention is coated on a support to form one or more layers. In the case of a single layer, the layer must contain a silver salt of an organic acid, a silver halide, a developing agent, a binder, and materials to be optionally added such as a toning agent, coating aid and other auxiliary agents. In the case of a double-layer structure, the first emulsion layer (usually a layer adjacent to the substrate) must contain a silver salt of an organic acid and a silver halide, and the second layer or both layers must contain some other components. However, a double-layer structure comprising a single emulsion layer containing all of the components and a protective topcoat may also be contemplated. A multicolor photosensitive photothermographic material may have a combination of the above-described two layers for each of the colors, or as described in U.S. Pat. No. 4,708,928, a structure comprising a single layer containing all components. In the case of a multi-dye multi-color photothermographic material, a functional or non-functional barrier layer is generally provided between respective emulsion layers (photosensitive layers) to keep the emulsion layer away from each other as described in U.S. Pat. No. 4,460,681.

A backside resistive heating layer described in U.S. Pat. Nos. 4,460,681 and 4,374,921 may also be used in the photothermographic image system.

A hardening agent may be added to the image-forming layer (photosensitive layer), the protective layer, the back layer and other layers. Examples of the hardening agent are described in T. H. James, "THE THEORY OF THE PHOTOGRAPHIC PROCESS, FOURTH EDITION", Macmillan Publishing Co., Inc., 1977, pp. 77–87. There may be preferably used chromium alum, 2,4-dichloro-6-hydroxy-s-triazine sodium salt, N,N-ethylene-bis(vinylsulfonacetamide), N,N-propylenebis(vinylsulfonacetamide), as well as the polyvalent metal ions described on page 78 of the above article, polyisocyanates described in U.S. Pat. No. 4,281,060 and JP-A-6-208193; epoxy compounds described in U.S. Pat. No. 4,791,042; vinylsulfone compounds described in JP-A-62-89048 and so forth.

In the present invention, a surface active agent may also be used to improve the coating property, electrostatic charge property and so forth. Examples of the surface active agent include nonionic, anionic, cationic and fluorocarbon surface active agents, which may be appropriately chosen and used. Specific examples thereof include fluorocarbon polymer surface active agents described in JP-A-62-170950 and U.S. Pat. No. 5,380,644, fluorocarbon surface active agents described in JP-A-60-244945 and JP-A-63-188135, polysiloxane surface active agents described in U.S. Pat. No. 3,885,965, and polyalkylene oxides and anionic surface active agents described in JP-A-6-301140.

Various types of supports may be used for the photothermographic material of the present invention. Typical examples of the support include polyester film, undercoated polyester film, poly(ethylene terephthalate) film, polyethylene naphthalate film, nitrocellulose film, cellulose ester film, poly(vinyl acetal) film, polycarbonate film, other related or resinous material, glass, paper, metal and so forth. A flexible substrate, particularly, a paper support coated with baryta and/or partially acetylated α-olefin polymer, preferably, a polymer of α-olefin having 2–10 carbon atoms, such as polyethylene, polypropylene or ethylene/butene copolymer may typically be used. The support may be either transparent or opaque, and preferably be transparent. Among them, a biaxially stretched polyethylene terephthalate (PET) having a thickness of approximately from 75–200 μm is particularly preferred.

When a plastic film is passed through a heat development apparatus and processed at 80° C. or higher, the film generally expands or contracts in the dimension. If the processed materials are used as printing plates, such expansion or contraction causes a serious problem at the time of precision multi-color printing. Accordingly, in the present invention, it is preferable to use a film designed to cause little change in the dimension by relaxing the internal strain remaining in the film during the biaxial stretching and thereby eliminating the heat shrinkage distortion that may be generated during the heat development. For example, polyester, in particular, polyethylene terephthalate, heat-treated at 100–210° C. before a photothermographic emulsion is coated thereon is preferably used. A film having a high glass transition point is also preferred, for example, a film of polyether ethyl ketone, polystyrene, polysulfone, polyether sulfone, polyarylate or polycarbonate may be used.

When the photothermographic material is for medical use, the transparent support may be colored with blue dyes (e.g., Dye-1 described in Examples of JP-A-8-240877), or may be colorless. For the support, techniques for undercoating described in JP-A-11-84574 (utilizing water-soluble polyester), JP-A-10-186565 (utilizing styrene/butadiene copolymer), Japanese Patent Application No. 11-106881, paragraphs 0063–0080 (utilizing vinylidene chloride copolymer) and so forth are preferably used. As for antistatic layers and undercoating, techniques disclosed in JP-A-56-143430, JP-A-56-143431, JP-A-58-62646, JP-A-56-120519, JP-A-11-84573, paragraphs 0040–0051, U.S. Pat. No. 5,575,957, JP-A-11-223898, paragraphs 0078–0084 and so forth can also be used.

The photothermographic material of the invention may have, for antistatic purpose, for example, a layer containing soluble salts (e.g., chlorides and nitrates), an deposited metal layer, a layer containing ionic polymers as described in U.S. Pat. Nos. 2,861,056 and 3,206,312, insoluble inorganic salts as described in U.S. Pat. No. 3,428,451, or tin oxide microparticles as described in JP-A-60-252349 and JP-A-57-104931.

As the method for producing color images using the photothermographic material of the invention, there is mentioned the method described in JP-A-7-13295, page 10, left column, line 43 to page 11, left column, line 40. Stabilizers for color dye images are exemplified in British Patent No. 1,326,889, U.S. Pat. Nos. 3,432,300, 3,698,909, 3,574,627, 3,573,050, 3,764,337 and 4,042,394.

In the present invention, the photothermographic emulsion can be coated by various coating methods including dip coating, air knife coating, flow coating, and extrusion coating using a hopper of the type described in U.S. Pat. No. 2,681,294. If desired, two or more layers may be simultaneously coated by the methods described in U.S. Pat. No. 2,761,791 and British Patent No. 837,095.

The photothermographic material of the invention may contain additional layers, for example, a dye accepting layer for accepting a mobile dye image, an opacifying layer when reflection printing is desired, a protective topcoat layer, and a primer layer well known in the photothermographic art. The photosensitive material of the invention is preferably able to form an image by only a single sheet of the photosensitive material. That is, it is preferred that a functional layer necessary to form an image such as an image-receiving layer does not constitute a separate member.

Although the photothermographic material of the invention may be developed by any method, the development is usually performed by heating a photothermographic material exposed imagewise. As preferred embodiments of heat development apparatus to be used, there are heat development apparatuses in which a photothermographic material is brought into contact with a heat source such as heat roller or heat drum as disclosed in JP-B-5-56499, Japanese Patent No. 684453, JP-A-9-292695, JP-A-9-297385, JP-A-11-133572 and WO95/30934, and heat development apparatuses of non-contact type as disclosed in JP-A-7-13294, WO97/28489, WO97/28488 and WO97/28487. Particularly preferred embodiments are the heat development apparatuses of non-contact type. The temperature for the development is 80–250° C., preferably 100–140° C., more preferably 100–130° C., particularly preferably 100–117° C. The development time is preferably 1–180 seconds, more preferably 10–90 seconds.

As a method for preventing uneven development due to dimensional change of the photothermographic material during the heat development, it is effective to employ a method for forming images wherein the material is heated at a temperature of 80° C. or higher but lower than 115° C. (preferably 113° C. or lower) for 5 seconds or more so as not to develop images, and then subjected to heat development at 110° C. or higher (preferably 130° C. or lower) to form images (so-called multi-step heating method).

The photothermographic material of the present invention can be exposed in any manner. As light source of exposure, laser rays are preferred. As the laser used in the present invention, gas lasers, YAG lasers, dye lasers, semiconductor lasers and so forth are preferred. A combination of semiconductor laser and second harmonic generating device may also be used.

The photothermographic material of the present invention shows a low haze at the exposure, and is liable to incur generation of interference fringes. For preventing the generation of interference fringes, a technique of entering a laser ray obliquely with respect to the photosensitive material disclosed in JP-A-5-113548 and a method of using a multimode laser disclosed in WO95/31754 have been known, and these techniques are preferably used.

The photothermographic material of the present invention is preferably exposed such that the laser rays are overlapped and the scanning lines are not viewed as described in *SPIE*, Vol. 169, "Laser Printing", pages 116 to 128 (1979), JP-A-4-51043, WO95/31754 and so forth.

An example of the structure of heat development apparatus used for the heat development of the photothermographic material of the present invention is shown in FIG. 1. FIG. 1 depicts a side view of a heat development apparatus. The heat development apparatus shown in FIG. 1 comprises carrying-in roller pairs 11 (lower rollers are heating rollers), which carry a photothermographic material 10 into the heating section while making the material in a flat shape and preheating it, and carrying-out roller pairs 12, which carry out the photothermographic material 10 after heat development from the heating section while maintaining the material to be in a flat shape. The photothermographic material 10 is heat-developed while it is conveyed by the carrying-in roller pairs 11 and then by the carrying-out roller pairs 12. A conveying means for carrying the photothermographic material 10 under the heat development is provided with multiple rollers 13 so that they should be contacted with the surface of the image-forming layer side, and a flat surface 14 adhered with non-woven fabric (composed of, for example, aromatic polyamide, Teflon etc.) or the like is provided on the opposite side so that it should be contacted with the opposite back surface. The photothermographic material 10 is conveyed by driving of the multiple rollers 13 contacted with the surface of the image-forming layer side, while the back surface slides on the flat surface 14. Heaters 15 are provided over the rollers 13 and under the flat surface 14 so that the photothermographic material 10 should be heated from the both sides. Examples of the heating means include panel heaters and so forth. While clearance between the rollers 13 and the flat surface 14 may vary depending on the material of the flat surface member, it is suitably adjusted to a clearance that allows the conveyance of the photothermographic material 10. The clearance is preferably 0–1 mm.

The materials of the surfaces of the rollers 13 and the member of the flat surface 14 may be composed of any materials so long as they have heat resistance and they should not cause any troubles in the conveyance of the photothermographic material 10. However, the material of the roller surface is preferably composed of silicone rubber, and the member of the flat surface is preferably composed of non-woven fabric made of aromatic polyamide or Teflon (PTFE). The heating means preferably comprises multiple heaters so that temperature of each heater can be adjusted freely.

The heating section is constituted by a preheating section A comprising the carrying-in roller pairs 11 and a heat development section B comprising the heaters 15. Temperature of the preheating section A locating upstream from the heat development section B is preferably controlled to be lower than the heat development temperature (for example, lower by about 10–30° C.), and temperature and heat development time are desirably adjusted so that they should be sufficient for evaporating moisture contained in the photothermographic material 10. The temperature is also preferably adjusted to be higher than the glass transition temperature (Tg) of the support of the photothermographic material 10 so that uneven development should be prevented.

Further, guide panels 16 are provided downstream from the heat development section B, and they constitute a gradual cooling section C together with the carrying-out roller pairs 12.

The guide panels 16 are preferably composed of a material of low heat conductivity, and it is preferred that the cooling is performed gradually.

The heat development apparatus was explained with reference to the example shown in the drawing. However, the apparatus is not limited to the example, and the heat development apparatus used for the present invention may have a variety of structures such as one disclosed in JP-A-7-13294. For the multi-stage heating method, which is preferably used for the present invention, the photothermographic material may be successively heated at different temperatures in such an apparatus as mentioned above, which is provided with two or more heat sources at different temperatures.

EXAMPLES

The present invention will be further specifically explained with reference to the following examples. The materials, regents, ratios, procedures and so forth shown in the following examples can be optionally changed so long as such change does not depart from the spirit of the present invention. Therefore, the scope of the present invention is not limited by the following examples.

Example 1

<<Preparation of PET Support>>

Polyethylene terephthalate having intrinsic viscosity of 0.66 (measured in phenol/tetrachloroethane=6/4 (weight ratio) at 25° C.) was obtained by using terephthalic acid and ethylene glycol in a conventional manner. The product was pelletized, dried at 130° C. for 4 hours, melted at 300° C., then extruded from a T-die and rapidly cooled to form an unstretched film having such a thickness that the film should have a thickness of 175 μm after thermal fixation.

The film was stretched along the longitudinal direction by 3.3 times at 110° C. using rollers of different peripheral speeds, and then stretched along the transverse direction by 4.5 times at 130° C. using a tenter. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4 kg/cm$^2$. Thus, a roll of a film having a thickness of 175 μm was obtained.

<<Surface Corona Discharging Treatment>>

Using a solid state corona discharging treatment machine Model 6KVA manufactured by Piller Inc., both surfaces of the support were treated at room temperature at 20 m/minute. The readings of electric current and voltage during the treatment indicated that the support underwent the treatment of 0.375 kV·A·minute/m$^2$. The discharging frequency of the treatment was 9.6 kHz, and the gap clearance between the electrode and the dielectric roll was 1.6 mm.

<<Preparation of Support Having Undercoat Layers>>

(Preparation of Undercoating Solution A)

In an amount of 1 g of polystyrene microparticles (mean particle size: 0.2 μm) and 20 ml of Surface active agent 1 (1 weight %) were added to 200 ml of polyester copolymer aqueous dispersion, Pesresin A-515GB (30 weight %, Takamatsu Yushi K.K.), and the mixture was further added with distilled water to a volume of 1000 ml to form Undercoating solution A.

(Preparation of Undercoating Solution B)

In an amount of 200 ml of styrene/butadiene copolymer aqueous dispersion (styrene/butadiene/itaconic acid=47/50/3 (weight ratio), concentration: 30 weight %) and 0.1 g of polystyrene microparticles (mean particle size: 2.5 μm) were added to 680 ml of distilled water, and the mixture was further added with distilled water to a volume of 1000 ml to form Undercoating solution B.

(Preparation of Undercoating Solution C)

In an amount of 10 g of inert gelatin was dissolved in 500 ml of distilled water, added with 40 g of aqueous dispersion of tin oxide/antimony oxide composite microparticles disclosed in JP-A-61-20033 (40 weight %), and the mixture was further added with distilled water to a volume of 1000 ml to form Undercoating solution C.

(Preparation of Support Having Undercoat Layers)

On one surface of the aforementioned support subjected to the corona discharging treatment, Undercoating solution A was coated by a bar coater in a wet coating amount of 5 ml/m$^2$ and dried at 180° C. for 5 minutes. Then, the back surface thereof was subjected to the corona discharge treatment and then coated with Undercoating solution B by a bar coater in a wet coating amount of 5 ml/m$^2$ so that a dry thickness of about 0.3 μm should be obtained and the coated layer was dried at 180° C. for 5 minutes. This layer was further coated with Undercoating solution C by a bar coater in a wet coating amount of 3 ml/m$^2$ so that a dry thickness of about 0.03 μm should be obtained and the coated layer was dried at 180° C. for 5 minutes to prepare a support having undercoat layers.

<<Preparation of Organic Acid Silver Salt Dispersion>>

To 43.8 g of a stirred mixture of behenic acid (product name: Edenor C22 85R, Henkel Corp.), 730 ml of distilled water and 60 ml of tert-butanol at 79° C., 117 ml of aqueous 1N NaOH solution was added over 55 minutes, and allowed to react for 240 minutes. Then, the mixture was added with 112.5 ml of aqueous solution of 19.2 g of silver nitrate over 45 seconds, and left as it was for 20 minutes so that the temperature of the mixture was lowered to 30° C. Thereafter, the solid content was separated by suction filtration, and washed with water until the conductivity of the filtrate became 30 μS/cm. The solid content obtained as described above was not dried but handled as a wet cake. To this wet cake corresponding to 100 g of dry solid content, 7.4 g of polyvinyl alcohol (trade name: PVA205) and water were added to make the total amount 385 g, and the resulting mixture was preliminarily dispersed in a homomixer.

Then, the preliminarily dispersed stock solution was treated three times in a dispersing machine (trade name: Microfluidizer M-110S-EH, manufactured by Microfluidex International Corporation, using G10Z interaction chamber) under a pressure controlled to be 1,750 kg/cm$^2$ to obtain Silver behenate dispersion B. The silver behenate particles contained in the silver behenate dispersion obtained as described above were acicular grains having a mean short axis length of 0.04 μm, average long axis length of 0.8 μm and variation coefficient of 30%. The grain size was measured by Master Sizer X manufactured by Malvern Instruments Ltd. During the cooling operation, a desired dispersion temperature was established by providing coiled heat exchangers fixed before and after the interaction chamber and controlling the temperature of the refrigerant.

<<Preparation of 25 Weight % Dispersion of Reducing Agent>>

To 80 g of a compound represented by the general formula (1) and a compound represented by the general formula (2) or (3) (types are shown in Table 1) and 64 g of 20 weight % aqueous solution of denatured polyvinyl alcohol MP-203 produced by Kuraray Co., Ltd., 176 g of water was added, and thoroughly stirred to obtain slurry. The slurry was introduced into a vessel together with 800 g of zirconia beads having a mean particle size of 0.5 mm, and dispersed in a dispersing machine (¼ G Sand Grinder Mill, manufactured by Imex) for 5 hours to prepare a reducing agent dispersion. The reducing agent particles contained in the reducing agent dispersion had a mean particle size of 0.72 μm.

<<Preparation of 20 Weight % Dispersion of Mercapto Compound>>

To 64 g of 3-mercapto-4-phenyl-5-heptyl-1,2,4-triazole and 32 g of 20 weight % aqueous solution of denatured polyvinyl alcohol MP-203 produced by Kuraray Co., Ltd., 224 g of water was added, and thoroughly stirred to obtain slurry. The slurry was introduced into a vessel together with 800 g of zirconia beads having a mean particle size of 0.5 mm, and dispersed in a dispersing machine (¼ G Sand Grinder Mill, manufactured by Imex) for 10 hours to obtain a mercapto compound dispersion. The mercapto compound particles contained in the mercapto compound dispersion obtained as described above had a mean particle size of 0.67 μm.

<<Preparation of 30 Weight % Dispersion of Organic Polyhalogenated Compound>>

In an amount of 116 g of 2-tribromomethylsulfonylnaphthalene, 48 g of 20 weight % aqueous solution of denatured polyvinyl alcohol MP203 produced by Kuraray Co., Ltd. and 224 g of water were thoroughly stirred to obtain slurry. The slurry was introduced into a vessel together with 800 g of zirconia beads having a mean particle size of 0.5 mm, and dispersed in a dispersing machine (¼ G Sand Grinder Mill, manufactured by Imex) for 5 hours to obtain a dispersion of organic polyhalogenated compound. The organic polyhalogenated compound particles contained in the dispersion of organic polyhalogenated compound dispersion obtained as described above had a mean particle size of 0.74 μm.

<<Preparation of 22 Weight % Dispersion of Compound G>>

In an amount of 10 kg of Compound G and 10 kg of 20 weight % aqueous solution of denatured polyvinyl alcohol (Poval MP203, produced by Kuraray Co. Ltd.) were added with 16 kg of water, and mixed sufficiently to form slurry. The slurry was fed by a diaphragm pump to a sand mill of horizontal type (UVM-2, produced by Imex Co.) containing zirconia beads having a mean particle size of 0.5 mm, and dispersed for 3 hours and 30 minutes. Then, the slurry was added with 0.2 g of benzothiazolinone sodium salt and water so that the concentration of Compound G should become 22 weight % to obtain a dispersion. The particles of Compound G contained in the dispersion obtained as described above had a median particle size of 0.55 μm and maximum particle size of 2.0 μm or less. The obtained reducing agent dispersion was filtered through a polypropylene filter having a pore size of 10.0 μm to remove dusts and so forth, and stored.

<<Preparation of Methanol Solution of Phthalazine Compound>>

In an amount of 26 g of 6-isopropylphthalazine as a phthalazine compound was dissolved in 100 ml of methanol and used.

<<Preparation of 20 Weight % Dispersion of Pigment>>

To 64 g of C. I. Pigment Blue 60 and 6.4 g of Demor N produced by Kao Corporation, 250 g of water was added, and thoroughly stirred to obtain slurry. The slurry was introduced into a vessel together with 800 g of zirconia beads having a mean particle size of 0.5 mm, and dispersed in a dispersing machine (¼ G Sand Grinder Mill, manufactured by Imex) for 25 hours to obtain a pigment dispersion. The pigment particles contained in the pigment dispersion obtained as described above had a mean particle size of 0.21 μm.

<<Preparation of Silver Halide Grain 1>>

In an amount of 1421 ml of distilled water was added with 6.7 ml of 1 weight % potassium bromide solution, and further added with 8.2 ml of 1 mol/L nitric acid and 21.8 g of phthalized gelatin. Separately, Solution al was prepared by adding distilled water to 37.04 g of silver nitrate to dilute it to 159 ml, and Solution b1 was prepared by diluting 32.6 g of potassium bromide with distilled water to a volume of 200 ml. To the aforementioned mixture maintained at 35° C. and stirred in a titanium-coated stainless steel reaction vessel, the whole volume of Solution al was added by the controlled double jet method over 1 minute at a constant flow rate while pAg was maintained at 8.1 (Solution b1 was also added by the controlled double jet method). Then, the mixture was added with 30 ml of 3.5 weight % aqueous hydrogen peroxide solution, and further added with 336 ml of 3 weight % aqueous solution of benzimidazole. Separately, Solution a2 was prepared by diluting Solution al with distilled water to a volume of 317.5 ml, and Solution b2 was prepared by dissolving dipotassium hexachloroiridate in Solution b1 in such an amount that its final concentration should become $1\times10^{-4}$ mol per mole of silver, and diluting the obtained solution with distilled water to a volume twice as much as the volume of Solution b1, 400 ml. The whole volume of Solution a2 was added to the mixture again by the controlled double jet method over 10 minutes at a constant flow rate while pAg was maintained at 8.1 (Solution b2 was also added by the controlled double jet method). Then, the mixture was added with 50 ml of 0.5 weight % solution of 2-mercapto-5-methyl-benzimidazole in methanol. After pAg was raised to 7.5 with silver nitrate, the mixture was adjusted to pH 3.8 using 1 mol/L sulfuric acid, and the stirring was stopped. Then, the mixture was subjected to precipitation, desalting and washing with water, added with 3.5 g of deionized gelatin and 1 mol/L sodium hydroxide to be adjusted to pH 6.0 and pAg of 8.2 to form a silver halide dispersion.

The grains in the completed silver halide emulsion were pure silver bromide grains having a mean spherical diameter of 0.031 μm and a variation coefficient of 11% for spherical diameter. The grain size and so forth were obtained from averages for 1000 grains by using an electron microscope. The [100 ] face ratio of these grains was determined to be 85% by the Kubelka-Munk method.

The aforementioned emulsion was warmed to 50° C. with stirring, added with 5 ml of 0.5 weight % solution of N,N-dihydroxy-N,N-diethylmelamine in methanol and 5 ml of 3.5 weight % solution of phenoxyethanol in methanol, and further added 1 minute later with sodium benzenethiosulfonate in an amount of $3\times10^{-5}$ mole per mole of silver. Further 2 minutes later, the emulsion was added with a solid dispersion of Spectral sensitization dye 1 (aqueous gelatin solution) in an amount of $5\times10^{-3}$ mol per mole of silver, added further 2 minutes later with a tellurium compound in an amount of $5\times10^{-5}$ mol per mole of silver, and ripened for 50 minutes. Immediately before the completion of the ripening, the emulsion was added with 2-mercapto-5-methylbenzimidazole in an amount of $1\times10^{-3}$ mole per mole of silver, and its temperature was lowered. Thus, chemical sensitization was finished to form Silver halide grain 1.

<<Preparation of Silver Halide Grain 2>>

In 700 ml of water, 22 g of phthalized gelatin and 30 mg of potassium bromide were dissolved, and after adjusting the pH to 5.0 at a temperature of 35° C., 159 ml of aqueous solution containing 18.6 g of silver nitrate and 0.9 g of ammonium nitrate and an aqueous solution containing potassium bromide and potassium iodide at a molar ratio of 92:8 were added by the control double jet method over 10 minutes while pAg was maintained at 7.7. Subsequently, 476 ml of an aqueous solution containing 55.4 g of silver nitrate and 2 g of ammonium nitrate and an aqueous solution containing $1\times10^{-5}$ mole of dipotassium hexachloroiridate and 1 mole of potassium bromide were added by the control double jet method over 30 minutes while pAg was maintained at 7.7, and then 1 g of 4-hydroxy-6-methyl-1,3,3a,7-tetrazaindene was added. Then, pH of the mixture was lowered to cause coagulation precipitation to effect desalting, and the mixture was added with 0.1 g of phenoxyethanol and adjusted to pH 5.9 and pAg of 8.2 to complete the preparation of silver iodobromide grains (cubic grains having a core iodine content of 8 mole %, mean iodine content of 2 mole %, mean grain size of 0.05 μm, variation coefficient of 8% for the projected area, and [100] face ratio of 88%).

The silver halide grains obtained above was warmed to 60° C., added with sodium thiosulfonate in an amount of 85 μmol per mole of silver and 2,3,4,5,6-pentafluorophenyldiphenylphosphine selenide in an amount of $1.1\times10^{-5}$ mole, a tellurium compound in an amount of $1.5\times10^{-5}$ mole, chloroauric acid in an amount of $3.5\times10^{-8}$ mole and thiocyanic acid in an amount of $2.7\times10^{-4}$ mole, ripened for 120 minutes, then quenched to 40° C., added with $1\times10^{-4}$ mole of Spectral sensitization dye 1 and $5\times10^{-4}$ mole of 2-mercapto-5-methylbenzimidazole, and quenched to 30° C. to obtain Silver halide emulsion 2.

<<Preparation of Coating Solution for Emulsion Layer>>

(Coating Solution for Emulsion Layer)

In an amount of 103 g of the organic acid silver salt dispersion obtained above and 5 g of 20 weight % aqueous solution of polyvinyl alcohol (PVA205, Kraray Co., Ltd.) were mixed and maintained at 40° C. To this mixture, the aforementioned 25 weight % reducing agent dispersion (type and amount are shown in Table 1), 20.3 g of the dispersion of Compound G, 4.8 g of 5 weight % aqueous dispersion of pigment, C.I. Pigment Blue 60, 10.7 g of the 30 weight % dispersion of organic polyhalogenated compound and 3.1 g of the 20 weight % mercapto compound dispersion were added. Then, the mixture was added with 106 g of 40 weight % SBR latex subjected to UF purification and maintained at 40° C., and stirred sufficiently. The mixture was further added with 6 ml of the solution of phthalazine compound in methanol to obtain an organic acid silver salt solution. Further, 5 g of Silver halide grain 1 and 5 g of Silver halide grain 2 were sufficiently mixed beforehand, mixed with the organic acid silver salt dispersion by a static mixer immediately before coating and used as a coating solution for emulsion layer. This coating solution was fed as it was to a coating die in such a feeding amount that a coated silver amount of 1.0 g/m$^2$ should be obtained.

The viscosity of the aforementioned coating solution for emulsion layer was measured by a Brookfield (B-type) viscometer of Tokyo Keiki, and found to be 85 [mPa·s] at 40° C. (No. 1 rotor).

The viscosity of the coating solution was measured at 25° C. by an RFS fluid spectrometer produced by Rheometric Far East Co., Ltd., and found to be 1500, 220, 70, 40 and 20 [mPa·s] at shear rates of 0.1, 1, 10, 100 and 1000 [l/second], respectively.

The SBR latex purified by UF (ultrafiltration) was obtained as follows. The following SBR latex diluted 10 times with distilled water was diluted and purified by using an UF purification module FS03 FC FUY03A1 (Daisen Membrane System Ltd.) until its ionic conductivity became 1.5 mS/cm and used. The latex concentration at that ionic conductivity was 40 weight %.

(SBR latex: a latex of -St(68)-Bu(29)-AA(3)-, wherein the numerals in the parentheses indicate the contents in terms of % by weight, St represents styrene, Bu represents butadiene and AA represents acrylic acid)

The latex had the following characteristics: mean particle size of 0.1 μm, concentration of 45 weight %, equilibrated moisture content of 0.6 weight % at 25° C. and relative humidity of 60%, and ion conductivity of 4.2 mS/cm (measured for the latex stock solution (40 weight %) at 25° C. by using a conductometer, CM-30S, manufactured by Toa Electronics, Ltd.), pH 8.2.

<<Preparation of Coating Solution for Intermediate Layer on Emulsion Layer Side>>

(Coating Solution for Intermediate Layer)

To 772 g of 10 weight % aqueous solution of polyvinyl alcohol PVA205 (Kuraray Co., Ltd.) and 226 g of 27.5 weight % latex solution of methyl methacrylate/styrene/2-ethylhexyl acrylate/hydroxyethyl methacrylate/acrylic acid copolymer (copolymerization weight ratio =59/9/26/5/1), 2 ml of 5 weight % aqueous solution of Aerosol OT (American Cyanamid Co.), 4 g of benzyl alcohol, 1 g of 2,2,4-trimethyl-1,3-pentanediol monoisbutyrate and 10 mg of benzisothiazolinone were added to form a coating solution for intermediate layer, which was fed to a coating die at such a feeding rate that its coating amount should be 5 ml/m$^2$.

The viscosity of the coating solution was measured by a B-type viscometer, and found to be 21 [mPa·s] at 40° C. (No. 1 rotor).

<<Preparation of Coating Solution for First Protective Layer for Emulsion Layer>>

(Coating Solution for First Protective Layer)

In an amount of 80 g of inert gelatin was dissolved in water, added with 138 ml of 10 weight % solution of phthalic acid in methanol, 28 ml of 1 mol/L sulfuric acid, 5 ml of 5 weight % aqueous solution of Aerosol OT (American Cyanamid Co.) and 1 g of phenoxyethanol, and further added with water so that the total amount should become 1000 g to form a coating solution, which was fed to a coating die at such a feeding amount that its coating amount should become 10 ml/m$^2$.

The viscosity of the coating solution was measured by a B-type viscometer, and found to be 17 [mPa·s] at 40° C. (No. 1 rotor).

<<Preparation of Coating Solution for Second Protective Layer for Emulsion Layer>>

(Coating Solution for Second Protective Layer)

In an amount of 100 g of inert gelatin was dissolved in water, added with 20 ml of 5 weight % solution of N-perfluorooctylsulfonyl-N-propylalanine potassium salt, 16 ml of 5 weight % solution of Aerosol OT (American Cyanamid Co.), 25 g of polymethyl methacrylate microparticles (average particle size: 4.0 μm), 44 ml of 1 mol/L sulfuric acid and 10 mg of benzisothiazolinone, and further added with water to a total amount of 1555 g. The mixture was mixed with 445 ml of an aqueous solution containing 4 weight % of chromium alum and 0.67 weight % of phthalic acid by a static mixer immediately before application and used as a coating solution for surface protective layer. The coating solution was fed to a coating die in such an amount that the coating amount should be 10 ml/m$^2$.

The viscosity of the coating solution was measured by a B-type viscometer, and found to be 9 [mPa·s] at 40° C. (No. 1 rotor).

<<Preparation of Coating Solution for Back Surface>>

(Preparation of Base Precursor Solid Microparticle Dispersion)

In an amount of 64 g of base precursor compound and 10 g of surface active agent (Demor N, Kao Corp.) were mixed with 246 ml of distilled water, and the mixture was subjected to bead dispersion in a sand mill (¼ Gallon Sand Grinder Mill, manufactured by Imex) to obtain a solid microparticle dispersion of the base precursor having a mean particle size of 0.2 μm.

(Preparation of Solid Microparticle Dispersion of Dye)

In an amount of 9.6 g of cyanine dye compound and 5.8 g of sodium p-alkylbenzenesulfonate were mixed with 305 ml of distilled water, and the mixture was subjected to bead dispersion in a sand mill (¼ Gallon Sand Grinder Mill, manufactured by Imex) to obtain a solid microparticle dispersion of the dye having a mean particle size of 0.2 μm. (Preparation of coating solution for antihalation layer) In an amount of 17 g of gelatin, 9.6 g of polyacrylamide, 70 g of the aforementioned solid microparticle dispersion of base precursor, 56 g of the aforementioned solid microparticle dispersion of dye, 1.5 g of polymethyl methacrylate microparticles (average particle size of 6.5 μm), 2.2 g of sodium polyethylenesulfonate, 0.2 g of 1 weight % aqueous solution of coloring dye compound and 844 ml of water were mixed to prepare a coating solution for antihalation layer.

(Preparation of Coating Solution for Protective Layer)

In a container kept at 40° C., 50 g of gelatin, 0.2 g of sodium polystyrenesulfonate, 2.4 g of N,N-ethylenebis(vinyl-sulfonacetamide), 1 g of sodium t-octylphenoxyethoxyethane-sulfonate, 30 mg of benzisothisazolinone, 32 mg of $C_8F_{17}SO_3K$, 64 mg of $C_8F_{17}SO_2N(C_3H_7)(CH_2CH_2O)_4(CH_2)_4—SO_3Na$ and 950 ml of water were mixed to form a coating solution for protective layer.

The compounds used for Example 1 are shown below.

Surface active agent 1

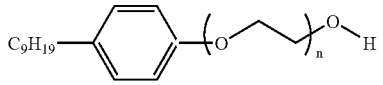

n = 8.5

-continued

Spectral sensitizing dye 1

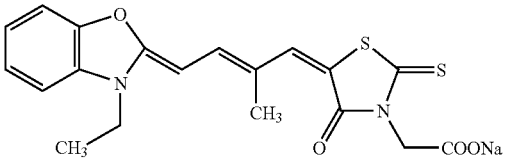

Tellurium compound

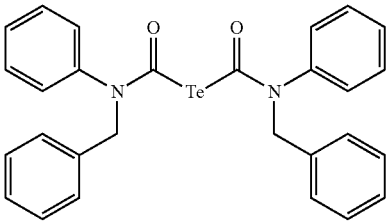

Base precursor compound

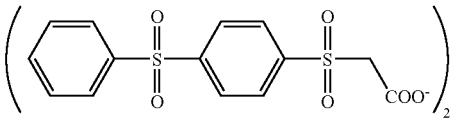

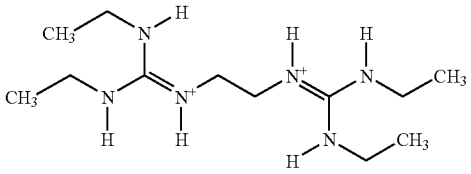

Cyanine dye compound

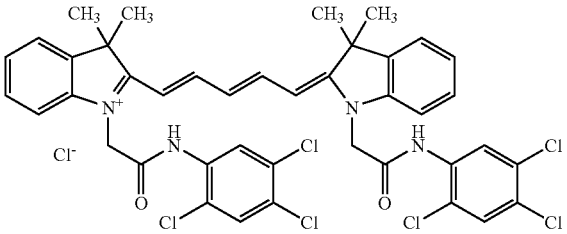

Coloring dye compound

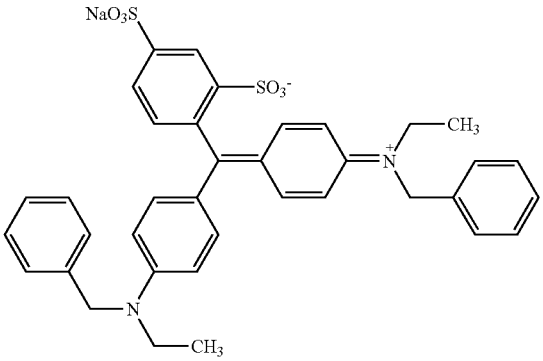

-continued

Compound G

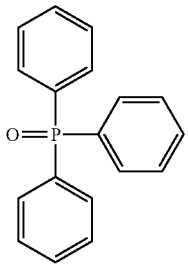

<<Production of Photothermographic Material>>

On the aforementioned support having undercoat layers, the coating solution for antihalation layer and the coating solution for protective layer were simultaneously applied as stacked layers so that the applied solid content amount of the solid microparticle dye in the antihalation layer should become 0.04 g/m$^2$, and the applied amount of gelatin in the protective layer should become 1 g/m$^2$, and dried to form an antihalation back layer. Then, on the surface opposite to the back surface, an emulsion layer, intermediate layer, first protective layer, and second protective layer were simultaneously applied in this order from the undercoat layer by the slide bead coating method as stacked layers to form each photothermographic material (Table 1). After the application on the back surface, the emulsion layer was applied without winding the material.

The coating was performed at a speed of 160 m/min, and the gap between the tip of coating die and the support was set to be 0.18 mm. The pressure in the reduced pressure chamber was adjusted to be lower than the atmospheric pressure by 392 Pa. In the subsequent chilling zone, the material was blown with air showing a dry-bulb temperature of 18° C. and a wet-bulb temperature of 12° C. at a mean wind speed of 7 m/second for 30 seconds to cool the coating solutions. Then, in the floating type drying zone in a coiled shape, the material was blown with drying air showing a dry-bulb temperature of 30° C. and a wet-bulb temperature of 18° C. at a blowing wind speed of 20 m/second at nozzles for 200 seconds to evaporate the solvents in the coating solutions.

The results of the following evaluation for each photosensitive material sample are shown in Table 1.

(Evaluation of Photographic Performance)

Each photosensitive material was light-exposed by a 647 nm Kr laser sensitometer (maximum output: 500 mW) at an angle of 300 with respect to the normal, and treated at 119° C., 117° C. or 115° C. for 20 seconds (development). The obtained image was evaluated by a densitometer. Further, for comparison of storability of the photosensitive materials, each unexposed photosensitive material was stored at 50° C. and relative humidity of 75% for 3 days, exposed in the same manner and treated (developed) under the conditions shown in Table 1. The measurement results were evaluated as Dmin (fog), Dmax and sensitivity (a reciprocal of ratio of exposure amount required for giving a density 1.0 higher than Dmin). The sensitivity was expressed with relative values to the sensitivity of Photothermographic material 101 shown in Table 1 at 119° C. as a base line (0.00).

TABLE 1

| Sample No. | Reducing agent 1 No. | Reducing agent 1 Amount (mmol) | Reducing agent 2 No. | Reducing agent 2 Amount (μmol) | 119° C. for 20 seconds (A) Dmax | 119° C. for 20 seconds (A) Fog | 119° C. for 20 seconds (A) Sensitivity | 117° C. for 20 seconds (B) Dmax | 117° C. for 20 seconds (B) Fog | 117° C. for 20 seconds (B) Sensitivity |
|---|---|---|---|---|---|---|---|---|---|---|
| 101 | I-1 | 15.7 | | | 1.46 | 0.12 | 0.00 | 0.94 | 0.11 | −0.22 |
| 102 | II-1 | 15.7 | | | 0.35 | 0.09 | — | — | — | — |
| 103 | D-101 | 15.7 | | | — | Strong | — | 1.76 | 0.17 | 0.45 |
| 104 | D-119 | 15.7 | | | — | Strong | — | 1.55 | 0.13 | 0.33 |
| 105 | D-137 | 15.7 | | | | | | 1.51 | 0.12 | 0.26 |
| 106 | I-1 | 15.7 | D-101 | 157 | 1.59 | 0.12 | 0.17 | 1.53 | 0.10 | 0.07 |
| 107 | I-1 | 15.7 | D-115 | 157 | 1.51 | 0.12 | 0.13 | 1.46 | 0.10 | 0.01 |
| 108 | I-1 | 15.7 | D-119 | 157 | 1.50 | 0.11 | 0.16 | 1.49 | 0.10 | 0.05 |
| 109 | I-1 | 15.7 | D-137 | 157 | 1.47 | 0.12 | 0.15 | 1.43 | 0.11 | 0.01 |
| 110 | I-6 | 15.7 | D-101 | 157 | 1.55 | 0.12 | 0.15 | 1.39 | 0.10 | 0.04 |
| 111 | I-6 | 15.7 | D-115 | 157 | 1.47 | 0.12 | 0.12 | 1.35 | 0.10 | −0.02 |
| 112 | I-6 | 15.7 | D-119 | 157 | 1.57 | 0.12 | 0.15 | 1.42 | 0.10 | 0.03 |
| 113 | I-6 | 15.7 | D-137 | 157 | 1.39 | 0.12 | 0.13 | 1.35 | 0.10 | −0.02 |
| 114 | I-12 | 15.7 | D-101 | 157 | 1.61 | 0.13 | 0.18 | 1.56 | 0.11 | 0.10 |
| 115 | I-12 | 15.7 | D-115 | 157 | 1.53 | 0.12 | 0.14 | 1.48 | 0.11 | 0.07 |
| 116 | I-12 | 15.7 | D-119 | 157 | 1.56 | 0.12 | 0.18 | 1.52 | 0.11 | 0.10 |
| 117 | I-12 | 15.7 | D-137 | 157 | 1.51 | 0.12 | 0.17 | 1.46 | 0.10 | 0.05 |
| 118 | I-5 | 15.7 | D-119 | 157 | 1.53 | 0.12 | 0.14 | 1.49 | 0.11 | 0.08 |
| 119 | I-5 | 15.7 | D-137 | 157 | 1.47 | 0.12 | 0.13 | 1.42 | 0.10 | 0.03 |
| 120 | II-1 | 15.7 | D-119 | 157 | 1.21 | 0.10 | 0.05 | 1.14 | 0.10 | 0.00 |

| Sample No. | 115° C. for 20 seconds (C) Dmax | 115° C. for 20 seconds (C) Fog | 115° C. for 20 seconds (C) Sensitivity | After storage at 50° C. Sample | After storage at 50° C. Dmax | After storage at 50° C. Fog | After storage at 50° C. Sensitivity |
|---|---|---|---|---|---|---|---|
| 101 | 0.41 | 0.10 | −0.49 | (A) | 1.21 | 0.12 | −0.29 |
| 102 | — | — | — | | — | — | — |
| 103 | 1.53 | 0.13 | 0.31 | (C) | 1.47 | 0.13 | 0.20 |
| 104 | 1.49 | 0.11 | 0.25 | (C) | 1.45 | 0.11 | 0.19 |
| 105 | 1.48 | 0.10 | 0.17 | (C) | 1.40 | 0.10 | 0.15 |
| 106 | 1.48 | 0.09 | 0.01 | (B) | 1.41 | 0.09 | 0.02 |
| 107 | 1.31 | 0.09 | −0.07 | (B) | 1.25 | 0.09 | −0.03 |
| 108 | 1.33 | 0.09 | −0.02 | (B) | 1.27 | 0.09 | 0.01 |
| 109 | 1.39 | 0.09 | −0.12 | (B) | 1.24 | 0.09 | −0.04 |
| 110 | 1.15 | 0.09 | 0.00 | (B) | 1.35 | 0.09 | 0.01 |
| 111 | 1.10 | 0.09 | −0.02 | (B) | 1.31 | 0.09 | −0.03 |
| 112 | 1.17 | 0.09 | −0.01 | (B) | 1.36 | 0.09 | 0.00 |
| 113 | 1.07 | 0.09 | −0.13 | (B) | 1.29 | 0.09 | −0.04 |
| 114 | 1.52 | 0.10 | 0.05 | (B) | 1.44 | 0.10 | 0.04 |
| 115 | 1.40 | 0.10 | 0.00 | (B) | 1.31 | 0.10 | 0.03 |
| 116 | 1.42 | 0.10 | 0.03 | (B) | 1.35 | 0.10 | 0.05 |
| 117 | 1.39 | 0.09 | −0.05 | (B) | 1.29 | 0.10 | 0.00 |
| 118 | 1.38 | 0.09 | 0.01 | (B) | 1.20 | 0.10 | 0.03 |
| 119 | 1.30 | 0.09 | −0.07 | (B) | 1.08 | 0.09 | −0.02 |
| 120 | 0.97 | 0.09 | −0.15 | (B) | 0.88 | 0.09 | −0.06 |

(Results)

In Photothermographic material 101, which did not contain compound represented by the general formula (1), marked reduction of sensitivity was observed when it was treated at 115° C. or 117° C. On the other hand, it was demonstrated that Photothermographic materials 103–105, which contained a compound represented by the general formula (1), showed superior maximum density and sensitivity even with a low development temperature. Further, it was also demonstrated that Samples 106–120, which contained a compound represented by the general formula (1) and a compound represented by the general formula (2), showed higher maximum density than the comparative samples and low fog in spite of high sensitivity at any of the development temperatures. Furthermore, while development scarcely proceeded in Comparative sample 102, Sample 120 additionally containing a compound represented by the general formula (1) showed good performance. Moreover, these samples also showed superior storability.

Example 2

(Preparation of Organic Acid Silver Salt Emulsion A)

In an amount of 933 g of behenic acid was added to 12 L of water, and added with 48 g of sodium hydroxide and 63 g of sodium carbonate dissolved in 1.5 L of water, while the mixture was maintained at 90° C. After the mixture was stirred for 30 minutes, the temperature of the mixture was lowered to 50° C., and the mixture was added with 1.1 L of 1 weight % N-bromosuccinimide aqueous solution, and then gradually added with 2.3 L of 17 weight % silver nitrate aqueous solution with stirring. Then, the temperature of the mixture was lowered to 35° C., and the mixture was added with 1.5 L of 2 weight % potassium bromide aqueous solutions over 2 minutes with stirring, then stirred for 30 minutes, and added with 2.4 L of 1 weight % N-bromosuccinimide aqueous solution. This aqueous mixture was added with 3300 g of 1.2 weight % polyvinyl acetate solution in butyl acetate with stirring, and then left standind for 10 minutes so that the mixture should be separated into two layers. Then, the aqueous layer was removed, and the remained gel was washed twice with water. The gel-like mixture of silver behenate and silver bromide obtained as described above was dispersed in 1800 g of 2.6 weight % solution of polyvinyl butyral (Denka Butyral #3000K, DENKI KAGAKU KOGYO K.K.) in 2-butanone, and further dispersed with 600 g of polyvinyl butyral (Butvar B-76, Monsanto Japan) and 300 g of isopropyl alcohol to obtain an organic acid silver salt emulsion (acicular grains having a mean short axis length of 0.05 μm, mean long axis length of 1.2 μm and variation coefficient of 25%).

(Preparation of Coating Solution for Emulsion Layer A)

The organic acid silver salt emulsion obtained above was added with the following reagents in the indicated amounts per 1 mole of silver. At 25° C., the emulsion was added with 520 mg of Sensitization dye A, 1.70 g of Compound (C-1), 21.5 g of 4-chlorobenzophenone-2-carboxylic acid (C-2), 0.90 g of calcium bromide dihydrate, 580 g of 2-butanone and 220 g of dimethylformamide with stirring, and left for 3 hours. Then, 1.6 g of a compound represented by the general formula (1) (type is shown in Table 2), 160 g of a compound represented by the general formula (2) or (3) (type is shown in Table 2), 2.1 g of Nu-1 as an ultrahigh contrast agent, 1.11 g of Dye (C-3), 6.45 g of Sumidur N3500 (polyisocyanate, Sumitomo Bayer Urethane Co., Ltd.), 0.60 g of Megafax F-176P (fluorinated surface active agent, Dai-Nihon Ink Chemical Industry Co., Ltd.), 590 g of 2-butanone and 10 g of methyl isobutyl ketone were added with stirring.

(Preparation of Coating Solution for Protective Layer for Emulsion Layer A)

In an amount of 65 g of CAB171-15S (cellulose acetate butyrate, Eastman Chemical Products, Inc.), 5.6 g of phthalazine (C-4), 1.91 g of tetrachlorophthalic acid (C-5), 2.6 g of 4-methylphthalic acid (C-6), 0.67 g of tetrachlorophthalic acid anhydride (C-7) as phthalazine compounds, 0.36 g of Megafax F-176P and 2 g of Sildex H31 (spherical silica having a mean size of 3 μm, Dokai Chemical K.K.) were dissolved in 1050 g of 2-butanone and 50 g of dimethylformamide.

(Preparation of Support with Back Layer)

In an amount of 6 g of polyvinyl butyral (Denka Butyral #4000 2, DENKI KAGAKU KOGYO K.K.), 0.2 g of Sildex H121 (spherical silica having a mean size of 12 μm, Dokai Chemical K.K.), 0.2 g of Sildex H51 (spherical silica having a mean size of 5 μm, Dokai Chemical K.K.) and 0.1 g of Megafax F-176P were added to 64 g of 2-propanol with stirring, dissolved and mixed in the solvent. To this mixture, a mixed solution containing 420 mg of Dye A dissolved in 10 g of methanol and 20 g of acetone and a solution containing 0.8 g of 3-isocyanatomethyl-3,5,5-trimethylhexyl isocyanate dissolved in 6 g of ethyl acetate were added to form a coating solution.

On a polyethylene terephthalate film having moisture-proof undercoat layers comprising polyvinylidene chloride on the both surfaces, the coating solution of back layer was applied in such an amount that an optical density at 780 nm should become 0.7.

On the support prepared as described above, the coating solution for emulsion layer was coated in such an amount that a coated silver amount of 1.2 g/m$^2$ should be obtained, and then the coating solution for protective layer for emulsion layer was coated on the emulsion layer surface in such an amount that a dry thickness of 2.3 μm should be obtained.

The compounds used for Example 2 are shown below.

Sensitizing dye A

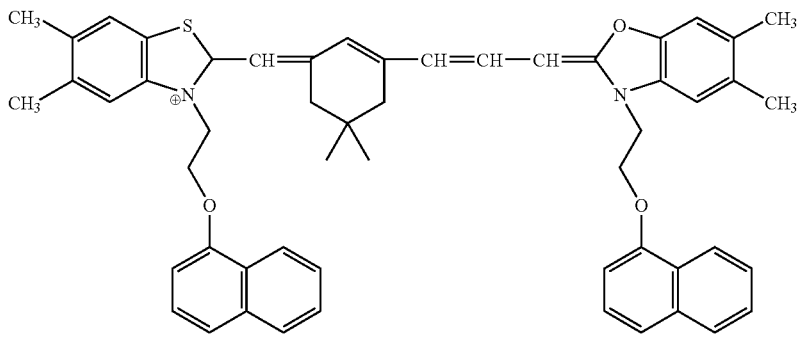

(C-1)

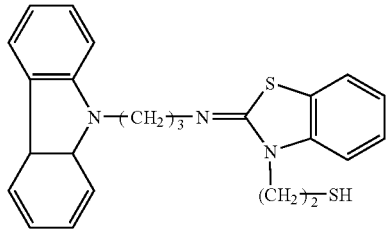

(C-2)

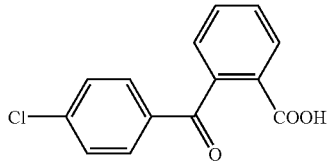

-continued (C-3)

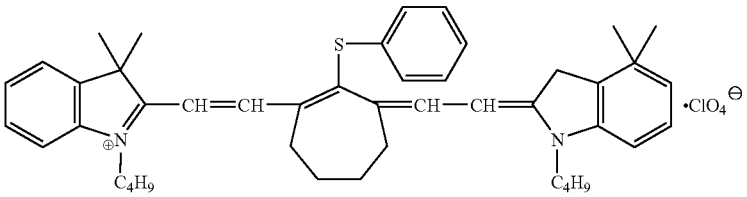

(Nu-1)

(C-4)

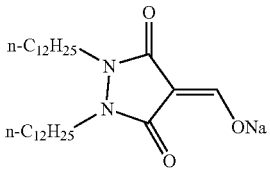

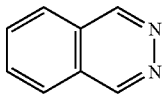

(C-5)

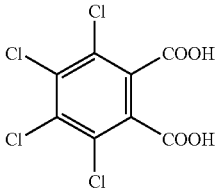

(C-6)

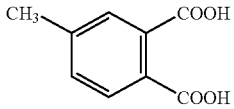

(C-7)

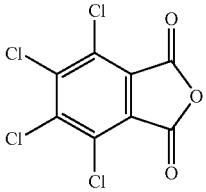

Dye A

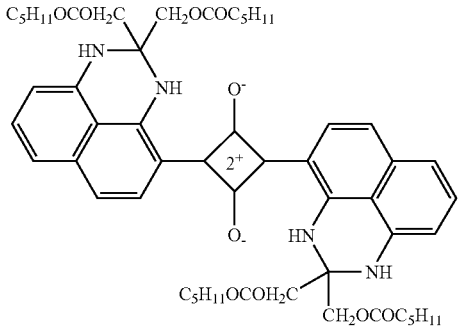

(Evaluation of Photographic Performance)

Each photothermographic material was light-exposed by a xenon flash light of an emission time of 10 seconds through an interference filter having a peak at 780 nm and a step wedge, and treated (developed) at 117° C. for 20 seconds or at 119° C. for 20 seconds. The obtained image was evaluated by a densitometer. As in Example 1, storability of unexposed photosensitive materials was also evaluated in the same manner. The measurement results were evaluated as Dmin (fog), Dmax and sensitivity as in Example 1. The sensitivity was expressed with relative values to the sensitivity of Photothermographic material 201 shown in Table 2 as a base line (0.00). The results are shown in Table 2.

TABLE 2

| | | | 119° C. for 20 seconds (A) | | | 117° C. for 20 seconds (B) | | | After storage at 50° C. | | | |
|---|---|---|---|---|---|---|---|---|---|---|---|---|
| Sample No. | Reducing agent 1 | Reducing agent 2 | Dmax | Fog | Sensitivity | Dmax | Fog | Sensitivity | Sample | Dmax | Fog | Sensitivity |
| 201 | I-1 | | 3.55 | 0.10 | 0.00 | 2.18 | 0.10 | −0.17 | (A) | 3.43 | 0.10 | −0.25 |
| 202 | II-1 | | 0.71 | 0.09 | — | 0.35 | 0.09 | — | (A) | 0.20 | 0.09 | — |
| 203 | D-101 | | 2.85 | 0.11 | 0.30 | 2.71 | 0.10 | 0.24 | (B) | 2.58 | 0.10 | 0.17 |
| 204 | D-119 | | 2.78 | 0.11 | 0.25 | 2.68 | 0.10 | 0.21 | (B) | 2.44 | 0.10 | 0.15 |
| 205 | D-137 | | 2.27 | 0.10 | 0.14 | 2.33 | 0.09 | 0.05 | (B) | 2.18 | 0.10 | 0.01 |
| 206 | I-1 | D-101 | 3.81 | 0.10 | 0.26 | 3.76 | 0.10 | 0.20 | (B) | 3.62 | 0.10 | 0.14 |
| 207 | I-1 | D-115 | 3.77 | 0.10 | 0.13 | 3.56 | 0.10 | 0.08 | (B) | 3.51 | 0.09 | 0.02 |
| 208 | I-1 | D-119 | 3.85 | 0.10 | 0.22 | 3.83 | 0.10 | 0.17 | (B) | 3.70 | 0.10 | 0.10 |
| 209 | I-1 | D-137 | 3.74 | 0.10 | 0.11 | 3.55 | 0.09 | 0.05 | (B) | 3.50 | 0.09 | 0.00 |
| 210 | I-6 | D-101 | 3.41 | 0.10 | 0.10 | 3.19 | 0.09 | 0.06 | (B) | 2.95 | 0.09 | 0.01 |
| 211 | I-6 | D-115 | 3.03 | 0.10 | 0.07 | 2.85 | 0.09 | 0.03 | (B) | 2.51 | 0.09 | 0.00 |
| 212 | I-6 | D-119 | 3.44 | 0.10 | 0.10 | 3.15 | 0.09 | 0.05 | (B) | 2.77 | 0.09 | 0.01 |
| 213 | I-6 | D-137 | 3.11 | 0.10 | 0.05 | 2.76 | 0.09 | 0.01 | (B) | 2.45 | 0.09 | −0.05 |

TABLE 2-continued

| | | | 119° C. for 20 seconds (A) | | | 117° C. for 20 seconds (B) | | | After storage at 50° C. | | | |
|---|---|---|---|---|---|---|---|---|---|---|---|---|
| Sample No. | Reducing agent 1 | Reducing agent 2 | Dmax | Fog | Sensi-tivity | Dmax | Fog | Sensi-tivity | Sample | Dmax | Fog | Sensi-tivity |
| 214 | I-12 | D-101 | 3.85 | 0.11 | 0.31 | 3.80 | 0.11 | 0.26 | (B) | 3.63 | 0.10 | 0.19 |
| 215 | I-12 | D-115 | 3.80 | 0.10 | 0.17 | 3.65 | 0.10 | 0.12 | (B) | 3.48 | 0.09 | 0.02 |
| 216 | I-12 | D-119 | 3.89 | 0.11 | 0.28 | 3.87 | 0.11 | 0.21 | (B) | 3.66 | 0.10 | 0.18 |
| 217 | I-12 | D-137 | 3.78 | 0.10 | 0.19 | 3.72 | 0.10 | 0.09 | (B) | 3.51 | 0.09 | 0.03 |
| 218 | I-5 | D-119 | 3.71 | 0.11 | 0.24 | 3.59 | 0.11 | 0.18 | (B) | 3.49 | 0.10 | 0.16 |
| 219 | I-5 | D-137 | 3.65 | 0.10 | 0.16 | 3.61 | 0.10 | 0.07 | (B) | 3.38 | 0.09 | 0.01 |
| 220 | II-1 | D-119 | 3.33 | 0.10 | 0.12 | 3.10 | 0.10 | 0.03 | (B) | 2.77 | 0.09 | 0.00 |

Samples Nos. 201 and 202 are comparative examples (Results)

It can be seen that, in Photothermographic materials 203–220, which contained a compound represented by the general formula (1), not only superior maximum density and sensitivity were obtained by the development at 119° C., but also, in particular, superior sensitivity was obtained even by the development at 117° C., compared with the comparative photothermographic materials, even though they were photothermographic materials containing an ultrahigh contrast agent. Further, the photothermographic materials of the present invention did not show increase of fog or inhibition of nucleation.

Example 3

(Preparation of PET Support)

PET having IV (intrinsic viscosity) of 0.66 (measured in phenol/tetrachloroethane=6/4 (weight ratio) at 25° C.) was obtained by using terephthalic acid and ethylene glycol in a conventional manner. The product was pelletized, dried at 130° C. for 4 hours, then melted at 300° C., and extruded from a T-die and rapidly cooled to form an unstretched film having such a thickness that the film should have a thickness of 175 μm after thermal fixation.

The film was stretched along the longitudinal direction by 3.3 times using rollers of different peripheral speeds, and then stretched along the transverse direction by 4.5 times using a tenter. The temperatures of these operations were 110° C. and 130° C., respectively. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4 kg/cm$^2$. Thus, a roll of a film having a thickness of 175 μm was obtained.

(Surface Corona Discharge Treatment)

Using a solid state corona discharging treatment machine Model 6KVA manufactured by Piller Inc., both surfaces of the support were treated at room temperature at 20 m/minute. The readings of electric current and voltage during the treatment indicated that the support underwent the treatment of 0.375 kV·A·minute/m$^2$. The discharging frequency of the treatment was 9.6 kHz, and the gap clearance between the electrode and the dielectric roll was 1.6 mm.

(Preparation of Support Having Undercoat Layers)

(1) Preparation of Coating Solutions for Undercoat Layers

| (Preparation of support having undercoat layers) (1) Preparation of coating solutions for undercoat layers | |
|---|---|
| Formulation 1 (for undercoat layer on photosensitive layer side) | |
| Pesresin A-515GB made by Takamatsu Yushi K.K. (30 weight % solution) | 234 g |
| Polyethylene glycol monononylphenyl ether (mean ethylene oxide number = 8.5, 10 weight % solution) | 21.5 g |
| MP-1000 made by Soken Kagaku K.K. (polymer microparticles, mean particle size: 0.4 μm) | 0.91 g |
| Distilled water | 744 ml |
| Formulation 2 (for 1st layer on back surface) | |
| Styrene/butadiene copolymer latex (solid content: 40 weight %, weight ratio of styrene/butadiene = 32/68) | 158 g |
| 2,4-Dichloro-6-hydroxy-S-triazine sodium salt (8 weight % aqueous solution) | 20 g |
| 1 weight % Aqueous solution of sodium laurylbenzenesulfonate | 10 ml |
| Distilled water | 854 ml |
| Formulation 3 (for 2nd layer on back surface side) | |
| $SnO_2$/SbO (weight ratio: 9/1, mean particle size: 0.038 μm, 17 weight % dispersion) | 84 g |
| Gelatin (10% aqueous solution) | 89.2 g |
| Metorose TC-5 made by Shin-Etsu Chemical Co., Ltd. (2% aqueous solution) | 8.6 g |
| MP-1000 (polymer microparticles) made by Soken Kagaku K.K. | 0.01 g |
| 1 weight % Aqueous solution of sodium dodecylbenzenesulfonate | 10 ml |
| NaOH (1 weight %) | 6 ml |
| Proxel (made by ICI Co.) | 1 ml |
| Distilled water | 805 ml |

(Preparation of Support Having Undercoat Layers)

On one surface (photosensitive layer side) of the aforementioned biaxially stretched polyethylene terephthalate support having a thickness of 175 μm, both of which surfaces had been subjected to the above corona discharging treatment, the undercoating solution of Formulation 1 was coated by a wire bar in a wet coating amount of 6.6 ml/m$^2$ (for one surface) and dried at 180° C. for 5 minutes. Then, the opposite surface (back surface) thereof was coated with the undercoating solution of Formulation 2 by a wire bar in a wet coating amount of 5.7 ml/m$^2$ and dried at 180° C. for 5 minutes. The back surface thus coated was further coated with the undercoating solution of Formulation 3 by a wire bar in a wet coating amount of 7.7 ml/$m^2$ and dried at 180° C. for 6 minutes to -prepare a support having undercoat layers.

(Preparation of Coating Solution for Back Surface)

(Preparation of Solid Microparticle Dispersion of Base Precursor (a))

In an amount of 64 g of Base precursor compound 11, 28 g of diphenylsulfone and 10 g of surface active agent, Demor N (manufactured by Kao Corporation) were mixed with 220 ml of distilled water, and the mixture was bead-dispersed using a sand mill (¼ Gallon Sand Grinder Mill, manufactured by Imex Co.) to obtain solid microparticle dispersion of the base precursor compound (a) having a mean particle size of 0.2 μm.

(Preparation of Dye Solid Microparticle Dispersion)

In an amount of 9.6 g of Cyanine dye compound 13 and 5.8 g of sodium p-dodecylbenzenesulfonate were mixed with 305 ml of distilled water, and the mixture was bead-dispersed using a sand mill (¼ Gallon Sand Grinder Mill, manufactured by Imex Co.) to obtain a dye solid microparticle dispersion having a mean particle size of 0.2 μm.

(Preparation of Coating Solution for Antihalation Layer)

In an amount of 17 g of gelatin, 9.6 g of polyacrylamide, 70 g of the solid microparticle dispersion of the base precursor (a), 56 g of the above dye solid microparticle dispersion, 1.5 g of monodispersed polymethyl methacrylate microparticles (mean particle size: 8 μm, standard deviation for particle size: 0.4), 0.03 g of benzoisothiazolinone, 2.2 g of sodium polyethylenesulfonate, 0.2 g of Blue dye compound 14 and 844 ml of water were mixed to prepare a coating solution for antihalation layer.

(Preparation of Coating Solution for Back Surface Protective Layer)

In a container kept at 40° C., 50 g of gelatin, 0.2 g of sodium polystyrenesulfonate, 2.4 g of N,N-ethylenebis(vinyl-sulfonacetamide), 1 g of sodium tert-octylphenoxy-ethoxy-ethanesulfonate, 30 mg of benzoisothiazolinone, 37 mg of N-perfluorooctylsulfonyl-N-propylalanine potassium salt, 0.15 g of polyethylene glycol mono(N-perfluorooctyl-sulfonyl-N-propyl-2-aminoethyl) ether [average polymerization degree of ethylene oxide: 15], 32 mg of $C_8F_{17}SO_3K$, 64 mg of $C_8F_{17}SO_2N(C_3H_7)(CH_2CH_2O)_4(CH_2)_4—SO_3Na$, 8.8 g of acrylic acid/ethyl acrylate copolymer (copolymerization ratio (by weight): 5/95), 0.6 g of Aerosol OT (manufactured by American Cyanamid Company), 1.8 g (as liquid paraffin) of liquid paraffin emulsion and 950 ml of water were mixed to form a coating solution for back surface protective layer.

<<Preparation of Silver Halide Emulsion 1>>

In a titanium-coated stainless steel reaction vessel, 1421 ml of distilled water, 3.1 ml of 1 weight % potassium bromide solution, 3.5 ml of 0.5 mol/L sulfuric acid and 31.7 g of phthalized gelatin were added and maintained at 34° C. with stirring. Separately, Solution A was prepared by adding distilled water to 22.22 g of silver nitrate to dilute it to 95.4 ml, and Solution B was prepared by diluting 15.9 g of potassium bromide with distilled water to a volume of 97.4 ml. To the aforementioned mixture in the titanium-coated stainless steel reaction vessel, the whole volumes of Solution A and Solution B were added over 45 seconds at constant flow rates. Then, the mixture was added with 10 ml of 3.5 weight % aqueous hydrogen peroxide solution, and further added with 10.8 ml of a 10 weight % aqueous solution of benzimidazole. Separately, Solution C was prepared by adding distilled water to 51.86 g of silver nitrate to dilute it to 317.5 ml, and Solution D was prepared by diluting 45.8 g of potassium bromide with distilled water to a volume of 400 ml. The whole volume of Solution C was added to the above mixture over 20 minutes at a constant flow rate. Solution D was added by the control double jet method while pAg was maintained at 8.1. Hexachloroiridic acid (III) potassium salt in an amount of $1\times10^{-4}$ mole per mole of silver was added 10 minutes after the addition of Solutions C and D was started. Further, an aqueous solution of potassium iron (II) hexacyanide in an amount of $3\times10^{-4}$ mole per mole of silver was added 5 seconds after the addition of Solution C was completed. Then, the mixture was adjusted to pH 3.8 using 5 mol/L sulfuric acid, and the stirring was stopped. Then, the mixture was subjected to precipitation, desalting and washing with water, and adjusted to pH 5.9 with sodium hydroxide at a concentration of 1 mol/L to form a silver halide dispersion having pAg of 8.0.

The obtained silver halide dispersion was added with 5 ml of a 0.34 weight % methanol solution of 1,2-benzisothiazolin-3-one with stirring at 38° C., and after 40 minutes since then, added with a methanol solution of Spectral sensitizing dye A in an amount of $1\times10^{-3}$ mole per mole of silver. After 1 minutes, the mixture was warmed to 47° C., and 20 minutes after the warming, added with $7.6\times10^{-5}$ mole of sodium benzenethiosulfonate per mole of silver as a methanol solution. Further after 5 minutes, the mixture was added with Tellurium sensitizer B as a methanol solution in an amount of $1.9\times10^{-4}$ mole per mole of silver followed by ripening for 91 minutes. The mixture was added with 1.3 ml of a 0.8 weight % methanol solution of N,N'-dihydroxy-N"-diethylmelamine, and 4 minutes later, added with 5-methyl-2-mercaptobenzimidazole in an amount of $3.7\times10^{-3}$ mole per mole of silver as a methanol solution and 1-phenyl-2-heptyl-5-mercapto-1,3,4-triazole in an amount of $4.9\times10^{-3}$ mole per mole of silver as a methanol solution to prepare Silver halide emulsion 1.

The grains in the obtained Silver halide emulsion 1 were pure silver bromide grains having a mean diameter as spheres of 0.046 μm and a variation coefficient of 20% for mean diameter as spheres. The grain size and others were obtained from averages for 1000 grains by using an electron microscope. The [100] face ratio of these grains was determined to be 80% by the Kubelka-Munk method.

<<Preparation of Silver Halide Emulsion 2>>

Silver halide emulsion 2 was prepared in the same manner as the preparation of Silver halide emulsion 1 except that the liquid temperature during the formation of the grains was changed from 34° C. to 49° C., addition time of Solution C was changed to 30 minutes, and potassium iron (II) hexacyanide was not used. Precipitation, desalting, washing with water and dispersion were performed in the same manner as the preparation of Silver halide emulsion 1. Further, spectral sensitization, chemical sensitization and addition of 5-methyl-2-mercaptobenzimidazole and 1-phenyl-2-heptyl-5-mercapto-1,3,4-triazole were performed in the same manner as the preparation of Silver halide emulsion 1 except that the amounts of Spectral sensitizing dye A, Tellurium sensitizer B and 1-phenyl-2-heptyl-5-mercapto-1,3,4-triazole were changed to $7.5\times10^{-4}$ mole, $1.1\times10^{-4}$ mole and $3.3\times10^{-3}$ mole per mole of silver, respectively, to obtain Silver halide emulsion 2. The emulsion grains in Silver halide emulsion 2 were pure silver bromide cubic grains having a mean grain size of 0.080 μm as spheres and variation coefficient of 20% for diameter as spheres.

<<Preparation of Silver Halide Emulsion 3>>

Silver halide emulsion 3 was prepared in the same manner as the preparation of Silver halide emulsion 1 except that the liquid temperature during the formation of the grains was changed from 34° C. to 27° C. Further, precipitation, desalting, washing with water and dispersion were performed in the same manner as the preparation of Silver halide emulsion 1. Silver halide emulsion 3 was obtained in the same manner as the preparation of Silver halide emulsion 1 except that Spectral sensitizing dye A was added as solid dispersion (gelatin aqueous solution) in an amount of $6\times10^{-3}$ mole per mole of silver and the amount of Tellurium sensitizer B was changed to $5.2\times10^{-4}$ mole per mole of silver. The grains in Silver halide emulsion 3 were pure silver bromide cubic grains having a mean grain size of 0.038 μm as spheres and variation coefficient of 20% for diameter as spheres.

<<Preparation of Mixed Emulsion A for Coating Solution>>

In an amount of 70 weight % of Silver halide emulsion 1, 15 weight % of Silver halide emulsion 2 and 15 weight % of Silver halide emulsion 3 were mixed and added with benzothiazolium iodide in an amount of $7\times10^{-3}$ mole per mole of silver as a 1 weight % aqueous solution to form Silver halide mixed emulsion A.

<<Preparation of Aliphatic Acid Silver Salt Dispersion>>

In an amount of 87.6 kg of behenic acid (Edenor C22-85R, trade name, manufactured by Henkel Co.), 423 L of distilled water, 49.2 L of 5 mol/L aqueous solution of NaOH, and 120 L of tert-butanol were mixed and allowed to react at 75° C. for one hour with stirring to obtain a solution of sodium behenate. Separately, 206.2 L of an aqueous solution containing 40.4 kg of silver nitrate (pH 4.0) was prepared and kept at 10° C. A mixture of 635 L of distilled water and 30 L of tert-butanol contained in a reaction vessel kept at 30° C. was added with the whole amount of the aforementioned sodium behenate solution and the whole amount of the aqueous silver nitrate solution with stirring at constant flow rates over the periods of 93 minutes and 15 seconds, and 90 minutes, respectively. In this case, they were added in such a manner that only the aqueous silver nitrate solution was added for 11 minutes after starting the addition of the aqueous silver nitrate solution. Then, the addition of the sodium behenate solution was started so that only the sodium behenate solution should be added for 14 minutes and 15 seconds after finishing the addition of the aqueous silver nitrate solution. In this operation, the outside temperature was controlled so that the temperature in the reaction vessel should be 30° C. and the liquid temperature should be constant. The piping of the addition system for the sodium behenate solution was warmed by steam trace and the steam opening was controlled such that the liquid temperature at the outlet orifice of the addition nozzle should be 75° C. The piping of the addition system for the aqueous silver nitrate solution was maintained by circulating cold water outside a double pipe. The addition position of the sodium behenate solution and the addition position of the aqueous silver nitrate solution were arranged symmetrically with respect to the stirring axis as the center, and the positions are controlled to be at heights for not contacting with the reaction mixture.

After finishing the addition of the sodium behenate solution, the mixture was left with stirring for 20 minutes at the same temperature and then the temperature was decreased to 25° C. Thereafter, the solid content was separated by suction filtration and washed with water until electric conductivity of the filtrate became 45 μS/cm. Thus, a silver salt of an organic acid was obtained. The obtained solid content was stored as a wet cake without being dried.

When the shape of the obtained silver behenate grains was evaluated by an electron microscopic photography, the grains were scaly crystals having a=0.14 μm, b=0.4 μm, and c=0.6 μm in mean values, mean aspect ratio of 5.2, mean diameter as spheres of 0.52 μm, and variation coefficient of 15% for mean diameter as spheres (a, b and c have the meanings defined in the present specification).

To the wet cake corresponding to 100 g of the dry solid content was added with 7.4 g of polyvinyl alcohol (PVA-217, trade name) and water to make the total amount 385 g, and the mixture was pre-dispersed by a homomixer.

Then, the pre-dispersed stock dispersion was treated three times by using a dispersing machine (Microfluidizer-M-110S-EH; trade name, manufactured by Microfluidex International Corporation, using GLOZ interaction chamber) with a pressure controlled to be 1750 kg/cm$^2$ to obtain a silver behenate dispersion. As for the cooling operation, a dispersion temperature of 18° C. was achieved by providing coiled heat exchangers fixed before and after the interaction chamber and controlling the temperature of the refrigerant.

<<Preparation of 25 Weight % Dispersion of Reducing Agent 1>>

In an amount of 10 kg of Reducing agent 1 (1:1 mixture of 2,2-methylenebis-(4-methyl-6-tert-butylphenol) and 2,2-methylenebis-(4-ethyl-6-tert-butylphenol)), 10 kg of 20 weight % aqueous solution of denatured polyvinyl alcohol (Poval MP203, manufactured by Kuraray Co. Ltd.) were added with 16 kg of water and mixed sufficiently to form slurry. The slurry was fed by a diaphragm pump to a sand mill of horizontal type (UVM-2, manufactured by Imex Co.) containing zirconia beads having a mean particle size of 0.5 mm, and dispersed for 3 hours and 30 minutes. Then, the slurry was added with 0.2 g of benzothiazolinone sodium salt and water so that the concentration of the reducing agent should become 25 weight % to obtain 25 weight % dispersion of reducing agent complex. The reducing agent complex particles contained in the reducing agent complex dispersion had a median particle size of 0.46 μm and the maximum particle size of 2.0 μm or less. The obtained reducing agent complex dispersion was filtered through a polypropylene filter having a pore size of 10.0 μm to remove dusts and so forth, and stored.

<<Preparation of 10 Weight % Dispersion of Reducing Agent (D-168)>>

In an amount of 4 kg of Compound (D-168) and 10 kg of 10 weight % aqueous solution of denatured polyvinyl alcohol (Poval MP203, manufactured by Kuraray Co. Ltd.) were added with 5.1 kg of water and mixed sufficiently to form slurry. The slurry was fed by a diaphragm pump to a sand mill of horizontal type (UVM-2, manufactured by Imex Co.) containing zirconia beads having a mean particle size of 0.5 mm in 80% by volume based on the internal volume of the mill, and dispersed for 8 hours. Then, the slurry was added with water so that the concentration of the reducing agent should become 10 weight % to obtain reducing agent dispersion. The reducing agent particles contained in the reducing agent dispersion had a median particle size of 0.20 μm and the maximum particle size of 0.7 μm or less. The particle size was measured by the particle distribution measuring apparatus with a laser diffraction and scattering, LA920 manufactured by Horiba Co. Ltd. The obtained reducing agent dispersion was filtered through a polypropylene filter having a pore size of 3 μm to remove dusts and so forth, and stored. Further, the dispersion was filtered through a polypropylene filter having a pore size of 10.0 μm immediately before use.

<<Preparation of 10 Weight % Dispersion of Mercapto Compound>>

In an amount of 5 kg of 1-phenyl-2-heptyl-5-mercapto-1,3,4-triazole and 5 kg of 20 weight % aqueous solution of denatured polyvinyl alcohol (Poval MP203, manufactured by Kuraray Co., Ltd.) were added with 8.3 kg of water and mixed sufficiently to form slurry. The slurry was fed by a diaphragm pump to a sand mill of horizontal type (UVM-2, manufactured by Imex Co.) containing zirconia beads having a mean particle size of 0.5 mm, and dispersed for 6 hours. Then, the slurry was added with water so that the concentration of the mercapto compound should become 10 weight % to obtain a mercapto compound dispersion. The mercapto compound particles contained in the dispersion had a median particle size of 0.40 μm and the maximum particle size of 2.0 μm or less. The obtained mercapto compound dispersion was filtered through a polypropylene filter having a pore size of 10.0 μm to remove dusts and so forth, and stored. Further, the dispersion was filtered through a polypropylene filter having a pore size of 10.0 μm immediately before use.

<<Preparation of Organic Polyhalogenated Compound Dispersion 1>>

In an amount of 5 kg of tribromomethylphenylsulfone, 2.5 kg of 20 weight % aqueous solution of denatured polyvinyl alcohol (Poval MP203, manufactured by Kuraray Co., Ltd.) and 213 g of 20 weight % aqueous solution of sodium triisopropylnaphthalenesulfonate and 10 kg of water were mixed sufficiently to form slurry. The slurry was fed by a diaphragm pump to a sand mill of horizontal type (UVM-2, manufactured by Imex Co.) containing zirconia beads having a mean particle size of 0.5 mm, and dispersed for 5 hours. Then, the slurry was added with 0.2 g of benzisothiazolinone sodium salt and water so that the concentration of the organic polyhalogenated compound should become 25 weight % to obtain organic polyhalogenated compound dispersion. The organic polyhalogenated compound particles contained in the organic polyhalogenated compound dispersion obtained as described above had a median particle size of 0.36 μm and the maximum particle size of 2.0 μm or less. The obtained organic polyhalogenated compound dispersion was filtered through a polypropylene filter having a pore size of 3.0 μm to remove dusts and so forth, and stored.

<<Preparation of Organic Polyhalogenated Compound Dispersion 2>>

A dispersion was prepared in the same manner as the above preparation of Organic polyhalogenated compound dispersion 1 except that 5 kg of N-butyl-3-tribromomethanesulfonylbenzamide was used instead of 5 kg of tribromomethylphenylsulfone, diluted so that the concentration of the organic polyhalogenated compound should become 25 weight %, and filtered to obtain Organic polyhalogenated compound dispersion 2. The organic polyhalogenated compound particles contained in the organic polyhalogenated compound dispersion obtained as described above had a median particle size of 0.38 μm and the maximum particle size of 2.0 μm or less. The obtained organic polyhalogenated compound dispersion was filtered through a polypropylene filter having a pore size of 3.0 μm to remove dusts and so forth, and stored.

<<Preparation of 25 Weight % Dispersion of Hydrogen Bond-forming Compound>>

In an amount of 10 kg of triphenylphosphine oxide and 10 kg of 20 weight % aqueous solution of denatured polyvinyl alcohol (Poval MP203, manufactured by Kuraray Co., Ltd.) were added with 16 kg of water and mixed sufficiently to form slurry. The slurry was fed by a diaphragm pump to a sand mill of horizontal type (UVM-2, manufactured by Imex Co.) containing zirconia beads having a mean particle size of 0.5 mm, and dispersed for 3 hours and 30 minutes. Then, the slurry was added with 0.2 g of benzoisothiazolinone and water so that the concentration of hydrogen bond-forming compound should become 25 weight % to obtain dispersion of hydrogen bond-forming compound. The particles of the hydrogen bond-forming compound contained in the dispersion of the hydrogen bond-forming compound had a median particle size of 0.42 μm and the maximum particle size of 2.0 μm or less. The obtained hydrogen bond-forming compound dispersion was filtered through a polypropylene filter having a pore size of 10.0 μm to remove dusts and so forth, and stored.

<<Preparation of 5 Weight % Solution of Phthalazine Compound>>

In an amount of 8 kg of denatured polyvinyl alcohol (MP-203, manufactured by Kuraray Co., Ltd.) was dissolved in 174.57 kg of water and then added with 3.15 kg of 20 weight % aqueous solution of sodium triisopropylnaphthalenesulfonate and 14.28 kg of 70 weight % aqueous solution of 6-isopropylphthalazine to obtain a 5 weight % solution of 6-isopropylphthalazine.

<<Preparation of 20 Weight % Dispersion of Pigment>>

In an amount of 64 g of C.I. Pigment Blue 60 and 6.4 g of Demor N manufactured by Kao Corporation, and 250 g of water were mixed sufficiently to provide slurry. Then, 800 g of zirconia beads having a mean particle size of 0.5 mm were placed in a vessel together with the slurry and the slurry was dispersed by a dispersing machine (¼ G Sand Grinder Mill; manufactured by Imex Co.) for 25 hours to obtain a pigment dispersion. The pigment particles contained in the dispersion obtained as described above had a mean particle size of 0.21 μm.

<<Preparation of 40 Weight % Aqueous Solution of SBR Latex>>

The SBR latex mentioned below diluted by 10 times with distilled water was diluted and purified by using an UF-purification module FS03-FC-FUY03A1 (manufactured by Daisen Membrane System K.K.) until the ion conductivity became 1.5 mS/cm, and added with Sandet-BL (manufactured by SANYO CHEMICAL INDUSTRIES, LTD.) to a concentration of 0.22 weight %. Further, the latex was added with NaOH and $NH_4OH$ so that the ratio of $Na^+$ ion:$NH_4^+$ ion should become 1:2.3 (molar ratio) to adjust pH to 8.4 to form a 40 weight % aqueous solution of SBR latex.

(SBR latex: a latex of -St(68)-Bu(29)-AA(3)-, wherein the numerals in the parentheses indicate the contents in terms of % by weight, St represents styrene, Bu represents butadiene and AA represents acrylic acid)

The latex had the following characteristics: mean particle size of 0.1 μm, concentration of 45 weight %, equilibrated moisture content of 0.6 weight % at 25° C. and relative humidity of 60%, and ion conductivity of 4.2 mS/cm (measured for the latex stock solution (40 weight %) at 25° C. by using a conductometer, CM-30S, manufactured by Toa Electronics, Ltd.), pH 8.2.

<<Preparation of Coating Solution for Emulsion Layer (Photosensitive Layer)>>

In an amount of 1.1 g of the 20 weight % dispersion of pigment, 103 g of the aliphatic acid silver salt dispersion, 5 g of 20 weight % of aqueous solution of polyvinyl alcohol PVA-205 (Kraray Co., Ltd.), 15.1 g of the 25 weight % dispersion of Reducing agent 1, 11.2 g of the 25 weight % dispersion of hydrogen bond-forming compound, 8.2 g in total of Organic polyhalogenated compound dispersions 1 and 2 (weight ratio=1:3), 6.2 g of the 10 weight % dispersion of mercapto compound, 106 g of the 40 weight % aqueous solution of SBR latex undergone the ultrafiltration (UF) purification and pH adjustment and 18 ml of the 5 weight % solution of phthalazine compound, which were obtained above, were mixed sufficiently, and mixed sufficiently with 10 g of Silver halide mixed emulsion A immediately before coating to prepare a coating solution for emulsion layer. The coating solution was fed as it was to a coating die in such a feeding amount giving a coating amount of 70 ml/m$^2$ and coated.

The viscosity of the obtained coating solution for emulsion layer was measured by a B-type viscometer manufactured by Tokyo Keiki K.K. and found to be 85 [mPa·s] at 40° C. (Rotor No. 1, 60 rpm).

The viscosity of the coating solution was measured at 25° C. by an RFS fluid spectrometer produced by Rheometric Far East Co., Ltd., and found to be 1500, 220, 70, 40 and 20 [mPa·s] at shear rates of 0.1, 1, 10, 100 and 1000 [l/second], respectively.

<<Preparation of Coating Solution for Intermediate Layer on Image-forming Layer Side>>

In an amount of 772 g of a 10 weight % aqueous solution of polyvinyl alcohol, PVA-205 (manufactured by Kuraray Co., Ltd.), 5.3 g of the 20 weight % dispersion of pigment, 226 g of 27.5 weight % solution of methyl methacrylate/styrene/butyl acrylate/hydroxyethyl methacrylate/acrylic acid copolymer (copolymerization ratio (by weight): 64/9/20/5/2) latex, 2 ml of a 5 weight % aqueous solution of Aerosol OT (manufactured by American Cyanamid Company), 10.5 ml of a 20 weight % aqueous solution of phthalic acid diammonium salt and water in such an amount giving a total amount of 880 g were mixed and adjusted to pH 7.5 with NaOH to form a coating solution for intermediate layer. This coating solution was fed to a coating die in such an amount that gave a coating amount of 10 ml/m$^2$.

The viscosity of the coating solution measured by a B-type viscometer at 40° C. (Rotor No. 1, 60 rpm) was 21 [mPa·s].

<<Preparation of Coating Solution for 1st Protective Layer on Emulsion Layer Side>>

In an amount of 64 g of inert gelatin was dissolved in water, added with 80 g of a 27.5 weight % latex solution of methyl methacrylate/styrene/butyl acrylate/hydroxyethyl methacrylate/acrylic acid copolymer (copolymerization ratio (by weight): 64/9/20/5/2), 23 ml of a 10 weight % methanol solution of phthalic acid, 23 ml of a 10 weight % aqueous solution of 4-methylphthalic acid, 28 ml of 0.5 mol/L sulfuric acid, 5 ml of a 5 weight % aqueous solution of Aerosol OT (manufactured by American Cyanamid Company), 0.5 g of phenoxyethanol, 0.1 g of benzoisothiazolinone, and water in such an amount that gave a total amount of 750 g to form a coating solution. The coating solution was mixed with 26 ml of 4 weight % chromium alum by a static mixer immediately before coating, and fed to a coating die in such an amount that gave a coating amount of 18.6 ml/m$^2$.

The viscosity of the coating solution measured by a B-type viscometer (Rotor No. 1, 60 rpm) at 40° C. was 17 [mPa·s]

<<Preparation of Coating Solution for 2nd Protective Layer on Emulsion Layer Side>>

In an amount of 80 g of inert gelatin was dissolved in water, added with 102 g of 27.5 weight % latex solution of methyl methacrylate/styrene/butyl acrylate/hydroxyethyl methacrylate/acrylic acid copolymer (copolymerization ratio (by weight): 64/9/20/5/2), 3.2 ml of a 5 weight % solution of N-perfluorooctylsulfonyl-N-propylalanine potassium salt, 32 ml of a 2 weight % aqueous solution of polyethylene glycol mono(N-perfluorooctylsulfonyl-N-propyl-2-aminoethyl) ether [average polymerization degree of ethylene oxide=15], 23 ml of 5 weight % aqueous solution of Aerosol OT (manufactured by American Cyanamid Company), 4 g of polymethyl methacrylate microparticles (mean particle size: 0.7 μm), 21 g of polymethyl methacrylate microparticles (mean particle size: 4.5 μm), 1.6 g of 4-methylphthalic acid, 4.8 g of phthalic acid, 44 ml of 0.5 mol/L sulfuric acid, 10 mg of benzoisothiazolinone and water in such an amount that gave a total amount of 650 g were mixed to form a coating solution. The coating solution was further mixed with 445 ml of an aqueous solution containing 4 weight % of chromium alum and 0.67 weight % of phthalic acid by a static mixer immediately before coating to form a coating solution for protective layer, and fed to a coating die in such an amount that gave a coating amount of 8.3 ml/m$^2$.

The viscosity of the coating solution measured by a B-type viscometer (Rotor No. 1, 60 rpm) at 40° C. was 9 [mPa·s].

<<Preparation of Photothermographic Material Sample No. 301>>

On the back surface side of the aforementioned support having undercoat layers, the coating solution for antihalation layer and the coating solution for back surface protective layer were simultaneously applied as stacked layers so that the applied solid content amount of the solid microparticle dye in the antihalation layer should be 0.04 g/m$^2$, and the applied amount of gelatin in the back surface protective layer should be 1.7 g/m$^2$, and dried to form a back layer.

Then, on the side opposite to the back side, an emulsion layer (coated silver amount of the silver halide was 0.14 g/m$^2$), intermediate layer, first protective layer and second protective layer were simultaneously coated in this order from the undercoat layer by the slide bead coating method as stacked layers to form a sample of photothermographic material. The conditions of coating and drying were as follows.

The coating was performed at a speed of 160 m/min. The gap between the tip of coating die and the support was set to be 0.10 to 0.30 mm, and the pressure in the reduced pressure chamber was adjusted to be lower than the atmospheric pressure by 196–882 Pa. Electrostatic charge of the support was eliminated by ionized wind immediately before the coating.

In the subsequent chilling zone, the coating solutions were dried with air blow showing a dry-bulb temperature of 10–20° C. Then, the material was transported without contact, and dried with drying air showing a dry-bulb temperature of 23–45° C. and a wet-bulb temperature of 15–21° C. in a coil-shaped non-contact type drier.

After the drying, the material was conditioned for its moisture content at 25° C. and relative humidity of 40–60%, and heated so that the temperature of film surface should become 70–90° C. After the heating, the material was cooled to 25° C. as a temperature of film surface.

The prepared photothermographic material showed matting degree of 550 seconds for the photosensitive layer side, and 130 seconds for the back surface, in terms of Beck's smoothness. The film surface pH on the photosensitive layer side was measured to be 6.0.

Spectral sensitizing dye A

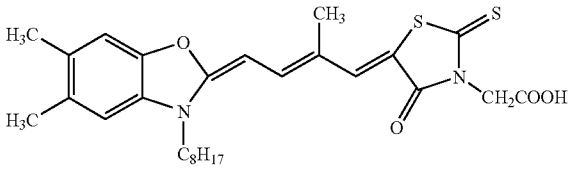

Tellurium sensitizer B

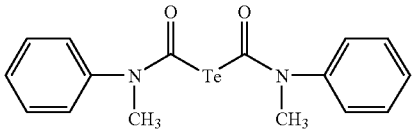

Base precursor compound 11

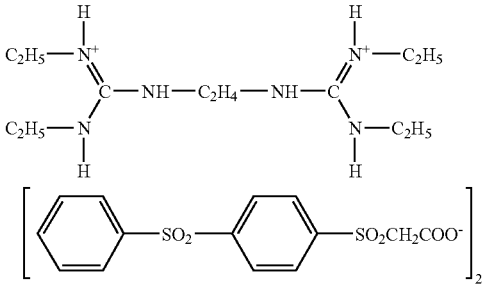

Cyanine dye compound 13

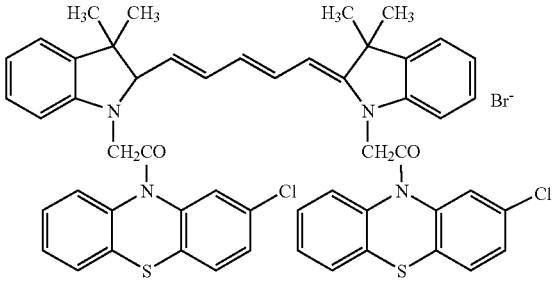

-continued

Blue dye compound 14

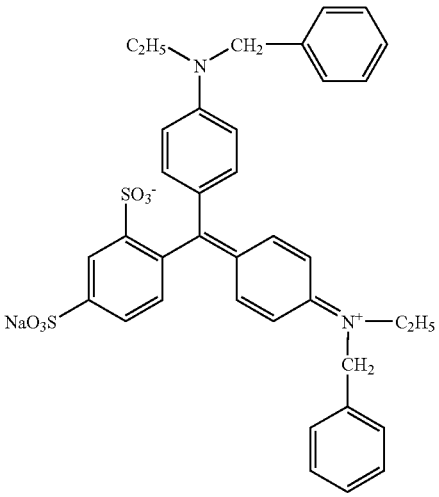

Samples were further prepared in the same manner as the aforementioned photothermographic material except that 10 weight % dispersion of Reducing agent (D-168) represented by the general formula (1) was added as shown in Table 3 (amount was 3 mole % with respect to Reducing agent 1 represented by the general formula (2)) and type of the hydrogen bond-forming compound was changed as shown in Table 3. The hydrogen bond-forming compounds were used in a molar amount equivalent to that of triphenylphosphine oxide.

(Evaluation of Photographic Performance)

Each of the photographic materials was light-exposed and heat-developed (at about 120° C.) by using Fuji Medical Dry Laser Imager FM-DP L (equipped with a semiconductor laser of 660 nm and a maximum output of 60 mW (IIIB)), and the obtained image was evaluated by a densitometer. The measurement results were evaluated as Dmax, fog (Dmin) and sensitivity as in Example 1. The sensitivity was expressed with relative values to the sensitivity of Photothermographic material 301 shown in Table 3 as a base line. The results are shown in Table 3. Further, each photosensitive material after the development was stored at 55° C. and relative humidity of 70% for 3 days, and change of Dmin during that storage was measured. The results for the difference are also shown in Table 3.

TABLE 3

| Sample No. | Compound of Formula (1) | Hydrogen bond-forming compound | Sensitivity ΔS | Image density Dmin | Image density Dmax | Image storability ΔDmin | Note |
|---|---|---|---|---|---|---|---|
| 301 | — | — | ±0 | 0.16 | 3.88 | 0.30 | Comparative |
| 302 | — | (P-1) | −0.06 | 0.17 | 3.84 | 0.18 | Comparative |
| 303 | D-168 | — | 0.23 | 0.21 | 4.02 | 0.35 | Invention |
| 304 | D-168 | (P-1) | 0.22 | 0.17 | 3.95 | 0.19 | Invention (preferred embodiment) |
| 305 | D-168 | (P-2) | 0.21 | 0.16 | 3.98 | 0.17 | Invention (preferred embodiment) |
| 306 | D-168 | (P-3) | 0.21 | 0.16 | 3.94 | 0.16 | Invention (preferred embodiment) |
| 307 | D-168 | (P-6) | 0.20 | 0.15 | 4.00 | 0.15 | Invention (preferred embodiment) |

From the results shown in Table 3, it can be seen that sensitivity can be markedly improved by using a hydrogen bond-forming compound in the photothermographic material of the present invention without degrading fog and image storability.

Example 4

(Preparation of PET Support)

PET having IV (intrinsic viscosity) of 0.66 (measured in phenol/tetrachloroethane=6/4 (weight ratio) at 25° C.) was obtained by using terephthalic acid and ethylene glycol in a conventional manner. The product was pelletized, dried at 130° C. for 4 hours, then melted at 300° C., and extruded from a T-die and rapidly cooled to form an unstretched film having such a thickness that the film should have a thickness of 175 μm after thermal fixation.

The film was stretched along the longitudinal direction by 3.3 times using rollers of different peripheral speeds, and then stretched along the transverse direction by 4.5 times using a tenter. The temperatures of these operations were 110° C. and 130° C., respectively. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4 kg/cm$^2$. Thus, a roll of a film having a thickness of 175 μm was obtained.

(Surface Corona Discharge Treatment)

Using a solid state corona discharging treatment machine Model 6KVA manufactured by Piller Inc., both surfaces of the support were treated at room temperature at 20 m/minute. The readings of electric current and voltage during the treatment indicated that the support underwent the treatment of 0.375 kV·A·minute/m$^2$. The discharging frequency of the treatment was 9.6 kHz, and the gap clearance between the electrode and the dielectric roll was 1.6 mm.

(Preparation of Support Having Undercoat Layers)

(1) Preparation of Coating Solutions for Undercoat Layers

| Formulation 1 (for undercoat layer on photosensitive layer side) | |
|---|---|
| Pesresin A-515GB made by Takamatsu Yushi K.K. (30 weight % solution) | 234 g |
| Polyethylene glycol monononylphenyl ether (mean ethylene oxide number = 8.5, 10 weight % solution) | 21.5 g |
| MP-1000 made by Soken Kagaku K.K. (polymer microparticles, mean particle size: 0.4 μm) | 0.91 g |
| Distilled water | 744 ml |

-continued

| Formulation 2 (for 1st layer on back surface) | |
|---|---|
| Styrene/butadiene copolymer latex (solid content: 40 weight %, weight ratio of styrene/butadiene = 32/68) | 158 g |
| 2,4-Dichloro-6-hydroxy-S-triazine sodium salt (8 weight % aqueous solution) | 20 g |
| 1 weight % Aqueous solution of sodium laurylbenzenesulfonate | 10 ml |
| Distilled water | 854 ml |

| Formulation 3 (for 2nd layer on back surface side) | |
|---|---|
| $SnO_2$/SbO (weight ratio: 9/1, mean particle size: 0.038 μm, 17 weight % dispersion) | 84 g |
| Gelatin (10% aqueous solution) | 89.2 g |
| Metorose TC-5 made by Shin-Etsu Chemical Co., Ltd. (2% aqueous solution) | 8.6 g |
| MP-1000 (polymer microparticles) made by Soken Kagaku K.K. | 0.01 g |
| 1 weight % Aqueous solution of sodium dodecylbenzenesulfonate | 10 ml |
| NaOH (1 weight %) | 6 ml |
| Proxel (made by ICI Co.) | 1 ml |
| Distilled water | 805 ml |

(Preparation of Support Having Undercoat Layers)

On one surface (photosensitive layer side) of the aforementioned biaxially stretched polyethylene terephthalate support having a thickness of 175 μm, both of which surfaces had been subjected to the above corona discharging treatment, the undercoating solution of Formulation 1 was coated by a wire bar in a wet coating amount of 6.6 ml/m$^2$ (for one surface) and dried at 180° C. for 5 minutes. Then, the opposite surface (back surface) thereof was coated with the undercoating solution of Formulation 2 by a wire bar in a wet coating amount of 5.7 ml/m$^2$ and dried at 180° C. for 5 minutes. The back surface thus coated was further coated with the undercoating solution of Formulation 3 by a wire bar in a wet coating amount of 7.7 ml/m$^2$ and dried at 180° C. for 6 minutes to prepare a support having undercoat layers.

(Preparation of Coating Solution for Back Surface)

(Preparation of Solid Microparticle Dispersion of Base Precursor (a))

In an amount of 64 g of Base precursor compound 11, 28 g of diphenylsulfone and 10 g of surface active agent, Demor N (manufactured by Kao Corporation) were mixed with 220 ml of distilled water, and the mixture was bead-dispersed using a sand mill (¼ Gallon Sand Grinder Mill, manufactured by Imex Co.) to obtain solid microparticle dispersion of the base precursor compound (a) having a mean particle size of 0.2 μm.

(Preparation of Dye Solid Microparticle Dispersion)

In an amount of 9.6 g of Cyanine dye compound 13 and 5.8 g of sodium p-dodecylbenzenesulfonate were mixed with 305 ml of distilled water, and the mixture was bead-dispersed using a sand mill (¼ Gallon Sand Grinder Mill, manufactured by Imex Co.) to obtain a dye solid microparticle dispersion having a mean particle size of 0.2 μm.

(Preparation of Coating Solution for Antihalation Layer)

In an amount of 17 g of gelatin, 9.6 g of polyacrylamide, 70 g of the solid microparticle dispersion of the base precursor (a), 56 g of the above dye solid microparticle dispersion, 1.5 g of monodispersed polymethyl methacrylate microparticles (mean particle size: 8 μm, standard deviation for particle size: 0.4), 0.03 g of benzoisothiazolinone, 2.2 g of sodium polyethylenesulfonate, 0.2 g of Blue dye compound 14 and 844 ml of water were mixed to prepare a coating solution for antihalation layer.

(Preparation of Coating Solution for Back Surface Protective Layer)

In a container kept at 40° C., 50 g of gelatin, 0.2 g of sodium polystyrenesulfonate, 2.4 g of N,N-ethylenebis(vinylsulfonacetamide), 1 g of sodium tert-octylphenoxyethoxy-ethanesulfonate, 30 mg of benzoisothiazolinone, 37 mg of fluorinated surface active agent (F-5), 0.15 g of fluorinated surface active agent (F-6: average polymerization degree of ethylene oxide is 15), 64 mg of fluorinated surface active agent (F-7), 32 mg of fluorinated surface active agent (F-8), 8.8 g of acrylic acid/ethyl acrylate copolymer (copolymerization ratio (by weight): 5/95), 0.6 g of Aerosol OT (manufactured by American Cyanamid Company), 1.8 g (as liquid paraffin) of liquid paraffin emulsion and 950 ml of water were mixed to form a coating solution for back surface protective layer.

<<Preparation of Silver Halide Emulsion 1>>

In a titanium-coated stainless steel reaction vessel, 1421 ml of distilled water, 3.1 ml of 1 weight % potassium bromide solution, 3.5 ml of 0.5 mol/L sulfuric acid and 31.7 g of phthalized gelatin were added and maintained at 30° C. with stirring. Separately, Solution A was prepared by adding distilled water to 22.22 g of silver nitrate to dilute it to 95.4 ml, and Solution B was prepared by diluting 15.3 g of potassium bromide and 0.8 g of potassium iodide with distilled water to a volume of 97.4 ml. To the aforementioned mixture in the titanium-coated stainless steel reaction vessel, the whole volumes of Solution A and Solution B were added over 45 seconds at constant flow rates. Then, the mixture was added with 10 ml of 3.5 weight % aqueous hydrogen peroxide solution, and further added with 10.8 ml of a 10 weight % aqueous solution of benzimidazole. Separately, Solution C was prepared by adding distilled water to 51.86 g of silver nitrate to dilute it to 317.5 ml, and Solution D was prepared by diluting 44.2 g of potassium bromide and 2.2 g of potassium iodide with distilled water to a volume of 400 ml. The whole volume of Solution C was added to the above mixture over 20 minutes at a constant flow rate. Solution D was added by the control double jet method while pAg was maintained at 8.1. Hexachloroiridic acid (III) potassium salt in an amount of $1\times10^{-4}$ mole per mole of silver was added 10 minutes after the addition of Solutions C and D was started. Further, an aqueous solution of potassium iron (II) hexacyanide in an amount of $3\times10^{-4}$ mole per mole of silver was added 5 seconds after the addition of Solution C was completed. Then, the mixture was adjusted to pH 3.8 using 5 mol/L sulfuric acid, and the stirring was stopped. Then, the mixture was subjected to precipitation, desalting and washing with water, and adjusted to pH 5.9 with sodium hydroxide at a concentration of 1 mol/L to form a silver halide dispersion having pAg of 8.0.

The obtained silver halide dispersion was added with 5 ml of a 0.34 weight % methanol solution of 1,2-benzisothiazolin-3-one with stirring at 38° C., and after 40 minutes since then, added with a methanol solution of Spectral sensitizing dye A and Spectral sensitizing dye B (molar ratio 1:1) in a sum amount of $1.2\times10^{-3}$ mole per mole of silver. After 1 minutes, the mixture was warmed to 47° C., and 20 minutes after the warming, added with $7.6\times10^{-5}$ mole of sodium benzenethiosulfonate per mole of silver as a methanol solution. Further after 5 minutes, the mixture was added with Tellurium sensitizer C as a methanol solution in an amount of $2.9\times10^{-4}$ mole per mole of silver followed by ripening for 91 minutes. The mixture was added with 1.3 ml of a 0.8 weight % methanol solution of N,N'-dihydroxy-N"-diethylmelamine, and 4 minutes later, added with 5-methyl-2-mercaptobenzimidazole in an amount of $4.8\times10^{-3}$ mole per mole of silver as a methanol solution and 1-phenyl-2-heptyl-5-mercapto-1,3,4-triazole in an amount of $5.4\times10^{-3}$ mole per mole of silver as a methanol solution to prepare Silver halide emulsion 1.

The grains in the obtained Silver halide emulsion 1 were pure silver bromide grains having a mean diameter as spheres of 0.046 μm and a variation coefficient of 20% for mean diameter as spheres. The grain size and others were obtained from averages for 1000 grains by using an electron microscope. The [100] face ratio of these grains was determined to be 80% by the Kubelka-Munk method.

<<Preparation of Silver Halide Emulsion 2>>

Silver halide emulsion 2 was prepared in the same manner as the preparation of Silver halide emulsion 1 except that the liquid temperature during the formation of the grains was changed from 30° C. to 47° C., Solution B was changed to the solution prepared by diluting 15.9 g of potassium bromide with distilled water to a volume of 97.4 ml, Solution D was changed to the solution prepared by diluting 45.8 g of potassium bromide with distilled water to a volume of 400 ml, addition time of Solution C was changed to 30 minutes, and potassium iron (II) hexacyanide was not used. Precipitation, desalting, washing with water and dispersion were performed in the same manner as the preparation of Silver halide emulsion 1. Further, spectral sensitization, chemical sensitization and addition of 5-methyl-2-mercapto-benzimidazole and 1-phenyl-2-heptyl-5-mercapto-1,3,4-triazole were performed in the same manner as the preparation of Silver halide emulsion 1 except that the amount of the methanol solution of Spectral sensitizing dye A and Spectral sensitizing dye B (molar ratio 1:1) was changed to $7.5\times10^{-4}$ mole per mole of silver, the amounts of Tellurium sensitizer C and 1-phenyl-2-heptyl-5-mercapto-1,3,4-triazole were changed to $1.1\times10^{-4}$ mole and $3.3\times10^{-3}$ mole per mole of silver, respectively, to obtain Silver halide emulsion 2. The emulsion grains in Silver halide emulsion 2 were pure silver bromide cubic grains having a mean grain size of 0.080 μm as spheres and variation coefficient of 20% for diameter as spheres.

<<Preparation of Silver Halide Emulsion 3>>

Silver halide emulsion 3 was prepared in the same manner as the preparation of Silver halide emulsion 1 except that the liquid temperature during the formation of the grains was changed from 30° C. to 27° C. Further, precipitation, desalting, washing with water and dispersion were performed in the same manner as the preparation of Silver halide emulsion 1. Silver halide emulsion 3 was obtained in the same manner as the preparation of Silver halide emulsion 1 except that Spectral sensitizing dye A and Spectral sensitizing dye B were added in the molar ratio of 1:1 as solid dispersion (gelatin aqueous solution) in a sum amount of Spectral sensitizing dyes A and B of $6\times10^{-3}$ mole per mole of silver and the amount of Tellurium sensitizer C was changed to $5.2\times10^{-4}$ mole per mole of silver. The grains in Silver halide emulsion 3 were silver bromide grains comprising 3.5 mole % of iodine homogeneously and having a mean grain size of 0.034 μm as spheres and variation coefficient of 20% for diameter as spheres.

<<Preparation of Mixed Emulsion A for Coating Solution>>

A mixture were prepared by mixing an amount of 70 weight % of Silver halide emulsion 1, 15 weight % of Silver halide emulsion 2 and 15 weight % of Silver halide emulsion 3. An aqueous solution of benzothiazolium iodide (1% by weight solution) was added to the mixture in an amount of $7\times10^{-3}$ mole permole of silver. Water was added to adjust the silver content to form Silver halide mixed emulsion A wherein 38.2 g of silver as silver halide was contained in 1 kg of the mixed emulsion.

<<Preparation of Aliphatic Acid Silver Salt Dispersion>>

In an amount of 87.6 kg of behenic acid (Edenor C22-85JP GW, trade name, manufactured by Cognis Deutschland GmbH), 423 L of distilled water, 49.2 L of 5 mol/L aqueous solution of NaOH, and 120 L of tert-butanol were mixed and allowed to react at 75° C. for one hour with stirring to obtain a solution of sodium behenate. Separately, 206.2 L of an aqueous solution containing 40.4 kg of silver nitrate (pH 4.0) was prepared and kept at 10° C. A mixture of 635 L of distilled water and 30 L of tert-butanol contained in a reaction vessel kept at 30° C. was added with the whole amount of the aforementioned sodium behenate solution and the whole amount of the aqueous silver nitrate solution with stirring at constant flow rates over the periods of 93 minutes and 15 seconds, and 90 minutes, respectively. In this case, they were added in such a manner that only the aqueous silver nitrate solution was added for 11 minutes after starting the addition of the aqueous silver nitrate solution. Then, the addition of the sodium behenate solution was started so that only the sodium behenate solution should be added for 14 minutes and 15 seconds after finishing the addition of the aqueous silver nitrate solution. In this operation, the outside temperature was controlled so that the temperature in the reaction vessel should be 30° C. and the liquid temperature should be constant. The piping of the addition system for the sodium behenate solution was warmed by steam trace and the steam opening was controlled such that the liquid temperature at the outlet orifice of the addition nozzle should be 75° C. The piping of the addition system for the aqueous silver nitrate solution was maintained by circulating cold water outside a double pipe. The addition position of the sodium behenate solution and the addition position of the aqueous silver nitrate solution were arranged symmetrically with respect to the stirring axis as the center, and the positions are controlled to be at heights for not contacting with the reaction mixture.

After finishing the addition of the sodium behenate solution, the mixture was left with stirring for 20 minutes at the same temperature. The temperature of the mixture was elevated to 35° C. for 30 minutes and the mixture was maintained at 35° C. for 210 minutes. Thereafter, the solid content was separated by suction filtration and washed with water until electric conductivity of the filtrate became 30 μS/cm. In this step, distilled water was added to the wet cake to form slurry three times to aid decrease of the conductance. The resultant wet cake was under a centrifugal force of 700 G for 1 hour. "G" is expressed by $1.119\times10^{-5}\times$radius of the container (cm)×[number of revolution (rpm)]$^2$. The wet cake of aliphatic acid silver salt thus obtained had a solid content of 44%, which was measured after drying 1 g of the wet cake at 110° C. for 2 hours.

When the shape of the obtained silver behenate grains was evaluated by an electron microscopic photography, the grains were scaly crystals having a=0.14 μm, b=0.4 μm, and c=0.6 μm in mean values, mean aspect ratio of 5.2, mean diameter as spheres of 0.52 μm, and variation coefficient of 15% for mean diameter as spheres (a, b and c have the meaning defined in the present specification).

To the wet cake corresponding to 260 kg of the dry solid content was added with 19.3 kg of polyvinyl alcohol (PVA-217, trade name) and water to make the total amount 1,000 kg, and the mixture was formed to slurry with disc of dissolver and pre-dispersed by a pipeline mixer manufactured by Mizuho Industry Co. Ltd., trade name PM-10.

Then, the pre-dispersed stock dispersion was treated three times by using a dispersing machine (Microfluidizer-M-610; trade name, manufactured by Microfluidex International Corporation, using Z interaction chamber) with a pressure controlled to be 1260 kg/cm$^2$to obtain a silver behenate dispersion. As for the cooling operation, a dispersion temperature of 18° C. was achieved by providing coiled heat exchangers fixed before and after the interaction chamber and controlling the temperature of the refrigerant.

<<Preparation of Dispersion of Reducing Agent 2>>

In an amount of 10 kg of Reducing agent 2 (2,2-methylenebis-(4-ethyl-6-tert-butylphenol)), 20 kg of 10 weight % aqueous solution of denatured polyvinyl alcohol (Poval MP203, manufactured by Kuraray Co. Ltd.) were added with 6 kg of water and mixed sufficiently to form slurry. The slurry was fed by a diaphragm pump to a sand mill of horizontal type (UVM-2, manufactured by Imex Co.) containing zirconia beads having a mean particle size of 0.5 mm, and dispersed for 3 hours and 30 minutes. Then, the slurry was added with 0.2 g of benzothiazolinone sodium salt and water so that the concentration of the reducing agent should become 25 weight % to obtain 25 weight % dispersion of reducing agent. The reducing agent particles contained in the reducing agent dispersion had a median particle size of 0.40 μm and the maximum particle size of 1.5 μm or less. The obtained reducing agent dispersion was filtered through a polypropylene filter having a pore size of 3.0 μm to remove dusts and so forth, and stored.

<<Preparation of Dispersion of Reducing Agent 3>>

In an amount of 10 kg of Reducing agent 3 (2,2'-methylenebis-(4-methyl-6-tert-butylphenol)), 20 kg of 10 weight % aqueous solution of denatured polyvinyl alcohol (Poval MP203, manufactured by Kuraray Co. Ltd.) were added with 6 kg of water and mixed sufficiently to form slurry. The slurry was fed by a diaphragm pump to a sand mill of horizontal type (UVM-2, manufactured by Imex Co.) containing zirconia beads having a mean particle size of 0.5 mm, and dispersed for 3 hours and 30 minutes. Then, the slurry was added with 0.2 g of benzothiazolinone sodium salt and water so that the concentration of the reducing agent should become 25 weight % to obtain 25 weight % dispersion of reducing agent. The reducing agent particles contained in the reducing agent dispersion had a median particle size of 0.38 μm and the maximum particle size of 1.5 μm or less. The obtained reducing agent dispersion was filtered through a polypropylene filter having a pore size of 3.0 μm to remove dusts and so forth, and stored.

<<Preparation of Dispersion of Hydrogen Bond-forming Compound 1>>

In an amount of 10 kg of hydrogen bond-forming compound 1 (tri(4-tert-butylphenyl)phosphine oxide) and 20 kg of 10 weight % aqueous solution of denatured polyvinyl alcohol (Poval MP203, manufactured by Kuraray Co., Ltd.) were added with 10 kg of water and mixed sufficiently to form slurry. The slurry was fed by a diaphragm pump to a sand mill of horizontal type (UVM-2, manufactured by Imex Co.) containing zirconia beads having a mean particle size of 0.5 mm, and dispersed for 3 hours and 30 minutes. Then, the slurry was added with 0.2 g of benzoisothiazolinone and water so that the concentration of hydrogen bond-forming compound should become 22 weight % to obtain dispersion of hydrogen bond-forming compound. The particles of the hydrogen bond-forming compound contained in the dispersion of the hydrogen bond-forming compound had a median particle size of 0.35 μm and the maximum particle size of 1.5 μm or less. The obtained hydrogen bond-forming compound dispersion was filtered through a polypropylene filter having a pore size of 3.5 μm to remove dusts and so forth, and stored.

<<Preparation of Organic Polyhalogenated Compound Dispersion 3>>

In an amount of 10 kg of organic polyhalogenated compound dispersion 3 (tribromomethanesulfonylbenzene, 10 kg of 20 weight % aqueous solution of denatured polyvinyl alcohol (Poval MP203, manufactured by Kuraray Co., Ltd.) and 0.4 kg of 20 weight % aqueous solution of sodium triisopropylnaphthalenesulfonate and 14 kg of water were mixed sufficiently to form slurry. The slurry was fed by a diaphragm pump to a sand mill of horizontal type (UVM-2, manufactured by Imex Co.) containing zirconia beads having a mean particle size of 0.5 mm, and dispersed for 5 hours. Then, the slurry was added with 0.2 g of benzisothiazolinone sodium salt and water so that the concentration of the organic polyhalogenated compound should become 26 weight % to obtain organic polyhalogenated compound dispersion. The organic polyhalogenated compound particles contained in the organic polyhalogenated compound dispersion obtained as described above had a median particle size of 0.41 μm and the maximum particle size of 2.0 μm or less. The obtained organic polyhalogenated compound dispersion was filtered through a polypropylene filter having a pore size of 10.0 μm to remove dusts and so forth, and stored.

<<Preparation of Organic Polyhalogenated Compound Dispersion 4>>

In an amount of 10 kg of organic polyhalogenated compound dispersion 4 (N-butyl-3-tribromomethanesulfonylbenzamide), 20 kg of 10 weight % aqueous solution of denatured polyvinyl alcohol (Poval MP203, manufactured by Kuraray Co., Ltd.) and 0.4 kg of 20 weight % aqueous solution of sodium triisopropylnaphthalenesulfonate and 8 kg of water were mixed sufficiently to form slurry. The slurry was fed by a diaphragm pump to a sand mill of horizontal type (UVM-2, manufactured by Imex Co.) containing zirconia beads having a mean particle size of 0.5 mm, and dispersed for 5 hours. Then, the slurry was added with 0.2 g of benzisothiazolinone sodium salt and water so that the concentration of the organic polyhalogenated compound should become 25 weight %. The dispersion was heated at 40° C. for 5 hours to obtain organic polyhalogenated compound dispersion. The organic polyhalogenated compound particles contained in the organic polyhalogenated compound dispersion obtained as described above had a median particle size of 0.36 μm and the maximum particle size of 1.5 μm or less. The obtained organic polyhalogenated compound dispersion was filtered through a polypropylene filter having a pore size of 3.0 μm to remove dusts and so forth, and stored.

<<Preparation of 5 Weight % Solution of Phthalazine Compound 1>>

In an amount of 8 kg of denatured polyvinyl alcohol (MP-203, manufactured by Kuraray Co., Ltd.) was dissolved in 174.57 kg of water and then added with 3.15 kg of 20 weight % aqueous solution of sodium triisopropylnaphthalenesulfonate and 14.28 kg of 70 weight % aqueous solution of phthalazine compound 1 (6-isopropylphthalazine) to obtain a 5 weight % solution of phthalazine compound 1.

<<Preparation of Aqueous Solution of Mercapto Compound>>

To 993 g of water was added 7 g of mercapto compound 1 (sodium salt of 1-(3-sulfophenyl)-5-mercaptotetrazol) to form an aqueous solution (concentration: 0.7 weight %)

<<Preparation of Pigment Dispersion 1>>

In an amount of 64 g of C.I. Pigment Blue 60 and 6.4 g of Demor N manufactured by Kao Corporation, and 250 g of water were mixed sufficiently to provide slurry. Then, 800 g of zirconia beads having a mean particle size of 0.5 mm were placed in a vessel together with the slurry and the slurry was dispersed by a dispersing machine (¼ G Sand Grinder Mill; manufactured by Imex Co.) for 25 hours to obtain a pigment dispersion 1. The pigment particles contained in the dispersion obtained as described above had a mean particle size of 0.21 μm.

<<Preparation of 10 Weight % Dispersion of Compound of Formula (1) >>

In an amount of 1 kg of Compound of formula (1) (types are shown in Table 4) and 5 kg of 10 weight % aqueous solution of denatured polyvinyl alcohol (Poval MP203, manufactured by Kuraray Co. Ltd.) were added with 5 kg of water and mixed sufficiently to form slurry. The slurry was fed by a diaphragm pump to a sand mill of horizontal type (UVM-2, manufactured by Imex Co.) containing zirconia beads having a mean particle size of 0.5 mm, and dispersed for 4 hours. Then, the slurry was added with 0.02 g of sodium benzoisothiazolinone and water so that the concentration of the compound of formula (1) should become 10 weight % to obtain a dispersion. The particles of the compound of formula (1) contained in the dispersion had a median particle size of 0.32 μm and the maximum particle size of 1.5 μm or less. The obtained dispersion was filtered through a polypropylene filter having a pore size of 3.0 μm to remove dusts and so forth, and stored.

<<Preparation of Solution of SBR Latex>>

SBR latex having Tg of 23° C. was prepared as follows:

Emulsion polymerization was conducted in a mixture of 70.5 parts by weight of styrene, 26.5 parts by weight of butadiene and 3 parts by weight of acrylic acid with ammonium persulfate as a polymerization initiator and anionic surface active agent as an emulsifier. After the emulsion polymerization, the mixture was under ageing for 8 hours and then cooled to 40° C. To the mixture, ammonia water was added to adjust pH of the mixture to 7.0 and Sandet BL manufactured by Sanyo Kasei Co. Ltd., was added to obtain a solution containing 0.22 weight % of Sandet BL. PH of the mixture was adjusted to 8.3 with addition of 5% solution of sodium hydroxide and then adjusted to 8.4 with addition of ammonoia water. The molar ratio of $Na^+$ and $NH_4^+$ used in this process is 1:2.3. To 1 kg of the resultant mixture was added 0.15 ml of 7% solution of sodium salt of benzoisothiazolinone to form SBR latex solution.

(SBR Latex: a latex of -St(70.5)-Bu(26.5)-AA(3)-, wherein the numerals in the parentheses indicate the contents in terms of % by weight, St represents styrene, Bu represents butadiene and AA represents acrylic acid)

The latex had the following characteristics: mean particle size of 0.1 μm, concentration of 43 weight %, equilibrated moisture content of 0.6 weight % at 25° C. and relative humidity of 60%, and ion conductivity of 4.2 mS/cm (measured for the latex stock solution (43 weight %) at 25° C. by using a conductometer, CM-30S, manufactured by Toa Electronics, Ltd.), pH 8.4. SBR latex having various Tg can be obtained in the same manner except for the ratio of styrene and butadiene.

<<Preparation of Coating Solution for Emulsion Layer (Photosensitive Layer)>>

A coating solution for emulsion layer was prepared by adding in order 1000 g of the aliphatic acid silver salt dispersion, 95 ml of water, 73 g of the dispersion of reducing agent 2, 69 g of the dispersion of reducing agent 3, 30 g of the dispersion of pigment 1, 21 g of the dispersion of organic polyhalogenated compound 3, 69 g of the dispersion of organic polyhalogenated compound 4, 173 g of the solution of phthalazine compound 1, 1082 g of the solution of SBR core-shell type latex (core (Tg:20° C.)/shell (Tg:30° C.)=70/30 by weight), 124 g of the dispersion of hydrogen bond-forming compound 1, 12 g of 10% dispersion of the compound of formula (1), 9 g of the solution of mercapto compound 1, and 110 g of Silver halide mixed emulsion A immediately before coating. The well-mixed coating solution was fed to a coating die and coated.

<<Preparation of Coating Solution for Intermediate Layer on Image-forming Layer Side>>

In an amount of 772 g of a 10 weight % aqueous solution of polyvinyl alcohol, PVA-205 (manufactured by Kuraray Co., Ltd.), 5.3 g of the 20 weight % dispersion of pigment, 226 g of 27.5 weight % solution of methyl methacrylate/styrene/butyl acrylate/hydroxyethyl methacrylate/acrylic acid copolymer (copolymerization ratio (by weight): 64/9/20/5/2) latex, 2 ml of a 5 weight % aqueous solution of Aerosol OT (manufactured by American Cyanamid Company), 10.5 ml of a 20 weight % aqueous solution of phthalic acid diammonium salt and water in such an amount giving a total amount of 880 g were mixed and adjusted to pH 7.5 with NaOH to form a coating solution for intermediate layer. This coating solution was fed to a coating die in such an amount that gave a coating amount of 10 ml/m$^2$.

The viscosity of the coating solution measured by a B-type viscometer at 40° C. (Rotor No. 1, 60 rpm) was 21 [mPa·s].

<<Preparation of Coating Solution for 1st Protective Layer on Emulsion Layer Side>>

In an amount of 64 g of inert gelatin was dissolved in water, added with 80 g of a 27.5 weight % latex solution of methyl methacrylate/styrene/butyl acrylate/hydroxyethyl methacrylate/acrylic acid copolymer (copolymerization ratio (by weight): 64/9/20/5/2), 23 ml of a 10 weight % methanol solution of phthalic acid, 23 ml of a 10 weight % aqueous solution of 4-methylphthalic acid, 28 ml of 0.5 mol/L sulfuric acid, 5 ml of a 5 weight % aqueous solution of Aerosol OT (manufactured by American Cyanamid Company), 0.5 g of phenoxyethanol, 0.1 g of benzoisothiazolinone, and water in such an amount that gave a total amount of 750 g to form a coating solution. The coating solution was mixed with 26 ml of 4 weight % chromium alum by a static mixer immediately before coating, and fed to a coating die in such an amount that gave a coating amount of 18.6 ml/m$^2$.

The viscosity of the coating solution measured by a B-type viscometer (Rotor No. 1, 60 rpm) at 40° C. was 17 [mPa·s]

<<Preparation of Coating Solution for 2nd Protective Layer on Emulsion Layer Side>>

In an amount of 80 g of inert gelatin was dissolved in water, added with 102 g of 27.5 weight % latex solution of methyl methacrylate/styrene/butyl acrylate/hydroxyethyl methacrylate/acrylic acid copolymer (copolymerization ratio (by weight): 64/9/20/5/2), 3.2 ml of a 5 weight % solution of fluorinated surface active agent (F-1), 32 ml of a 2 weight % aqueous solution of fluorinated surface active agent (F-2), 23 ml of 5 weight % aqueous solution of Aerosol OT (manufactured by American Cyanamid Company), 4 g of polymethyl methacrylate microparticles (mean particle size: 0.7 μm), 21 g of polymethyl methacrylate microparticles (mean particle size: 4.5 μm), 1.6 g of 4-methylphthalic acid, 4.8 g of phthalic acid, 44 ml of 0.5 mol/L sulfuric acid, 10 mg of benzoisothiazolinone and water in such an amount that gave a total amount of 650 g were mixed to form a coating solution. The coating solution was further mixed with 445 ml of an aqueous solution containing 4 weight % of chromium alum and 0.67 weight % of phthalic acid by a static mixer immediately before coating to form a coating solution for protective layer, and fed to a coating die in such an amount that gave a coating amount of 8.3 ml/m$^2$.

The viscosity of the coating solution measured by a B-type viscometer (Rotor No. 1, 60 rpm) at 40° C. was 9 [mPa·s]

<<Preparation of Photothermographic Material>>

On the back surface side of the aforementioned support having undercoat layers, the coating solution for antihalation layer and the coating solution for back surface protective layer were simultaneously applied as stacked layers so that the applied solid content amount of the solid microparticle dye in the antihalation layer should be 0.04 g/m$^2$, and the applied amount of gelatin in the back surface protective layer should be 1.7 g/m$^2$, and dried to form a back layer.

Then, on the side opposite to the back side, an emulsion layer, intermediate layer, first protective layer and second protective layer were simultaneously coated in this order from the undercoat layer by the slide bead coating method as stacked layers to form a sample of photothermographic material. In this process, the emulsion layer, the intermediate layer, the first protective layer and the second protective layer were maintained at 31° C., 31° C., 36° C. and 37° C., respectively. The coating amount of each compound contained in the emulsion layer is as follows:

| Compound | Content (g/m$^2$) |
|---|---|
| Silver behenate | 5.57 |
| Pigment (C.I. Pigment Blue 60) | 0.032 |
| Reducing agent 2 | 0.40 |
| Reducing agent 3 | 0.36 |
| Polyhalogenated compound 3 | 0.12 |
| Polyhalogenated compound 4 | 0.37 |
| Phthalazine compound 1 | 0.19 |
| SBR latex | 10.0 |
| Hydrogen bond-forming compound 1 | 0.59 |
| Compound of formula (1) or Comparative compound (see Tables 4 and 5) | 0.028 |
| Mercapto compound 1 | 0.002 |
| Silver halide (As Ag content) | 0.09 |

The conditions of coating and drying were as follows.

The coating was performed at a speed of 160 m/min. The gap between the tip of coating die and the support was set to be 0.10 to 0.30 mm, and the pressure in the reduced pressure chamber was adjusted to be lower than the atmospheric pressure by 196–882 Pa. Electrostatic charge of the support was eliminated by ionized wind immediately before the coating.

In the subsequent chilling zone, the coating solutions were dried with air blow showing a dry-bulb temperature of 10–20° C. Then, the material was transported without contact, and dried with drying air showing a dry-bulb temperature of 23–45° C. and a wet-bulb temperature of 15–21° C. in a coil-shaped non-contact type drier.

After the drying, the material was conditioned for its moisture content at 25° C. and relative humidity of 40–60%, and heated so that the temperature of film surface should become 70–90° C. After the heating, the material was cooled to 25° C. as a temperature of film surface.

The prepared photothermographic material showed matting degree of 550 seconds for the photosensitive layer side, and 130 seconds for the back surface, in terms of Beck's smoothness.

The film surface pH on the photosensitive layer side was measured to be 6.0.

The chemical structures of the compounds used in Example 4 are as follows:

Spectral sensitizing dye A

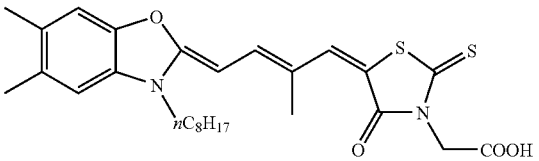

Spectral sensitizing dye B

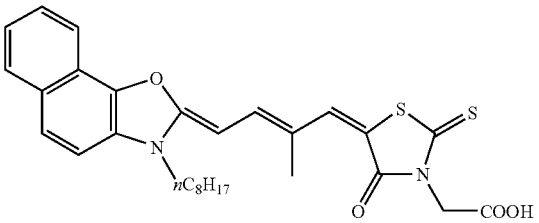

-continued

Tellurium sensitizer C

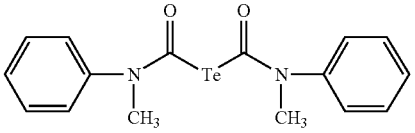

Base precursor compound 11

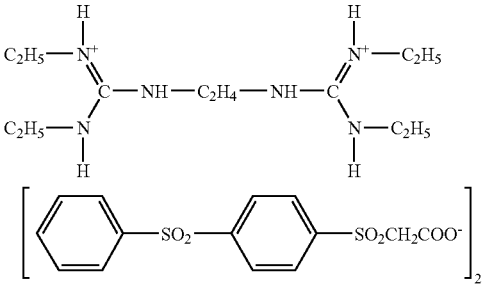

Cyanine dye compound 13

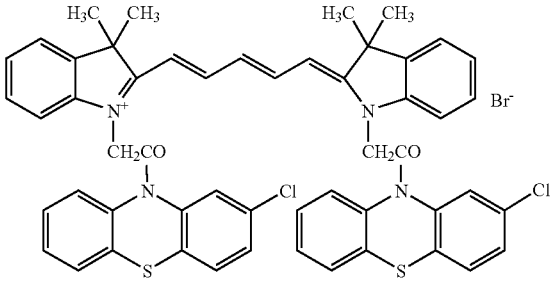

Blue dye compound 14

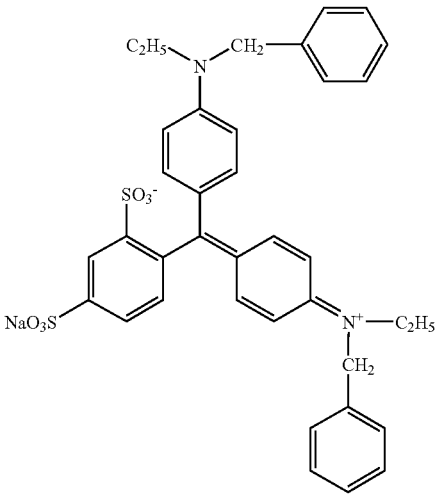

Reducing agent 2

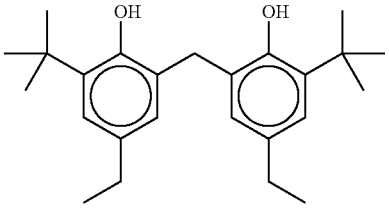

-continued

Reducing agent 3

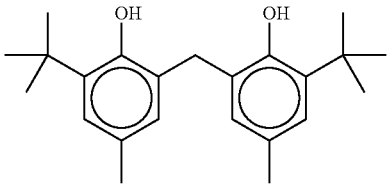

Hydrogen bond-forming compound 1

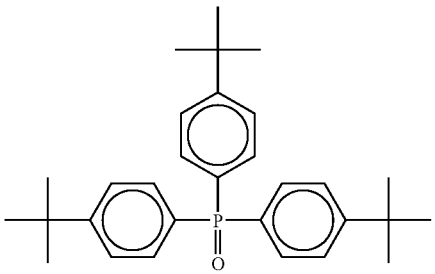

Polyhalogenated compound 4

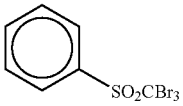

Polyhalogenated compound 5

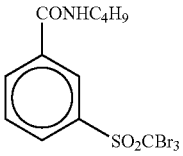

Mercapto compound 1

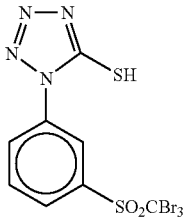

Phthalazine compound 1

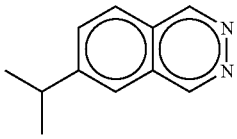

(F-1)

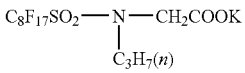

(F-2)

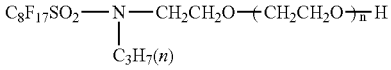

n = 15 (average)

(F-5)

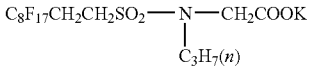

(F-6)

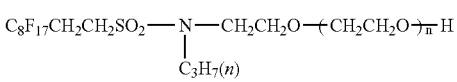

n = 15 (average)

-continued (F-7)

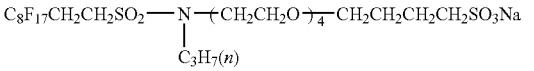

(F-8)

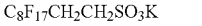

(Evaluation of Photographic Performance)

Each of the photographic materials was light-exposed and heat-developed (on four panel heaters at 112° C., 119° C., 121° C. and 121° C., respectively, for total 14 seconds) by using Fuji Medical Dry Laser Imager FM-DP L (equipped with a semiconductor laser of 660 nm and a maximum output of 60 mW (IIIB)), and sensitivity and Dmin of the obtained image were evaluated by a densitometer. The results are shown in Tables 4 and 5. The sensitivity was expressed with relative values to the sensitivity of Photothermographic material 401 shown in Table 4 as a base line (0.00).

TABLE 4

| Sample No. | Compound | Sensitivity ΔS | Dmin | Note |
|---|---|---|---|---|
| 401 | — | 0.00 | 0.18 | Comparative |
| 405 | D-115 | 0.09 | 0.16 | Invention |
| 406 | D-119 | 0.11 | 0.18 | Invention |
| 407 | D-120 | 0.10 | 0.18 | Invention |
| 408 | D-121 | 0.10 | 0.17 | Invention |
| 409 | D-122 | 0.12 | 0.18 | Invention |
| 410 | D-137 | 0.08 | 0.18 | Invention |
| 411 | D-157 | 0.14 | 0.17 | Invention |
| 412 | D-158 | 0.15 | 0.16 | Invention |
| 413 | D-162 | 0.15 | 0.16 | Invention |
| 414 | D-166 | 0.15 | 0.17 | Invention |
| 415 | D-168 | 0.16 | 0.16 | Invention |
| 416 | D-172 | 0.14 | 0.16 | Invention |
| 417 | D-175 | 0.13 | 0.17 | Invention |
| 418 | D-176 | 0.12 | 0.17 | Invention |
| 419 | D-185 | 0.14 | 0.17 | Invention |
| 420 | D-187 | 0.15 | 0.17 | Invention |

TABLE 5

| Sample No. | Compound | sum of σp | Sensitivity ΔS | Dmin | Note |
|---|---|---|---|---|---|
| 402 | D-101 | 2.04 | 0.10 | 0.18 | Invention |
| 403 | D-102 | 2.00 | 0.11 | 0.16 | Invention |
| 404 | D-105 | 2.16 | 0.10 | 0.16 | Invention |
| 421 | C-1 | 1.58 | 0.01 | 0.23 | Invention |

Comparative compound C-1 has the following chemical formula:

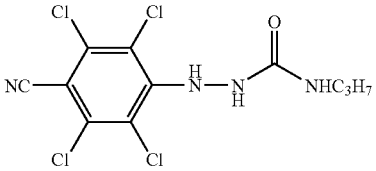

Table 4 indicates that the photothermographic materials of the present invention using a compound represented by the formula (1) have excellent properties in comparison with the comparative photothermographic materials. The photothermographic materials of the present invention have a sufficient sensitivity and give a low Dmin when they are developed for 14 seconds. These advantageous effects are enhanced when the photothermographic material contains a compound of formula (1) wherein $Q^1$ is a quinazoline ring bonding to NHNH—$R^1$ at a carbon atom, $R^1$ is a substituted carbamoyl group represented by —C(═O)—NH—$R^{11}$ and $R^{11}$ is an alkyl group or an aryl group having 1–10 carbon atoms. Table 5 indicates that higher sensitivity and lower Dmin can be obtained by using a compound of formula (1) wherein $Q^1$ is a substituted benzene ring and the sum of Hammett σp values of the substituents on the benzene ring is 1.6 or more.

What is claimed is:

1. A photothermographic material comprising:

(a) a photosensitive silver halide, (b) a reducible silver salt, (c) a reducing compound represented by the formula (1) below, (d) a binder, and (e) a compound represented by the formula (2) below, wherein the amount of the compound represented by the formula (1) is 0.1–10 mole % of the amount of the compound represented by the formula (2), and an image can be formed by only a single sheet of the photothermographic material without a functional layer constituting a separate member;

Formula (1):

$$Q^1\text{—NHNH—}R^1$$

wherein $Q^1$ represents a quinazoline ring bonding to NHNH—R at a carbon atom, and $R^1$ represents a carbamoyl group of the formula —C(═O)—NH—$R^{11}$ wherein $R^{11}$ is an alkyl group having 1 to 10 carbon atoms or an aryl group having 6 to 10 carbon atoms, Formula (2):

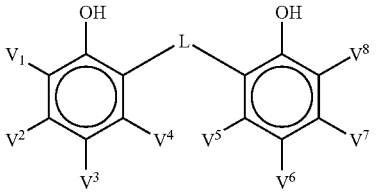

wherein $V^1$ to $V^8$ each independently represent hydrogen atom or a substituent, and L represents a bridging group consisting of —CH($V^9$)— or —S— where $V^9$ represents hydrogen atom or a substituent.

2. The photothermographic material according to claim 1, which further comprises (f) a compound represented by the formula (4) on the same surface of the support:

Formula (4):

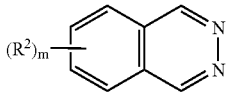

wherein, in the formula (4), $R^2$ represents hydrogen atom or a monovalent substituent, m represents an integer of 1 to 6 where $(R^2)_m$ means that 1–6 of Y independently exist on the phthalazine ring, and when m is 2 or more, adjacent two of $R^2$ may form an aliphatic ring or an aromatic ring.

3. The photothermographic material according to claim 2, wherein, in the formula (4), $R^2$ represents a monovalent substituent, and m represents an integer of 1 to 6.

4. The photothermographic material according to claim 1, wherein (b) the reducible silver salt is a silver salt of a long chain aliphatic carboxylic acid.

5. A method for forming images, which comprises developing a photothermographic material according to claim 1 by heating to form a silver image.

6. The method for forming images according to claim 5, wherein the heat development is performed at a temperature of 100–117° C.

* * * * *